United States Patent [19]

Takayama et al.

[11] Patent Number: 4,728,991

[45] Date of Patent: Mar. 1, 1988

[54] IMAGE FORMING APPARATUS

[75] Inventors: Kenzo Takayama, Tokyo; Haruo Shimizu, Yokohama, both of Japan

[73] Assignee: Canon Kabushiki Kaisha, Tokyo, Japan

[21] Appl. No.: 776,962

[22] Filed: Sep. 17, 1985 (Under 37 CFR 1.47)

[30] Foreign Application Priority Data

| | | | |
|---|---|---|---|
| Sep. 19, 1984 | [JP] | Japan | 59-194746 |
| Sep. 19, 1984 | [JP] | Japan | 59-194747 |
| Sep. 19, 1984 | [JP] | Japan | 59-194748 |
| Sep. 19, 1984 | [JP] | Japan | 59-194749 |
| Sep. 19, 1984 | [JP] | Japan | 59-194750 |

[51] Int. Cl.[4] ..... G03G 15/00

[52] U.S. Cl. ..... 355/14 TR; 355/3 TR; 271/307; 271/900

[58] Field of Search ..... 355/14 TR, 3 TR, 3 R; 271/307, 900; 358/300; 346/153.1

[56] References Cited

U.S. PATENT DOCUMENTS

| | | | |
|---|---|---|---|
| 4,027,960 | 6/1977 | Ladrigan | 355/14 TR |
| 4,183,653 | 1/1980 | Satomi et al. | 271/900 |
| 4,309,101 | 1/1982 | Nakamura et al. | 355/3 R |

*Primary Examiner*—R. L. Moses

*Attorney, Agent, or Firm*—Fitzpatrick, Cella, Harper & Scinto

[57] ABSTRACT

An image forming apparatus such as a laser beam printer has a laser mechanism, an optical system for forming a latent image on a photosensitive drum, a separation charge eliminator for separating a transfer material with a toner image transferred thereonto from the drum, and a printer controller for controlling the print operation. A high voltage is applied to the charge eliminator for a non-image zone of the original, and a low voltage is applied for an image zone of the original. The application voltage for the charge eliminator is obtained by superposing a DC voltage on an AC voltage. A system including a reader, a CCU, and a printer is also provided.

20 Claims, 64 Drawing Figures

FIG. 29A—1
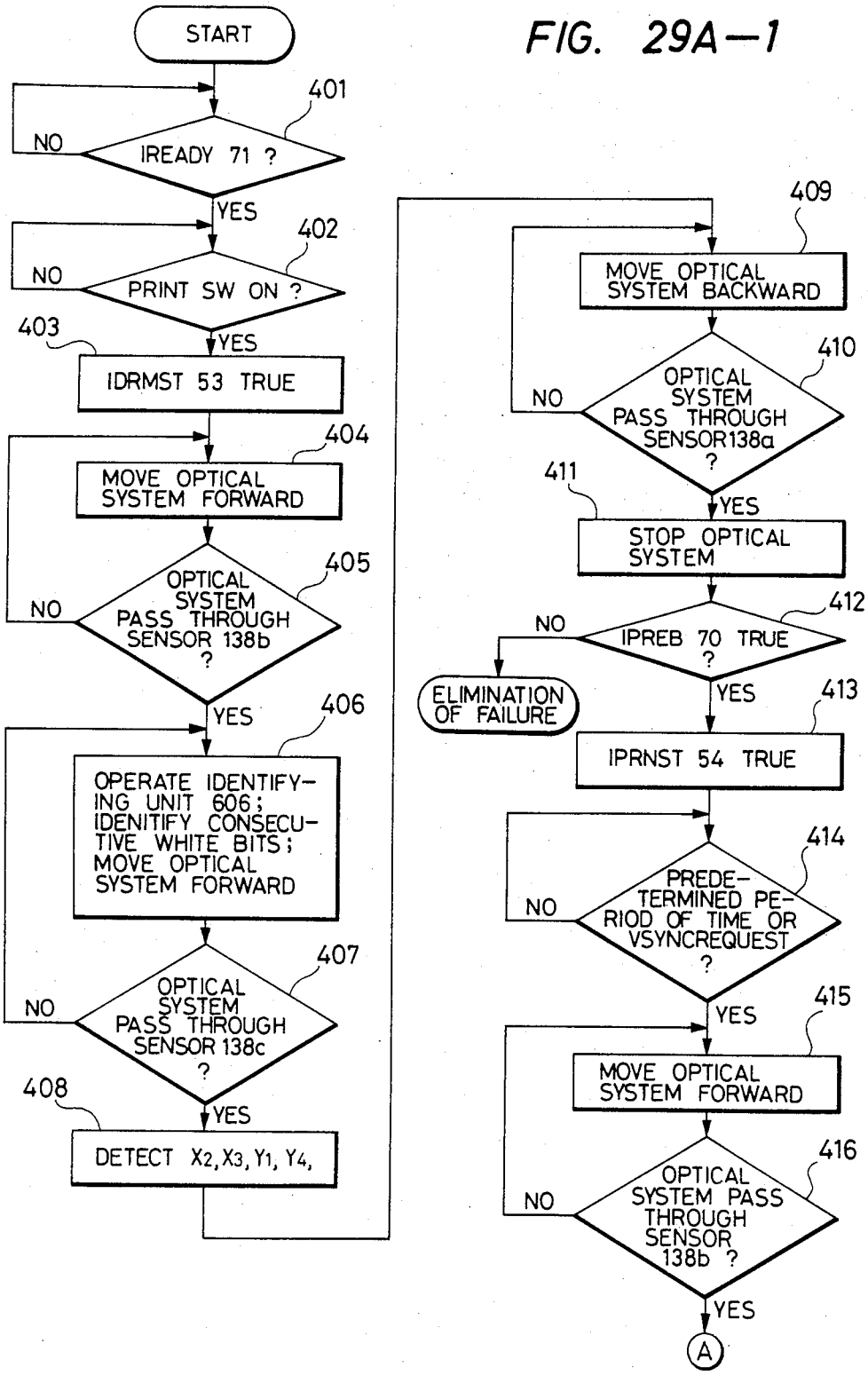

FIG. 35A—1
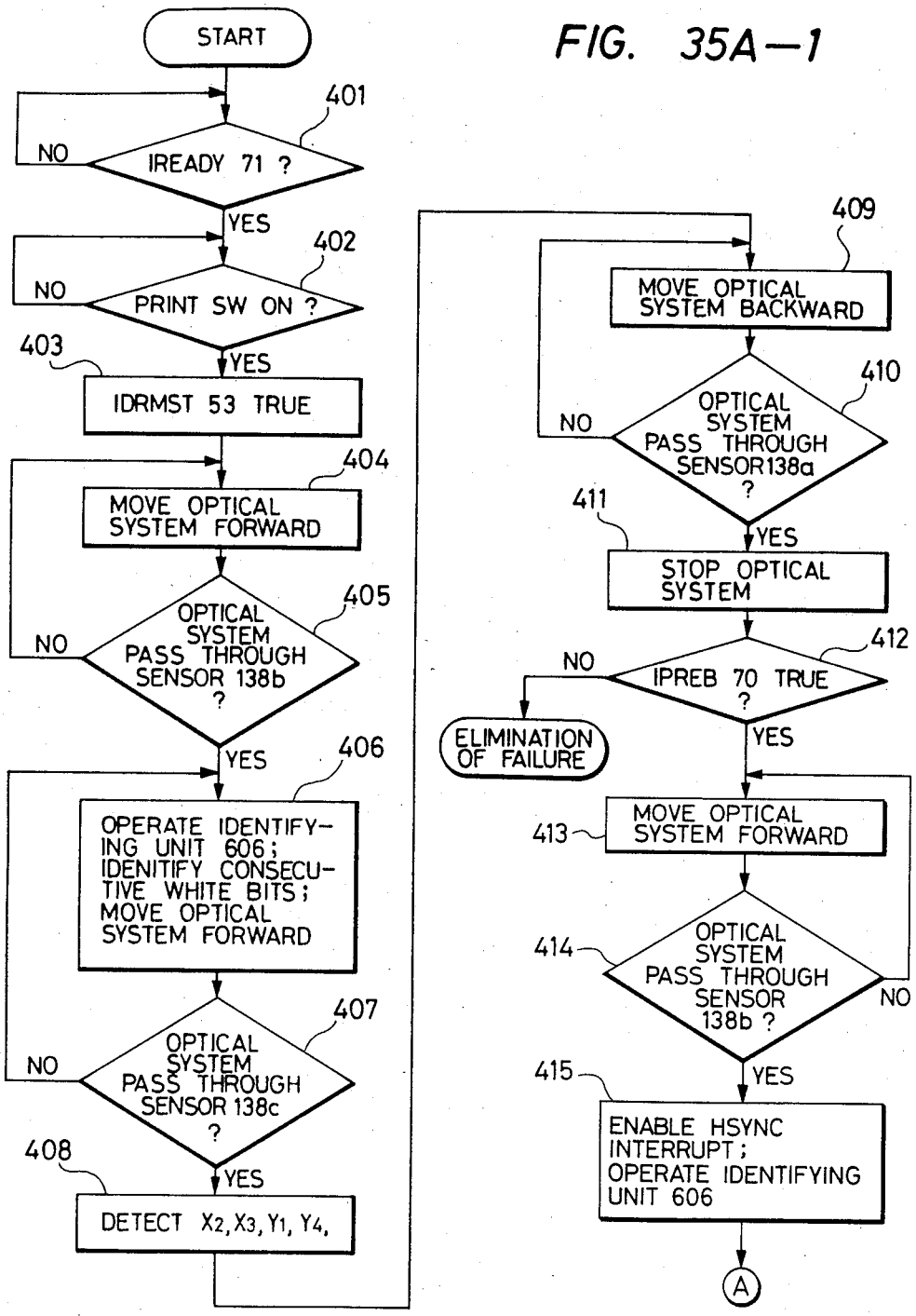

IMAGE FORMING APPARATUS

BACKGROUND OF THE INVENTION

1. Field of the Invention

The present invention relates to an image forming apparatus for forming a copy by transferring an image formed on a recording medium such as a photosensitive drum onto a transfer material.

2. Description of the Prior Art

In a method of separating a transfer material from a photosensitive body, a high AC voltage sufficient to allow separation of the transfer material from the surface of the photosensitive body is applied to eliminate the charge of the transfer material. This method is subject to a problem of re-transfer wherein toner transferred onto the transfer material is re-transferred to the surface of the photosensitive body due to over-elimination of the transfer material charge. In order to prevent this problem, a DC bias voltage is superposed on the AC voltage, or the DC bias voltage is switched between a predetermined zone from the leading edge of the transfer material and the remaining zone thereof.

FIG. 3 shows the effect of the DC bias voltage on the separation of the transfer material or re-transfer of the toner. As can be seen from FIG. 3, within a DC bias voltage range in which toner re-transfer is unlikely to occur, defective separation of the transfer material is likely to occur.

In view of the above, in the method wherein a DC bias voltage is superposed on the AC voltage, in order to simultaneously perform satisfactory separation of the transfer material and prevent re-transfer of toner, a voltage intermediate between a DC application voltage optimal for separation of the transfer material and a DC application voltage optimal for prevention of toner re-transfer has been applied. With this method, however, separation performance of the transfer material or prevention of toner re-transfer is adversely affected by changes in environmental factors or contamination of the residual charge eliminator.

On the contrary, the method of strongly charge-eliminating only the leading end of the transfer material is subject to the following problem. That is, in order to assure reliable separation of the leading edge, charge elimination must be performed by a high voltage exceeding a predetermined zone of the transfer material, e.g., a zone 20 mm or more from the leading edge of the transfer material. However, in the associated conventional technique, the ON time of the separation charge eliminator is fixed and cannot be changed.

FIGS. 1A and 1B are diagrams for explaining the above problem. FIG. 1A is a diagram illustrating the relationships between a transfer material, an image on the transfer material, and a switching timing of charge eliminating voltage. More specifically, FIG. 1A shows a leading edge X, a trailing edge Y of the transfer material, a non-image zone X'-A of the transfer material on which no image is formed, an image zone A-Y' of the transfer material on which an image is formed, a zone X"-P in which a high charge eliminating voltage is applied, and a zone P-Y" in which an intermediate (middle) charge eliminating voltage is applied. A point P is at a distance of 20 mm or more from the leading edge X. In the case of FIG. 1A, even if a zone P'-A is strongly charge-eliminated, toner re-transfer will not be caused since no toner is present in this zone. However, as shown in FIG. 1B, when the image on the transfer material X-Y is formed in a zone B-Y', since the high charge eliminating voltage application zone X"-P is fixed, a zone B-P' of the image on the transfer material is strongly charge-eliminated. In this zone, re-transfer easily occurs, and stable image quality cannot be obtained.

The method of charge eliminating only the leading end of the transfer material is subject to the following problem. That is, in order to assure separation of the leading end of the transfer material, the separation charge eliminator must exceed a zone 20 mm or more from the leading end of the transfer material. However, the ON interval of the separation charge eliminator is conventionally fixed, and cannot be changed.

FIGS. 1A and 1B are used again to explain the above problem. FIG. 1A shows the relationships of a transfer material, an image formed on the transfer material, and the timing of the charge eliminating voltage. Thus, FIG. 1A shows a leading edge X of the transfer material, a trailing edge Y of the transfer material, a non-image zone X'-A of the transfer material in which no image is formed, an image zone A-Y' of the transfer material in which an image is formed, a charge eliminating voltage application zone X"-P, and a charge eliminating voltage non-application zone P-Y". A point P is at a distance of 20 mm or more from the leading edge X. In the case of FIG. 1A, no toner re-transfer occurs in the zone P'-A since no toner image is formed in this zone. However, when the image on the transfer material X-Y is formed in the zone B-Y' as shown in FIG. 1B, since the charge eliminating voltage application zone X"-P is fixed, charge elimination is performed in the image zone B-P' on the transfer material. In this zone, toner re-transfer and data drop occur, and stable image quality cannot be obtained.

Conventional copying machines mainly adopt the electrostatic separation method for separating a transfer material from a photosensitive body after an electrostatic latent image is formed on the photosensitive body and the resultant toner image is transferred onto the transfer material. Thus, a high AC voltage is applied to the transfer material so as to eliminate the charge of the transfer material and to allow its separation from the surface of the photosensitive body.

However, in this method, the charge of the transfer material is excessively eliminated in accordance with the value of the superposed AC voltage, so that toner which has been transferred onto the transfer material is re-transferred to the surface of the transfer material. In order to prevent such re-transfer of toner, a method of superposing a DC bias voltage to the AC voltage is known. However, although the value of the DC bias voltage applied is kept constant, the area of the image to be reproduced, i.e., the amount of toner to be transferred is not constant. For this reason, defective separation of the transfer material or toner re-transfer still occurs.

The above problem may be attributed to the various area ratios (to be referred to an image area ratio hereinafter) of an image zone (information zone) of an original to the total area thereof. In normal document originals, the image area ratio is 10% or less. However, in digital copying machines, photographs can also be reproduced with high quality by the dither method. In such photograph originals, the image area ratio is as high as 50 to 80%.

FIG. 2 shows the influence of the image area ratio and the DC bias voltage on the separation of the transfer material and toner re-transfer. The experiment conditions to obtain the results shown in FIG. 2 were as follows.

| | |
|---|---|
| Type of photosensitive body: | Amorphous Si photosensitive body |
| Surface potential of photosensitive body: | Dark potential $V_D = +400$ V<br>Bright potential $V_L = +50$ V |
| AC voltage after separation charge elimination: | 5.0 kVrms |

In FIG. 2, a hatched region indicates a region wherein separation of the transfer material can be performed without causing toner re-transfer. Referring to FIG. 2, when an original image is entirely white, the DC bias voltage for allowing separation is 0.5 to 1.8 kV. When the applied voltage is lower than the lower limit, the transfer material is electrostatically attracted to the photosensitive body by residual charge on the transfer material and satisfactory separation cannot be performed. On the contrary, when the applied voltage is higher than the upper limit, too many positive coronas are generated to cause excessive charge elimination. Then, the transfer material is charged to the opposite polarity. The transfer material is then electrostatically attracted to the photosensitive body, not allowing satisfactory separation again. When the original image is entirely black, the separable voltage range is −1.0 to 0.9 kV.

When the image is a black image, the DC bias voltage for separation can be lower than that in the case wherein the image is a white image for the following reason. When the original is a black image, a relatively large amount of toner is present between the photosensitive body and the transfer material. For this reason, the gap between the transfer material and the photosensitive body is wide, and the electrostatic attraction force acting between the transfer material and the photosensitive body is smaller than in the case of a white image.

As can be seen from FIG. 2, an optimal DC bias voltage changes in accordance with changes in image area ratio. Thus, although the optimal DC bias voltage must be able to change in accordance with an image area ratio of each original, the DC bias voltage is fixed at an intermediate voltage in conventional apparatuses. For this reason, in the case of originals wherein the image area ratio is extremely high or low, defective separation and/or toner re-transfer cannot be prevented.

In view of this problem, it has been proposed to detect the surface potential or the toner attachment amount on the photosensitive body and to control the DC separation voltage in accordance with the detected surface potential or toner attachment amount. However, in these methods, it is difficult to determine a DC voltage precisely corresponding to the image area ratio of the original and the detection apparatus becomes complex and expensive.

SUMMARY OF THE INVENTION

It is an object of the present invention to eliminate the above drawbacks.

It is another object of the present invention to provide an improvement in an image forming apparatus.

It is still another object of the present invention to provide an image forming apparatus which is free from various problems which are normally encountered when a transfer material is separated from a recording medium.

It is still another object of the present invention to provide an image forming apparatus which allows easy separation of a transfer material from a recording medium such as a photosensitive drum.

It is still another object of the present invention to provide an image forming apparatus which can separate a transfer material from a recording medium without causing re-transfer of toner.

It is still another object of the present invention to provide an image forming apparatus which has a simple configuration and which can reliably separate a transfer material from a recording medium.

It is still another object of the present invention to provide an image forming apparatus which detects image data to perform suitable control operation.

It is still another object of the present invention to provide, in a recording apparatus such as a laser beam printer, an image forming apparatus wherein a video signal (image signal) is detected so as to discriminate non-image and image zones on the transfer material, a high charge eliminating voltage is applied only on non-image zones on the transfer material, and an intermediate charge eliminating voltage low enough not to cause re-transfer is applied to the image zones, so that defective separation of the transfer material and re-transfer of toner may not be caused.

It is still another object of the present invention to provide, in a recording apparatus such as a laser beam printer, an image forming apparatus wherein a video signal (image signal) is detected so as to discriminate non-image and image zones on the transfer material, and a charge eliminating voltage is applied to a charge eliminater only for the non-image zones, so that the transfer material can be reliably separated from the photosensitive body and re-transfer of toner is not caused.

It is still another object of the present invention to provide an image forming apparatus which can perform reliable separation of a transfer material irrespective of an original image.

The above and other objects and features of the present invention will become apparent from the following description when taken in conjunction with the accompanying drawings and the appended claims.

BRIEF DESCRIPTION OF THE DRAWINGS

FIGS. 29A-1, 29A-2 and 29B are flow charts of a control sequence executed by the controller 614 of the reader A;

FIGS. 30A-1, 30A-2, and 30C are flow charts of a control sequence executed by the controller 50C of the printer B;

FIGS. 35A-1, 35A-2, 35A-3, and 35B are flow charts of a control sequence of the controller 614 of the reader A;

FIGS. 39-1 and 39-2 are a flow chart of a control sequence of a CPU 51*d* of a printer controller 50*d*.

DETAILED DESCRIPTION OF THE PREFERRED EMBODIMENTS

The preferred embodiments of the present invention will be described in detail with reference to the accompanying drawings.

Figure 4:
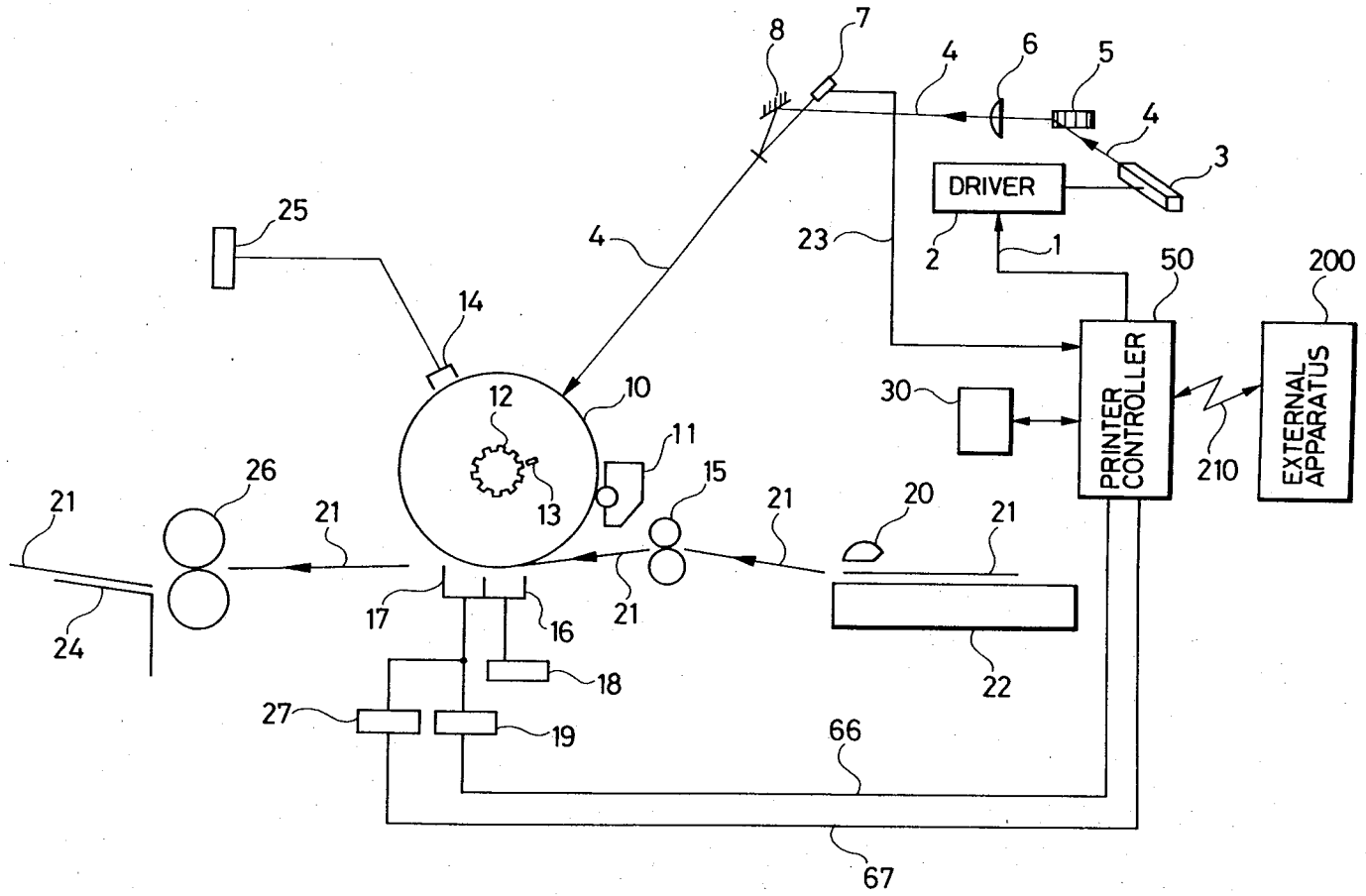
FIG. 4 is a diagram showing a first embodiment of the present invention.

FIG. 4 is a diagram showing the configuration of a laser beam printer according to a first embodiment of the present invention. The laser beam printer includes a laser driver 2 for receiving a video signal 1, a laser maser 3 for generating a laser beam 4, a polygon mirror 5, an f·θ lens 6, a known beam detector 7 for generating a beam detection signal 23, an optical path changing mirror 8, a photosensitive drum 10, a developing unit 11, a gear disk 12 rotating with the photosensitive drum 10, a sensor 13 integrally mounted on the disk 12 for detecting the tooth and bottom land of the gear disk to generate drum clocks (57 in FIG. 7), a primary charger 14, registration rollers 15, a transfer charger 16, a separation charge eliminator 17, a transfer high-voltage power source 18, an AC voltage power source 19 for the separation charge eliminator 17, a power source 25 for the primary charger, a fixing unit 26, a DC voltage power source 27 for the separation charge eliminator 17, a paper feed (or pick-up) roller 20, a transfer material 21, a paper cassette 22 for storing a transfer material 21, a beam detect signal 23, a stacker 24, a video detector 30, a printer controller 50, an external apparatus 200, and an interface cable 210 connecting the printer controller 50 and the external apparatus 200.

The operation of the apparatus of the first embodiment of the present invention will be described below. The laser maser 3 generates the laser beam 4 in accordance with the video signal 1 corresponding to print data. The laser beam 4 is reflected by the polygon mirror 5, converged by the f·θ lens 6, reflected by the mirror 8 and reaches the photosensitive drum 10. Main scan is performed by rotating the polygon mirror 5, and sub-scan in a direction perpendicular to the main scan is performed by rotating the photosensitive drum 10 clockwise.

Since the surface of the photosensitive drum 10 is uniformly charged by the corona discharge of the primary charger 14, when the laser beam 4 reaches the photosensitive drum 10, the irradiated portion of the drum 10 is electrically neutralized and an image corresponding to the video image 1 is formed, as is well known.

In this embodiment, the photosensitive layer of the drum 10 comprises amorphous Si. Dark potential Vd and bright potential Vl at the developing unit when the amorphous Si is positively charged by the primary charger 14 and an electrostatic latent image is formed are given by Vd = +400 V and Vl = +50 V. The peripheral speed at the surface of the drum 10 is 180 mm/sec.

The latent image formed on the surface of the photosensitive drum is developed by the developing unit 11. More specifically, positively charged toner is attached to the bright portion (portion irradiated with the laser beam and corresponding to the ON video signal) and is visualized. The transfer material 21 picked by the pick-up roller 20 from the cassette 22 is fed to the transfer charger 16 by the registration rollers 15. A high voltage from the transfer high-voltage power source 18 is supplied to the transfer charger 16 so as to charge the transfer material 21 to the polarity opposite to the toner. As the transfer material 21 passes over the transfer charger 16, the toner image is transferred onto the transfer material 21 and the transfer material 21 is electrostatically attached to the surface of the drum 10.

The transfer material 21 is subjected to the separation corona discharge from the separation charge eliminator 17 at 14.0 mm from the drum surface by a voltage obtained by superposing a positive DC voltage to an AC voltage 5.0 kVrms. The transfer material 21 is thus charge-eliminated. The DC voltage power source 27 is connected to the printer controller 50 so that the DC voltage can be controlled in accordance with the logic level of the video signal 1.

Figure 3:
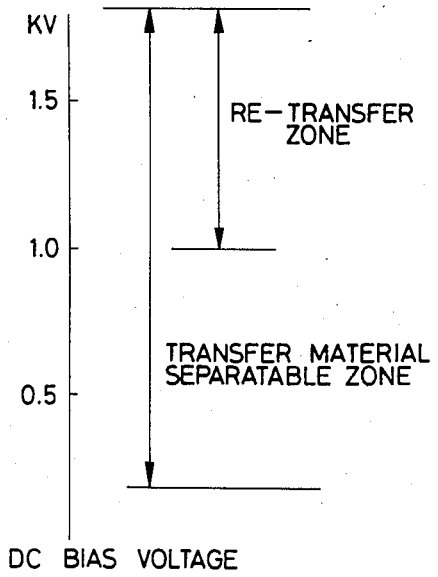
FIG. 3 is a diagram showing the influence of the DC voltage applied to the charge eliminator on separation of the DC voltage and re-transfer of toner.

The DC voltage to be superposed on the AC voltage will be described first. FIG. 3 shows separable and re-transfer regions when the separation superposition DC voltage was varied under various conditions. The separation AC voltage was 5.0 kVrms, the photosensitive drum was an amorphous Si drum, and the paper used was normal paper having a weight of 64 g/m$^2$.

As can be seen from FIG. 3, under the above conditions, the separable region for the DC superposition voltage is 0.2 to 1.8 kV, and that the re-transfer region is 1.0 to 1.8 kV. Therefore, if a constant DC superposition voltage is applied, a region in which no re-transfer is caused and separation is reliably performed is only 0.2 to 1.0 kV.

However, re-transfer occurs only in a zone of a transfer material in which toner is attached, i.e., an image zone, and re-transfer is not caused in a non-image zone. Accordingly, in the first embodiment, a relatively high DC superposition voltage, e.g., 1.2 kV is applied in a non-image zone from the leading end of the transfer mateiral to the first video image (image signal), and a relatively low DC superposition voltage at which re-transfer will not be caused, e.g., 0.6 kV is applied in a subsequent image zone.

In this manner, the electrostatic attachment force at the leading end of the transfer material is weakened, separation of the transfer material at the leading end is facilitated, and re-transfer of toner in the image zone is not caused. After the leading end of the transfer material is thus separated, the remaining portion of the transfer material can be easily separated at a relatively low charge elimination voltage level at which toner re-transfer may not be caused.

Figure 5A:
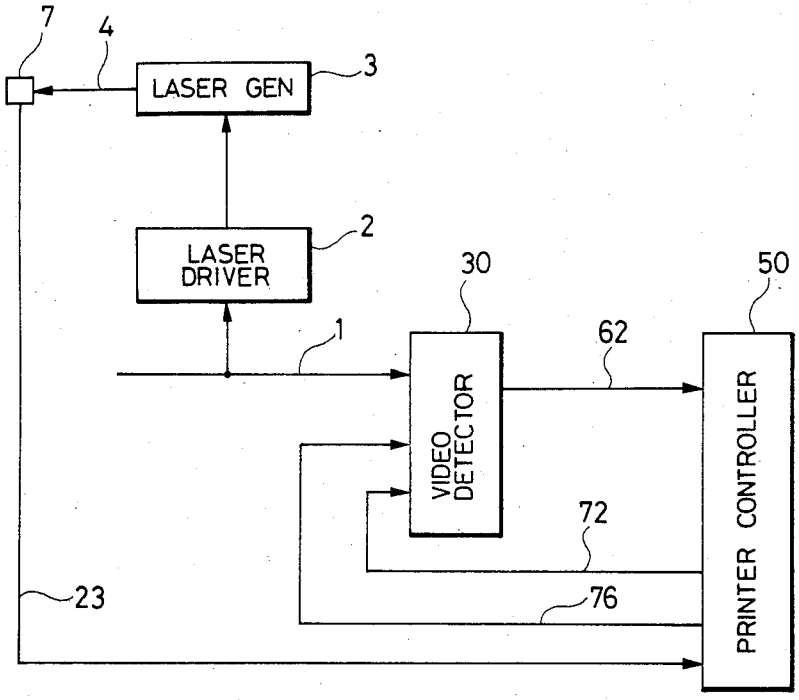
FIGS. 5A and 5B are diagrams of a video detector.

A video detector portion for discriminating non-image and image zones will be described below. FIG. 5A shows signal exchange of the video signal 1 and signal exchange between the video detector 30 and the printer controller 50. Referring to FIG. 5A, the video detector 30 detects if the video signal 1 is "black" information (true bit). Since the video signal 1 is normally a binary signal, discrimination is easy.

Detection of the video signal need not be performed until the drum 10 is correctly irradiated with the laser beam 4 and the transfer material has reached a prescribed position. For this reason, the discrimination condition for the video signal detection uses a signal BD 72 and a vertical effective zone signal (to be referred to as VENB signal hereinafter) 76. The signal BD 72 is obtained by conversion by the controller 50 of the beam detection signal 23 from the beam detector 7 immediately before the laser beam 4 from the laser maser 3 scans the drum 10. The signal BD 72 indicates that the drum 10 is currently irradiated with the laser beam 4.

Figure 5B:
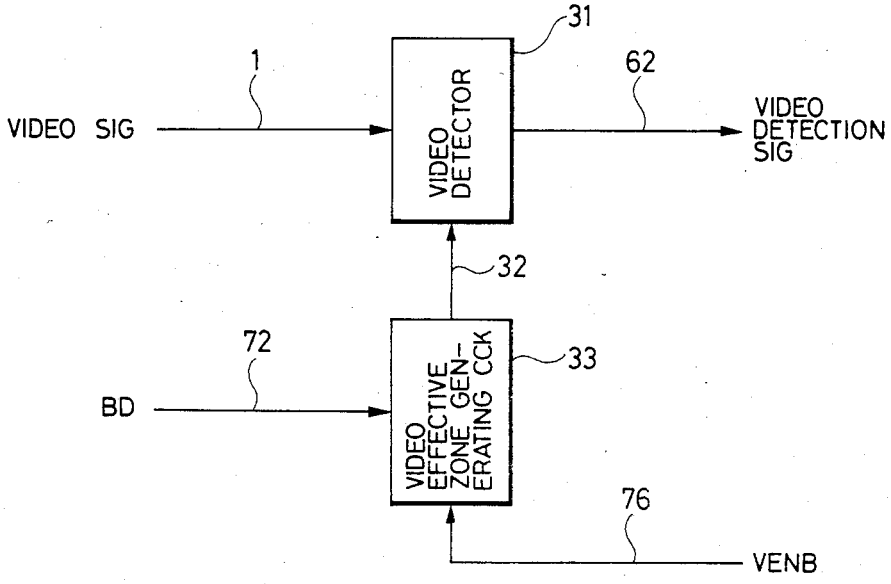

FIG. 5B is a detailed view of the video detector 30 shown in FIG. 5A. When the signal BD 72 is true and the signal VENB 76 is true, the laser beam 4 scans the drum 10. Thus, only from when the transfer material is conveyed to a predetermined position, a video detector 30 detects if black information is included in the video signal 1. If black information is included, the video detector 30 supplies a video detection signal to the printer controller 50. In response to the video detection signal 62, the printer controller 50 enters the interrupt routine and determines the ON/OFF timing of the high-voltage power source of the charge eliminator.

The timing for applying a high voltage to the charge eliminator 17 will be described in association with the rotation of the drum 10 and the convey operation of the transfer material 21, with reference to FIG. 6A.

A laser beam becomes incident on a point C of the drum 10, and the effect of corona discharge of the charge eliminator 17 reaches at a point D. A point F is at a midpoint between the registration rollers 15.

When a case wherein the circumferential distance between the points C and D is shorter than that between the points D and F (FIG. 6A), while the drum 10 rotates from the point C to the point D, the transfer material 21 must reach the point D. Therefore, when the transfer material 21 reaches a point E where the distance between the points C and D is equal to that between the points D and E, the video signal 1 is supplied from the external apparatus 200 to start scanning operation of the laser beam.

When the video signal 1 begins to be sent, detection of black information can be performed. Therefore, when black information is detected after the leading edge of the transfer material 21 reaches the point G, the black information is sensitized at the point C on the surface of the drum and forms a toner image. Therefore, after a time period until the drum 10 reaches from the point C to the point D, the point E on the transfer material coincides with the toner image on the drum 10 at the point D. In this manner, if the voltage supplied by the DC voltage power source 27 is switched after this time period (the time period required for the drum 10 to rotate from the point C to the point D) from the detection of the black information, the object of the present invention can be achieved.

The time period described above corresponds to the time period obtained by subtracting the time period for the drum 10 to rotate from the point C to the point D from the time period for the corona discharge to disappear after supply of the high-voltage power source is interrupted.

A case will now be described with reference to a case wherein the distance between the points C and D is longer than that between the points D and F. In this case, referring to FIG. 5B, the convey operation of the transfer material 21 is stopped at the registration rollers 15 (the transfer material is registered by the registration rollers 15 during this wait period), and the registration rollers 15 are driven when the drum 10 reaches a point H at which the distance between the points D and H is equal to that between the points D and F.

If black information of the video signal 1 is detected when the point P on the drum 10 reaches a point J, since this black information is formed on the point C, the voltage can be switched after a time period required for the drum to rotate from the point C to the point D thereafter. Since the above also applies when the point J is between the points C and H, i.e., when black information is detected before the registration rollers 15 are driven, a description of this case will be omitted.

Although a description has been made with reference to two positional relationships, since the positional relationship between the drum 10 and the registration rollers 15 remains the same in an actual optical printer or the like, the following description will be made with reference to a printer assuming the positional relationship shown in FIG. 6A.

Figure 7:
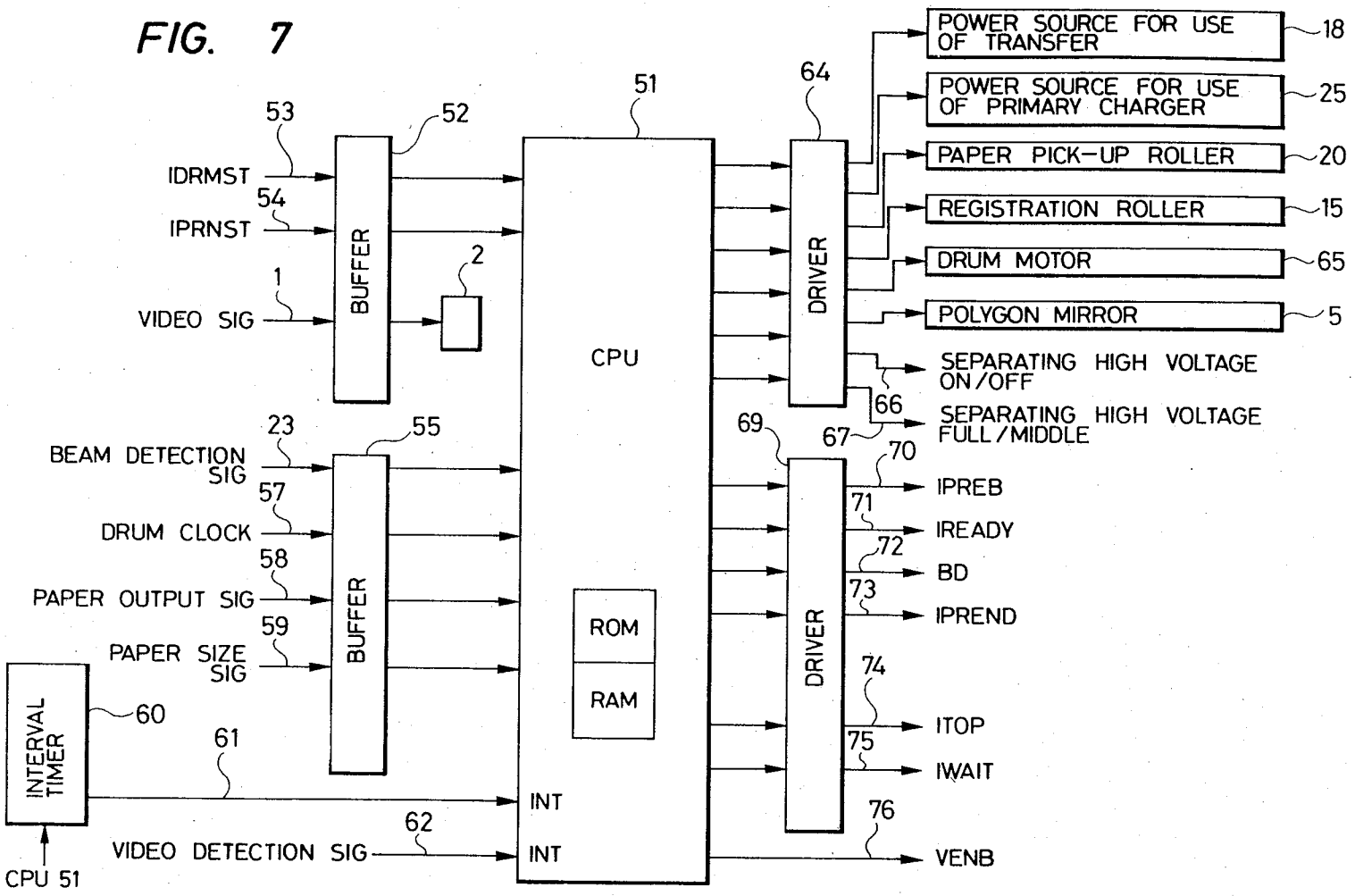
FIG. 7 is a diagram showing the main portion of a printer controller in the first embodiment of the present invention.

Control operation of the printer controller 50 will be described with reference to FIG. 7. FIG. 7 is a block diagram of the printer controller 50. A microcomputer (CPU) 51 performs control operation of the overall apparatus in accordance with a program stored in an internal or external (ROM (read-only memory) or RAM (random access memory). A buffer 52 receives an input interface signal from the external apparatus 200. A buffer 55 and a driver 64 exchange signals from various portions of the printer apparatus.

A driver 69 sends an output interface signal to the external apparatus 200. An interval timer 60 provides a suitable timing necessary for the control flow and is started by the CPU 51. The DC voltage is switched at a timing controlled by this interval timer 60 in the first embodiment. A separating high voltage ON/OFF signal 66 is a control signal for the AC voltage power source 19 of the separation charge eliminator 17. A separating high voltage FULL/MIDDLE signal 67 is a control signal for controlling an output from the DC voltage power source 27 between a high voltage and an intermediate voltage. When the FULL/MIDDLE signal is ON, the output from the power source 27 is set at the high voltage. When the signal FULL/MIDDLE is OFF, the output from the power source 27 is set at the intermediate voltage.

Figure 8A:
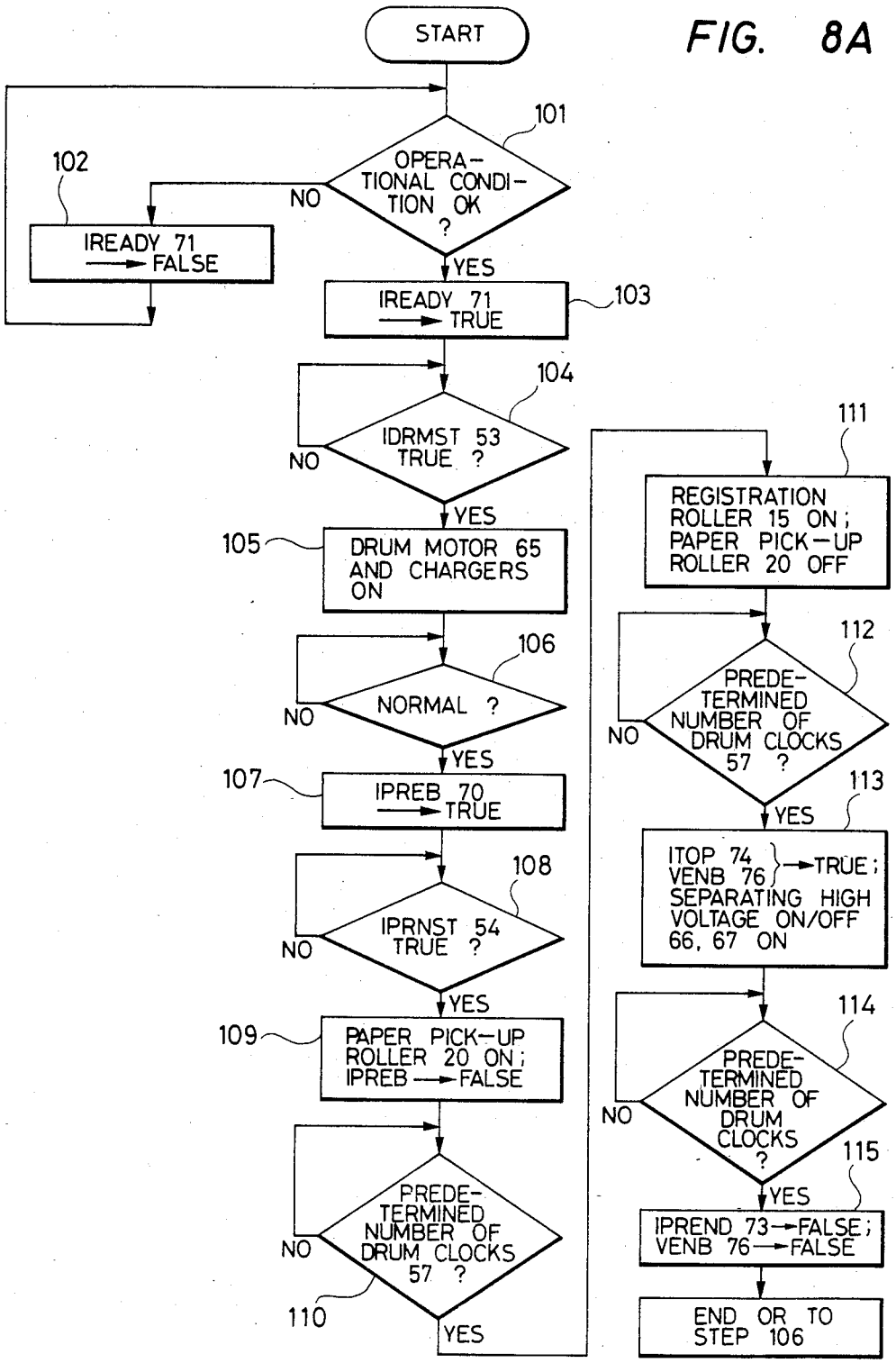
FIGS. 8A, 8B and 8C are flow charts of a control sequence according to the first embodiment of the present invention.
Figure 8B:
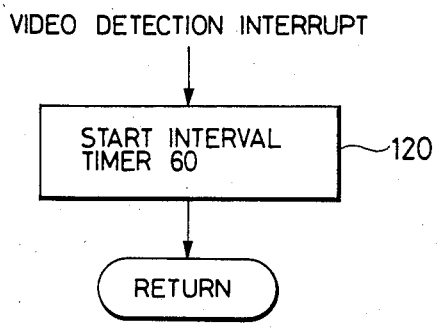
Figure 8C:
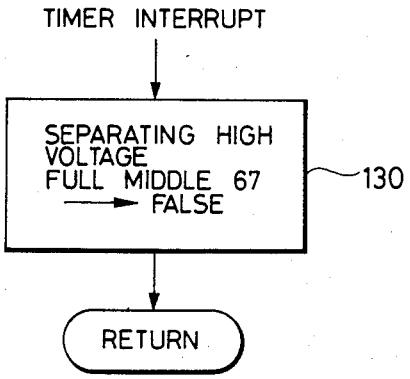

FIGS. 8A to 8C are flow charts of the control program stored in the CPU 51.

Referring to FIGS. 7 and 8A to 8C, when power is turned on, the program of the CPU 51 is started and initialization is performed. In step 101, operational conditions are checked; it is checked if the temperature of the fixing unit has reached a predetermined temperature, the printer apparatus is operative, and so on. If NO in step 101, a signal IREADY 71 representing the communication enable/disable is set false (disabled) to signal the situation to the external apparatus 200 (step 102). When YES in step 101, this situation is signalled to the external apparatus 200 by setting the signal IREADY 71 true in step 103.

When the signal IREADY 71 is true and recording information is available, the external apparatus 200 supplies a signal IDRMST (drum rotation instruction) 53 to the CPU 51. In response to the signal IDRMST (step 104), the CPU 51 turns on a drum motor 65, and turns on the high-voltage power sources such as the primary charger 14 and the transfer charger 16 except for the separation charge eliminator 17, thereby setting the surface of the drum 10 in a state for recording (step 105).

When recording can thus be performed, the CPU 51 supplies an ON signal IPREB 70 to the external apparatus 200 through a driver 69 (steps 106 & 107), and waits until a signal IPRNST 54 is received from the external apparatus 200. In response to the signal IPREB 70, the external apparatus 200 checks if the video information in the memory has been developed or if there is no abnormality. If there is no abnormality, the external apparatus 200 supplies a signal IPRNST 54 (feed instruction) to the printer apparatus.

As a result, the CPU 51 drives a paper pick-up roller 20 through the driver 64 and sets the signal IPREB 70 false so as to enter the printing sequence (steps 108 & 109). Thereafter, the drum clock 57 as the output from the sensor 13 mounted on the drum 10 is supplied to the CPU 51 through the buffer 55. Thus, the CPU 51 performs the sequence control in accordance with the position of the transfer material by means of the received drum clock 57.

The transfer material 21 conveyed by the paper pick-up roller 20 reaches the registration rollers 15 (step 110). The transfer material 21 is registered with the registration rollers 15. The positional relationship between the registration rollers 15 and the drum 10 is as described above. The following description will be made with reference to a case wherein the distance between the points C and D is shorter than that between the points D and F. When the drum 10 rotates to a predetermined position (step 110), the registration rollers 15 are driven to stop the paper pick-up roller 20 (step 111). As described above, when the leading edge of the transfer material reaches the point E, this can be confirmed by counting of the drum clocks 57 (step 112). The CPU 51 supplies a signal ITOP 74 for one drum clock period to the external apparatus 200 through the driver 69 so as to request sending of a video signal 1 and also sets the signal VENB 76 false.

At this time, the video detector 30 starts operating, and an interrupt to the CPU 51 by the video detection signal 62 can be made. The separating high voltage ON/OFF signal 66 is turned on and the separating high voltage FULL/MIDDLE signal 67 is set false so as to apply the high AC voltage and the high DC voltage to the separation charge eliminator 17 from the power sources 19 and 27 (steps 112 and 113). In response to the signal ITOP 74, the external apparatus 200 supplies the contents in the internal memory as the video signal 1 to the printer apparatus. Since the video detector 30 has already started to check if the video signal 1 includes black information, when the video detection signal 62 becomes true, the control sequence enters the interrupt routine shown in FIG. 8B. In the interrupt routine, a preset time is set in the interval timer 60 (step 120) and the flow returns to the main flow. The preset time set in the interval timer 60 corresponds to the predetermined time period required for the drum 10 to rotate from the point C to the point D. When the flow returns to the main control flow shown in FIG. 8A, print processing is continued while a timer interrupt is awaited. During this process, an electrostatic latent image is formed on the drum 10.

The timer interrupt is generated when the first image zone reaches the point D. When the timer interrupt is generated, the flow enters the timer interrupt routine shown in FIG. 8C. When the flow enters the timer interrupt routine, the separating high voltage FULL/-MIDDLE signal 67 is set false in order to decrease the output voltage from the DC voltage power source 27 (step 130). Then, a high DC voltage is applied for the non-image zone at the leading edge of the original, while a low DC voltage is applied for the image zone, thus achieving the object of the present invention.

After an image signal of one page determined by a paper size signal 59 is processed (step 114), an image zone end signal IPREND 73 is set true for the one drum clock period through the driver 69 so as to signal an end of one print zone to the external apparatus 20. At the same time, the signal VENB 76 is set false so as to stop the video detector 30 (step 115). Thus, the transfer material is output through the fixing unit 26. When a continuous copy operation is performed, the process from step 106 is repeated.

When printing is completed and both signals IDRMST 53 and IPRNST 54 from the external apparatus go false, the motor 65, the roller 20, and the registration rollers 15 are stopped.

In the method described with reference to the first embodiment, the rise time of the separation high-voltage power source is preferably short. If the rise time is long, the throughput is degraded due to long recording interval.

Figure 1A:
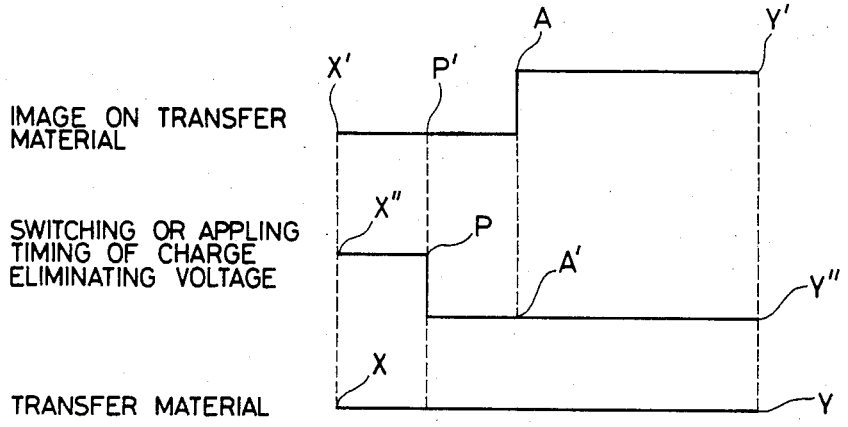
FIGS. 1A and 1B are diagrams showing the switching timing or application timing of a charge eliminating voltage when a transfer material is separated.
Figure 1B:
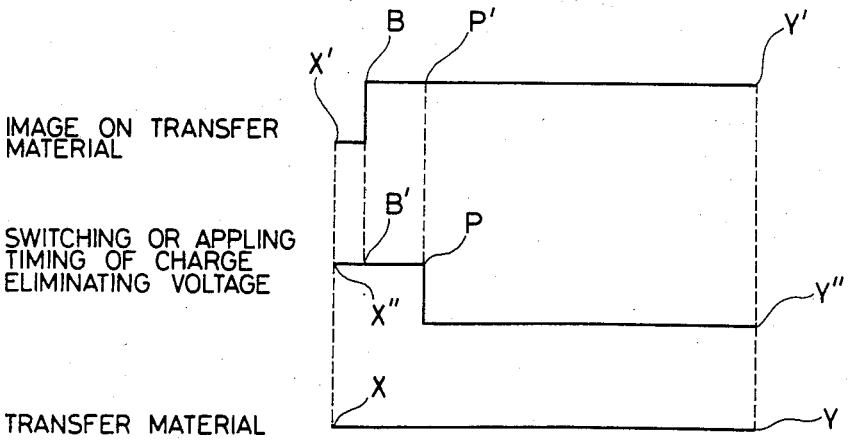
Figures 1, 30A:
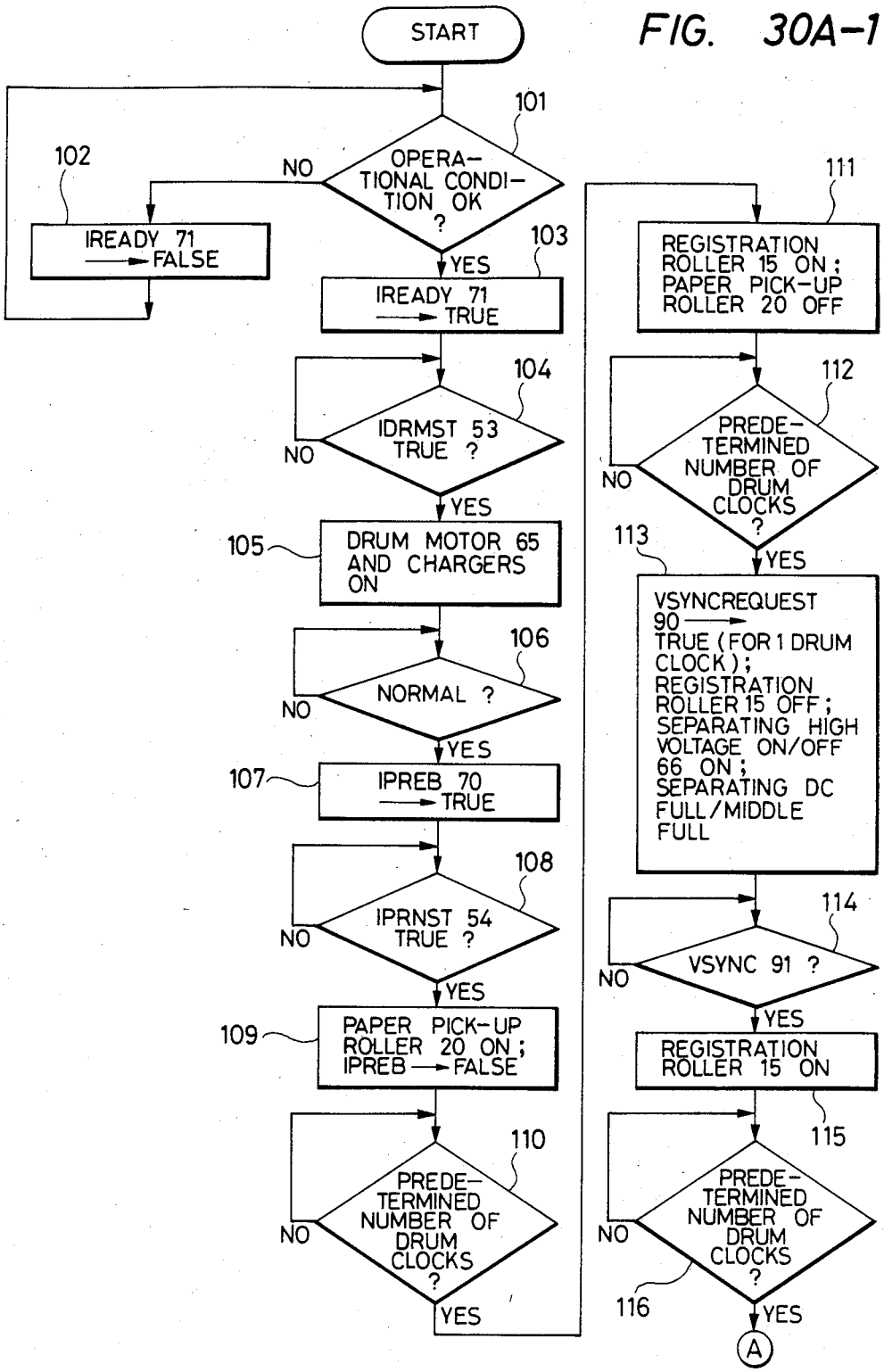
Figures 2, 30A:
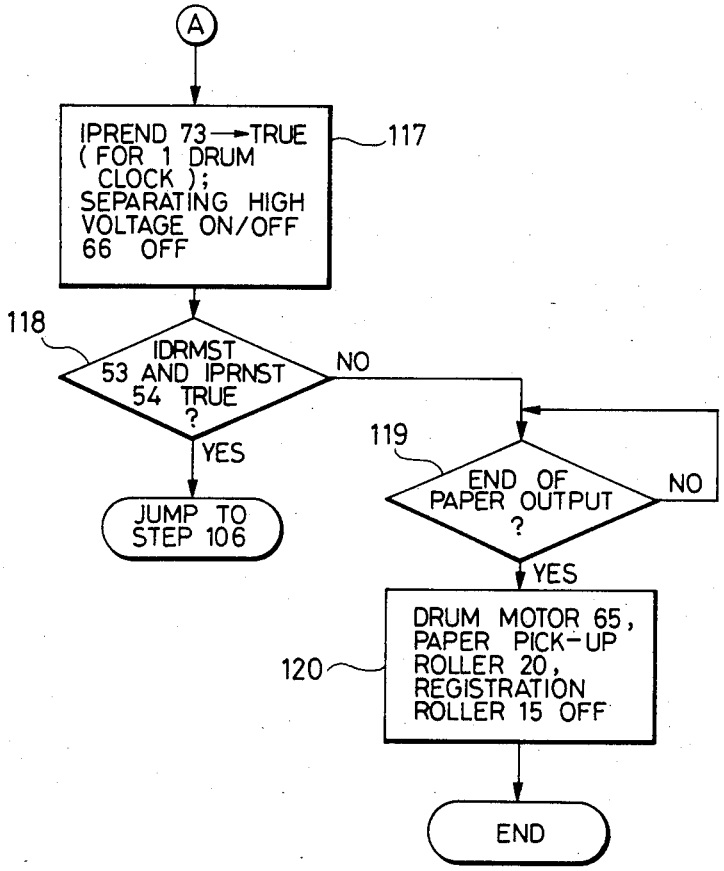

If the above description is applied to the case of FIG. 1, the DC power source voltage is switched at a point A' in FIG. 1A and at a point B' in FIG. 1B. Thus, it is seen that the switching point or timing changes in accordance with the start position of an image zone.

Figure 6A:
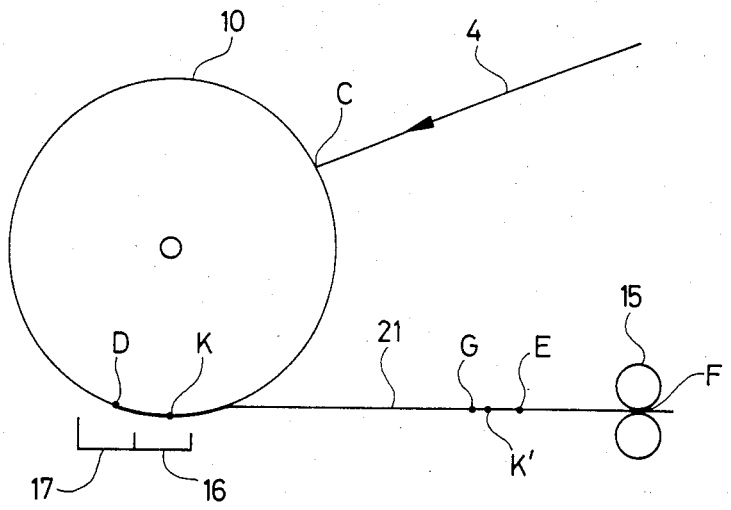
FIGS. 6A and 6B are diagrams showing the positional relationship between the photosensitive drum and the registration rollers.
Figure 9A:
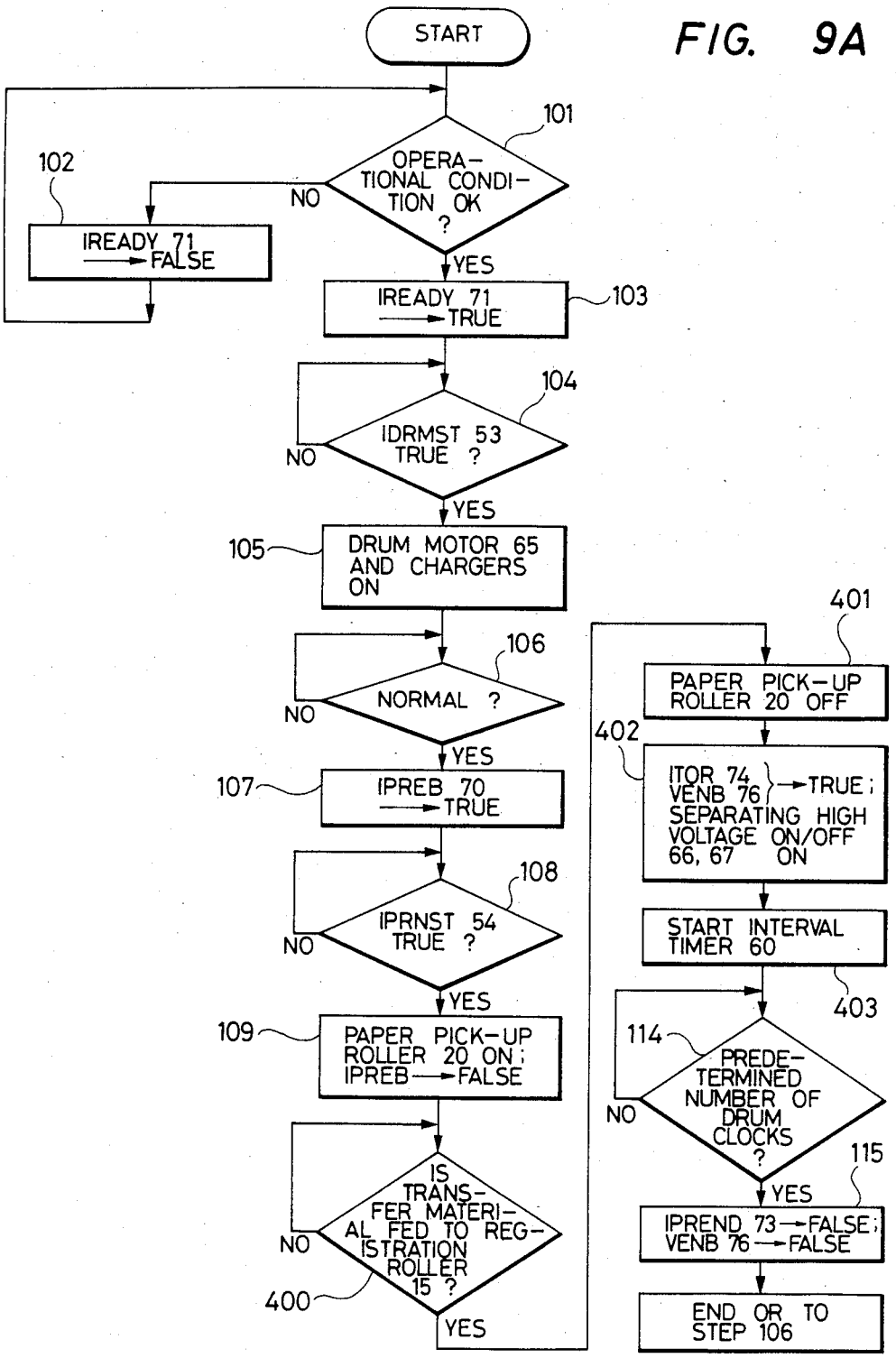
FIGS. 9A, 9B and 9C are flow charts of a control sequence when the positions of the photosensitive drum 10 and the registration rollers 15 are set as shown in FIG. 6B.
Figure 9B:
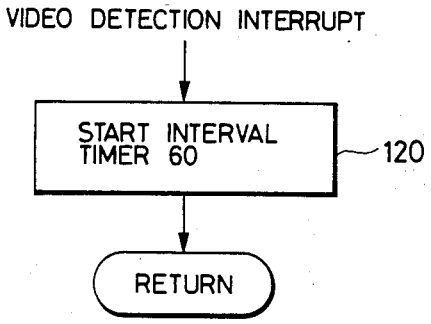
Figure 9C:
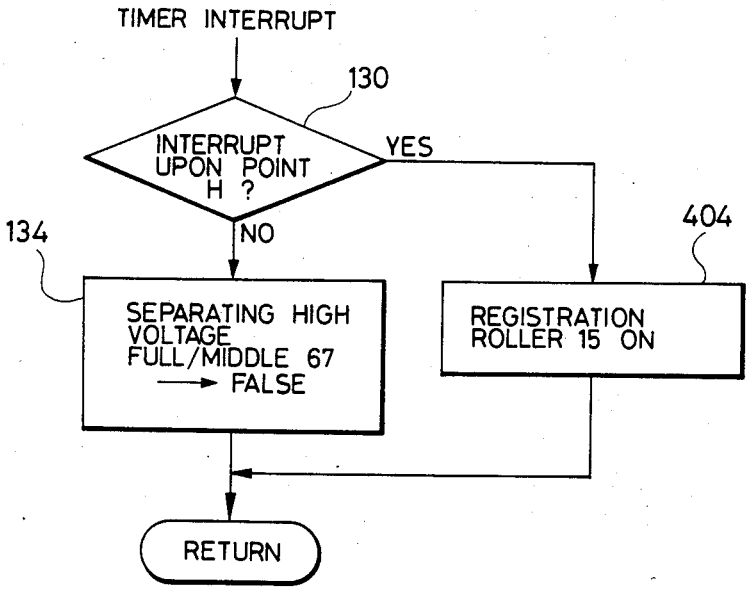

The control flow shown in FIG. 8 corresponds to the case wherein the drum 10 and the registration rollers 15 hold the positional relationship as shown in FIG. 6A. The following description will be made with reference to the case wherein the drum 10 and the registration rollers 15 hold the positional relationship shown in FIG. 6B. FIGS. 9A to 9C show flow charts in this case. Steps 101 to 109 in FIG. 9A are the same as steps 101 to 109 in FIG. 8A. When the signal IPRNST 54 from the external apparatus is set true, paper pickup is started (step 109). When the transfer material 21 reaches the registration rollers 15 (step 400), the pick-up roller 20 is turned off and the transfer material 21 is stopped at the position of the registration rollers 15 (step 401).

Meanwhile, the signals ITOP 74 and VENB 76 supplied to the external apparatus 200 are set true to request sending of the video signal 1 and to energize the video detector 30. The separation charge eliminator 17 is operated (step 402). In step 403, the interval timer 60 is started so as to count the time required for the drum 10 to rotate from the point C to the point H. When the drum H reaches the point H, a timer interrupt is generated. In the interrupt routine shown in FIG. 9C, the flow advances from step 130 to step 404 and the registration rollers 15 are driven. When the registration rollers 15 are driven, the transfer material 21 and the drum 10 are moved together. When the video detection signal 62 goes true, the flow enters the interrupt routine shown in FIG. 9B. When a predetermined time set is counted by the interval timer 60, a timer interrupt is generated and the flow enters the timer interrupt routine shown in FIG. 9C. Then, it is determined that the first image zone has reached the point D, and the separating high voltage FULL/MIDDLE signal is set false so as to decrease the output voltage from the power source 27 (steps 130 & 134).

Since the subsequent flow is the same as that described with reference to FIG. 8, a description thereof will be omitted.

The above embodiment is described with reference to the case of a laser beam printer. However, the present invention is similarly applicable to a recording apparatus which uses an LED array or an OFT (optical fiber tube array) as a light source.

In the above embodiment, the AC voltage applied to the separation charge eliminator is kept constant, while the DC voltage is switched. However, the DC voltage can be set constant, and the AC voltage can be switched. In this case, if the AC and DC voltages are property selected, the remaining control flow details remain the same and need not be modified.

In the above embodiment, when the CPU 51 receives the video detection signal 62, the interval timer 60 is started in the interrupt routine (FIG. 8B) so as to generate a timer interrupt after a predetermined period of time. However, since this predetermined period of time corresponds to a predetermined count of the drum clocks 57, the interval timer 60 can be omitted. Instead, a counter can be used in the interrupt routine of video detection, and the counter can be counted up every time the drum clock 57 is received. When the count reaches a predetermined value, it can be determined that the image zone has reached a prescribed position.

A second embodiment of the present invention will now be described.

Figure 10:
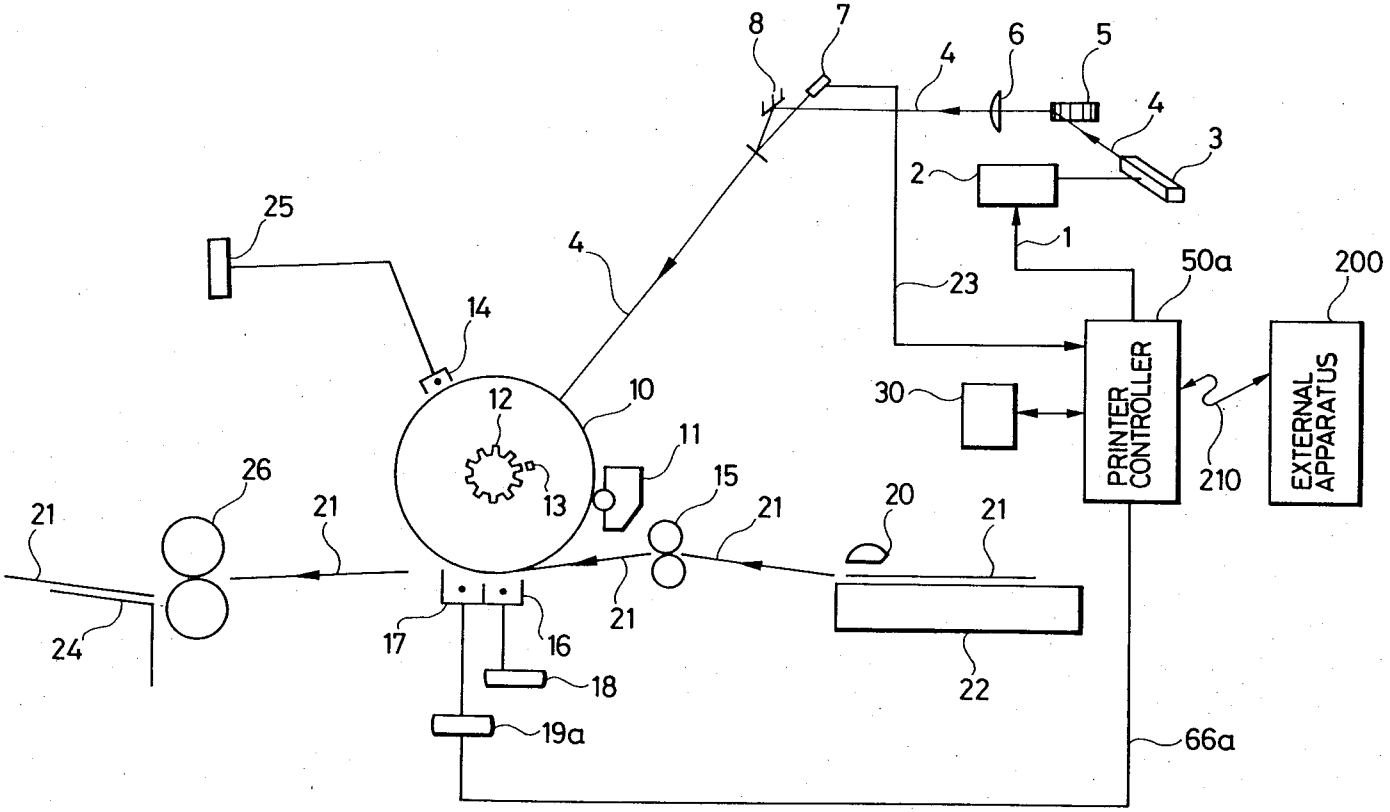
FIG. 10 is a block diagram showing a second embodiment of the present invention.

FIG. 10 is a view showing the construction of a laser beam printer according to the second embodiment of the present invention. The same reference numerals as in FIG. 4 denote the same parts in FIG. 10, and a detailed description thereof will be omitted. Referring to FIG. 10, a separation charge eliminating power source 19*a* supplies a voltage to a separation charge eliminator 17. An external apparatus 200 is connected to a printer controller 50*a*. The apparatus shown in FIG. 10 operates in substantially the same manner as in FIG. 4. In the apparatus shown in FIG. 10, when a transfer material 21 reaches the separation charge eliminator 17 arranged at 14.0 mm from the surface of a photosensitive drum 10, it is subjected to a separation corona discharge in which a positive DC voltage is superposed on an AC voltage of 5.0 kVrms. As will be described below, the power source 19*a* is connected to the controller 50*a* so that it can be controlled in accordance with the logic level of the video signal.

In this case, discharge must be started before the leading edge of the transfer material reaches the separation charge eliminator so that the transfer material can be discharged from its leading edge even if there are variations in the discharge rise time of corona discharge or feed timing of the transfer material.

When a high AC voltage is applied to the charge eliminator 17, the leading edge of the transfer material 21 is subjected to the corona discharge and charge elimination is started. The characteristic feature of the second embodiment is that charge elimination is continued for a predetermined period of time since detection of the first image zone in the video signal, and charge elimination is thereafter stopped. Since the corona discharge is stopped when the supply of the high AC voltage is stopped, the transfer material is not charge-eliminated after the first image data is sent. Therefore, the image zone is not subject to the adverse influence of the charge elimination and a transfer image of stable quality can be formed.

When the leading edge of the transfer material is separated from the surface of the drum, the overall transfer material is separated due to the weight and elasticity of the material. As an auxiliary means, high-pressure air can be blown or a vacuum suction mechanism can be adopted.

In the second embodiment, the ON/OFF timing of the separation high-voltage power source is determined by detecting image data in the video signal, as in the first embodiment. The circuitry for providing this function can have a configuration as shown in FIGS. 5A and 5B. The mode of operation of the circuit shown in FIGS. 5A and 5B will not be repeated here.

The timing for applying a separation charge eliminating voltage to the separation charge eliminator 17 will be described in association with rotation of a photosensitive drum 10 and the convey operation of the transfer material 21, with reference to FIG. 6A. However, since the apparatuses of the first and second embodiments operate in substantially the same manner, a detailed description will be omitted.

In the second embodiment, the separation charge eliminating power source 19*a* is turned off after a predetermined period of time (a period of time required for the drum to rotate from the point C to the point D) since detection of black information.

It is to be noted that the predetermined period of time is a period of time obtained by subtracting a time period required for the corona discharge to disappear after turn-off of the high-voltage source from the time period required for the drum to rotate from the point C to the point D.

A case wherein the distance between the points C and D is shorter than that between the points D and F will be described with reference to FIG. 6B. Since the operation in this case in the second embodiment is also substantially the same as that in the first embodiment, a detailed description will be omitted.

In the second embodiment, if black information is detected when the point C on the drum 10 rotates to the point J, the black information is formed on the point C. Therefore, charge elimination must be stopped after a time required for the drum to rotate from the point C to the point D elapses. If the point J is between the points C and H or if black information is detected every time the registration rollers 15 are driven, the same also applies and a description thereof will not be made.

Although the description has been made with reference to two positional relationships, the positional relationship between the drum 10, the registration rollers 15 and the like remains constant in a practical laser beam printer. Therefore, the following description will be made with reference to the case of a laser beam printer wherein the positional relationship is as shown in FIG. 6A.

Figure 12A:
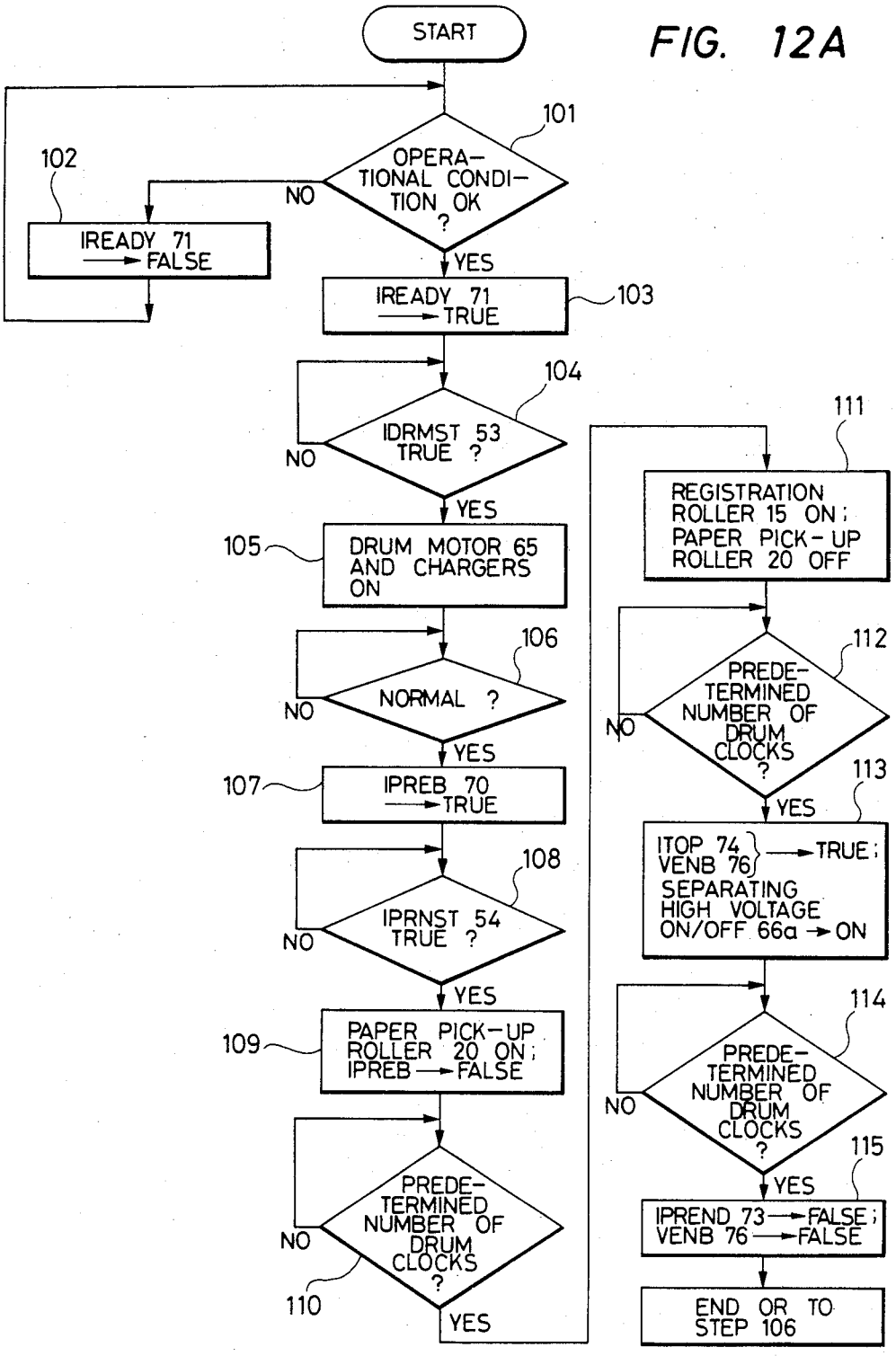
FIGS. 12A, 12B and 12C are flow charts of a control sequence in the second embodiment of the present invention.
Figure 12B:
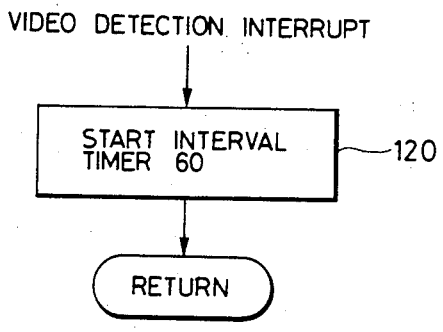

The control flow of the printer controller 50*a* will be described with reference to FIGS. 12A, 12B and 12C.

Figure 11:
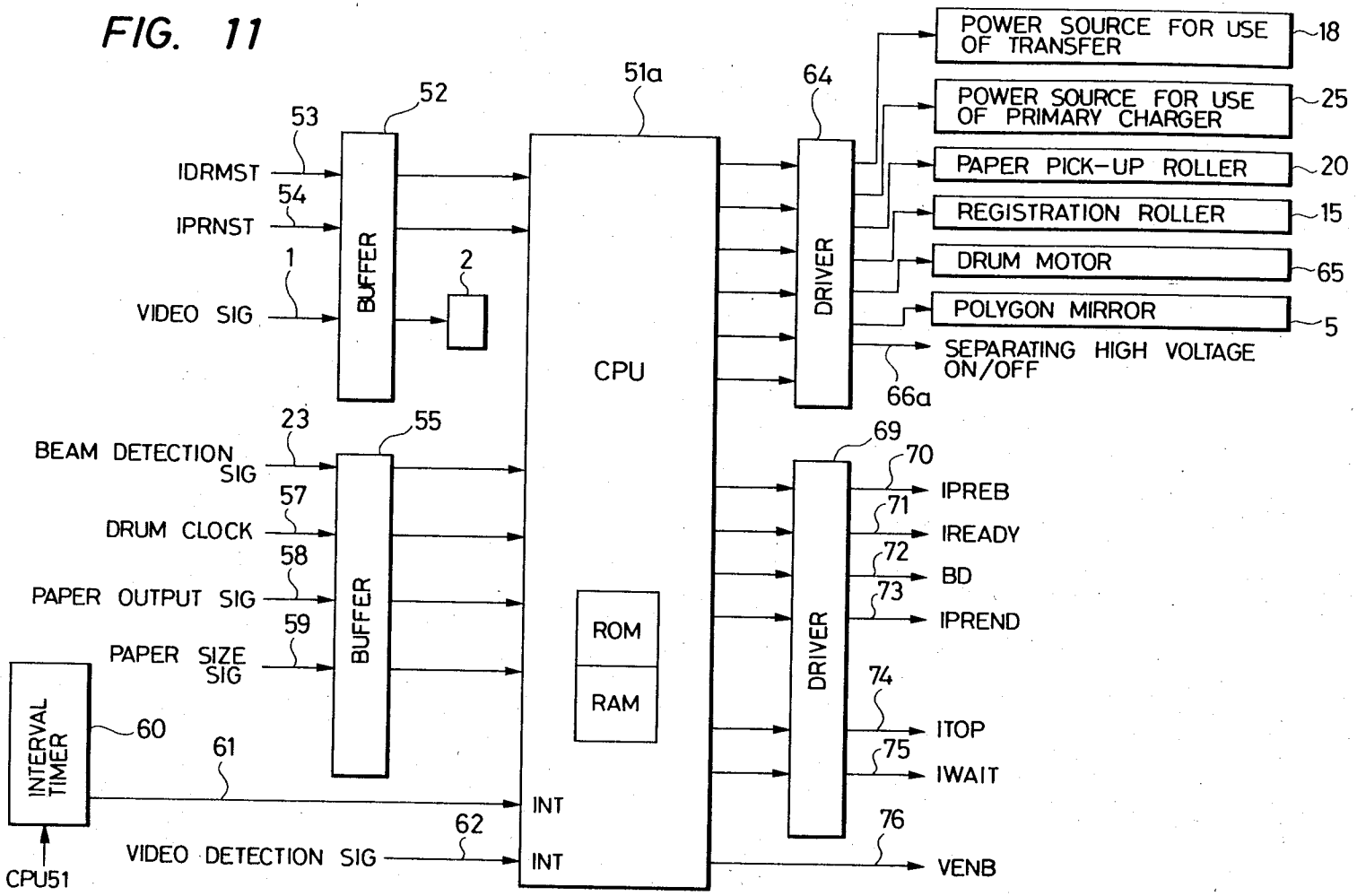
FIG. 11 is a block diagram of a controller in the second embodiment of the present invention.

FIG. 11 is a block diagram of the printer controller according to the second embodiment of the present invention. The same reference numerals as in FIG. 7 denote the same parts or similar parts having similar functions in FIG. 11, and a detailed description thereof will be omitted.

The ON/OFF timing of the separation charge elimination in the second embodiment is controlled by means of the interval timer 60. A separating high voltage ON/-OFF signal 66*a* is a signal for turning on or off the separation charge eliminating power source 19*a*.

Since the operations in the respective steps of the flow chart shown in FIG. 12 are substantially the same as those of the flow chart shown in FIG. 8, only those steps which are different from those shown in FIG. 8 will be described hereinbelow.

In step 113 in FIG. 8, the separating high voltage ON/OFF signal 66 is turned on and the separating high voltage FULL/MIDDLE signal 67 is set true. However, in step 113 in FIG. 12, only the separating high voltage ON/OFF signal 66 is turned on and charge elimination is started.

Figure 12C:
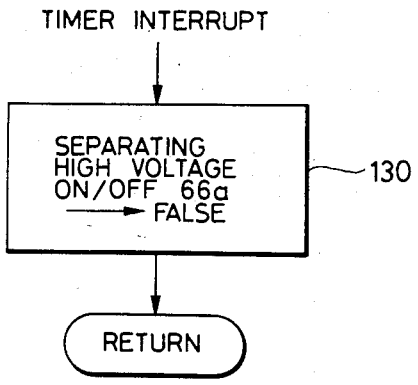

In the timer interrupt routine shown in FIG. 12C, the separating high voltage ON/OFF signal 66*a* is turned off to stop charge elimination (step 130) and the flow returns to the main control flow. Thereafter, the image zone on the transfer material is not charge eliminated and the transfer material is carried.

In the method adopted in the second embodiment, the rise time of the separation charge eliminating power source is preferably short. If this rise time is long, recording interval is prolonged and the throughput of the printer is degraded.

As described above, when the improvement in the charge elimination timing is examined with reference to FIG. 1, the charge elimination timing is ON→OFF at the point A′ in FIG. 1A, and it is ON→OFF at the point B′ in FIG. 1B.

In the above embodiment, the present invention is applied to a laser beam printer. However, the present invention is similarly applicable to a recording apparatus using an LED array or an OFT as a light source.

Figure 13:
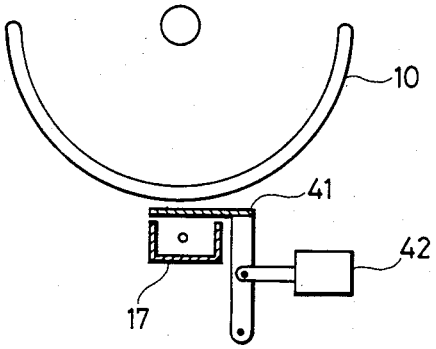
FIG. 13 is a schematic diagram when the effect of separation corona discharge is controlled by a shutter.

In the above embodiment, the operation control of separation charge elimination is performed by turning on or off the control signal supplied to the separation charge eliminating voltage power source 19*a*. However, a modification as shown in FIG. 13 can be adopted. In this modification, a shutter plate 41 which is slid by a solenoid 42 is arranged at the opening of a separation charge eliminator 17, and the shutter plate is moved in accordance with a video signal. Thus, the effect of corona discharge of the separation charge eliminator is controlled.

The control flow shown in FIG. 12 applies when the drum 10 and the registration rollers 15 have the positional relationship as shown in FIG. 16A. A description will now be made with reference to a case wherein the drum 10 and the registration rollers 15 have the positional relationship shown in FIG. 6B. FIG. 14 shows a flow chart in this case. The operation of the respective steps of the flow chart shown in FIG. 14 are substantially the same as those in FIG. 4, and only those which are different from those shown in FIG. 14 will be described below. In step 402 in FIG. 9, the separating high voltage ON/OFF signal 66 is turned on, and the separating high voltage FULL/MIDDLE signal 67 is set true. However, in FIG. 14, only the separating high voltage ON/OFF signal 66*a* is turned on and charge elimination is started. In step 134, the separating high voltage ON/OFF signal 66*a* is turned off.

In the above embodiment, the interval timer 60 is started in the interrupt routine (FIG. 8B) after the CPU 51*a* receives the video detection signal 62. After a preset time period in the timer 60 elapses, a timer interrupt is generated. However, the preset time period corresponds to a certain count of the drum clocks 57. Therefore, the interval timer 60 can be omitted, and a counter can be used in the interrupt timer for video detection. This counter can be counted up every time the drum clock 57 is received. When the count of the counter reaches a predetermined value, it can be determined that the image zone has reached a predetermined position.

A third embodiment of the present invention will now be described.

Figure 15:
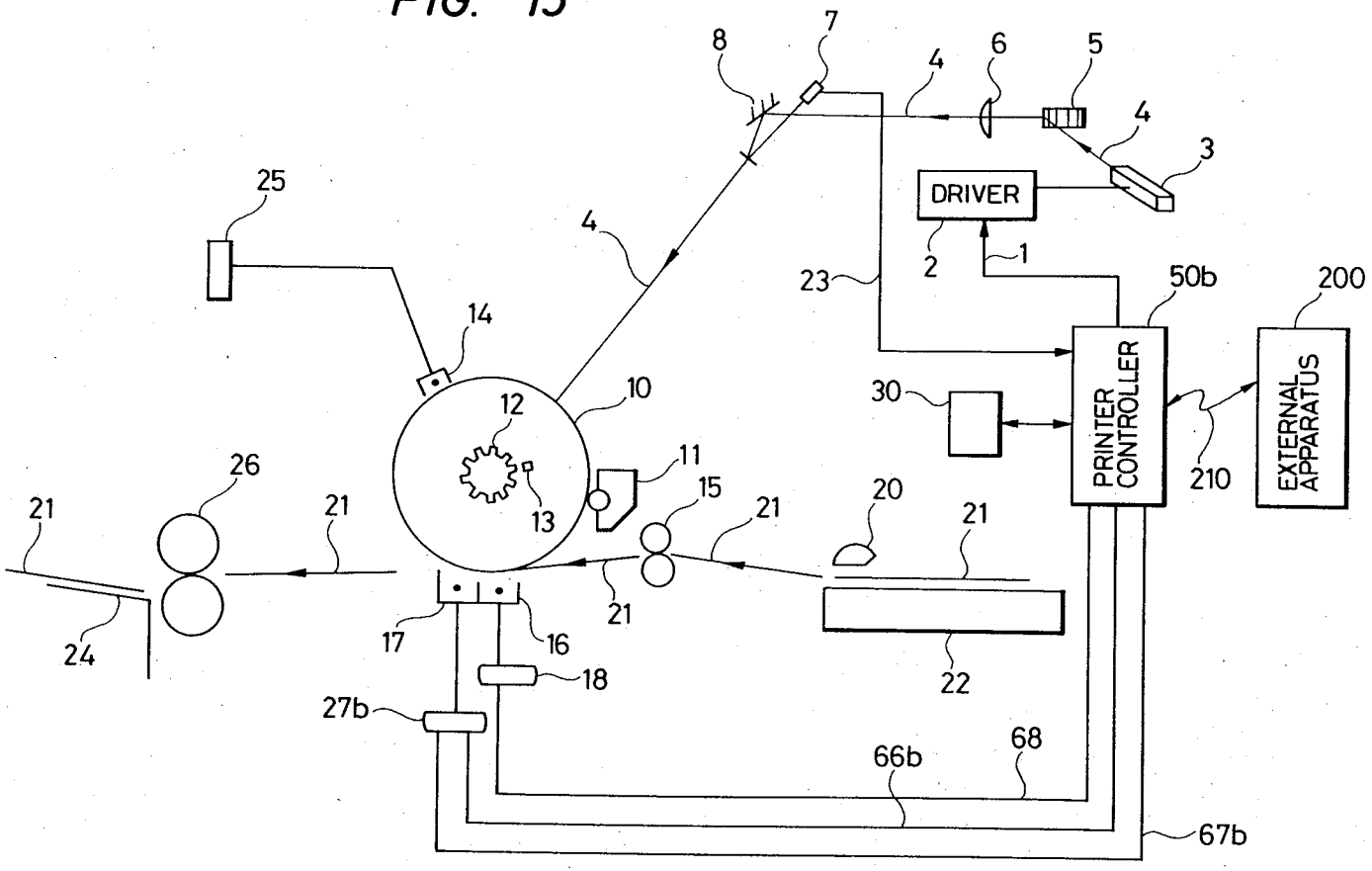
FIG. 15 is a diagram showing the configuration a laser beam printer according to a third embodiment of the present invention.

FIG. 15 is a diagram showing the construction of a laser beam printer according to the third embodiment. The same reference numerals as in FIG. 4 denote the same parts in FIG. 15, and a detailed description thereof will be omitted.

Referring to FIG. 15, a printer controller 50*b* produces a transfer high voltage ON/OFF signal 68 as a control signal for a transfer charger power source 18, a separating high voltage ON/OFF signal 66*b* for turning on or off the AC power source of an AC/DC voltage power source of a separation charge eliminator 17, and a separating DC FULL/MIDDLE signal 67*b* for controlling an output from the DC section of the AC/DC voltage power source 27 between a high voltage and an intermediate voltage The DC section is not operative when the separating high voltage ON/OFF signal 66*b* is OFF.

As can be seen from the description made with reference to FIG. 4, the transfer material is charged from its leading edge by the transfer charger. Therefore, the leading edge of the transfer material is in tight contact with the drum 10, frequently resulting in separation error. In view of this, in this embodiment, the non-image zone is not charged by the transfer charger. If the application voltage for the separation charge eliminator is high, separation of the transfer material is easy. Therefore, the separating charge eliminating voltage for the non-image zone of the transfer material is set at a high voltage, while that for the image zone is set at a low voltage not causing any re-transfer. Alternatively, no separating voltage is applied for the non-image zone, and a separating charge eliminating voltage not causing any re-transfer is applied for the image zone. These two alternatives do not require any hardware change and require only slight modification in the control flow sequence.

Selection of a separation charge eliminating DC voltage will be described. FIG. 3 is a diagram showing the relationship between the DC bias voltage applied to the separation charge eliminator, the separability of the transfer material, and re-transfer of toner The measurement conditions are as follows: the photosensitive body is an amorphous Si, the peripheral speed of the drum at its surface is 180 mm/sec, the transfer charger 16 is arranged at 11 mm from the drum and receives a voltage of −5.0 kV, and the separation charge eliminator 17 is arranged at 14 mm from the drum surface and receives an AC voltage of 5.0 kVrms and a DC voltage shown in FIG. 3. The dark potential Vd at the developing unit is 400 V, the bright portion Vl is 50 V, and the transfer material is normal paper having a weight of 64 g/m$^2$.

Under these conditions, the transfer material separable zone is 0.2 to 1.8 kV. However, since the re-transfer zone is 1.0 to 1.8 V, if a predetermined DC superposition voltage is applied, a zone wherein no toner re-transfer occurs and separation can be satisfactorily performed is 0.2 to 1.0 kV.

However, naturally, toner re-transfer occurs only in a zone wherein toner is attached, i.e., in an image zone. Therefore, toner re-transfer does not occur in a non-image zone. In the third embodiment, a relatively high DC voltage, e.g., 1.2 kV is applied in a non-image zone from the transfer material leading edge to the first video signal (image signal). A relatively low DC voltage which does not cause retransfer, e.g., 0.6 kV is applied in a subsequent image zone.

With this control, the electrostatic attraction force at the leading edge of the transfer material is reduced, and separation of the transfer material is facilitated. In addition, re-transfer of toner is not caused in an image zone. When the leading edge of the transfer material is separated, the subsequent zone of the transfer material can be easily separated at a relatively low voltage level at which re-transfer is not caused.

In a modification of this embodiment, a separation charge eliminating voltage is not applied for a non-image zone, and a DC superposition voltage of 0.6 kV is applied for only an image zone. In this case, since the separation charge eliminating voltage is not applied for a non-image zone, there is substantially no toner present between the transfer material 21 and the drum 10 and substantially no attraction force is generated therebetween to allow easy separation of the transfer material, although these effects are not as strong as those in the first embodiment.

In the third embodiment, image data of the video signal is detected as in the previous embodiments. A circuitry as shown in FIGS. 5A and 5B can be used to perform this detection. Therefore, the operation of the circuit shown in FIGS. 5A and 5B will not be described in detail. In response to the video detection signal 62, the printer controller 50*b* enters an interrupt routine and turns on the transfer high voltage ON/OFF signal 68 as a control signal for the transfer charger power source 18 as will be described below.

The control process of voltage application timing will be described with reference to the positional relationship between the transfer charger 16, the separation charge eliminator 17, the drum 10 and the transfer material 21 as shown in FIG. 6A.

Since the operation of this embodiment is substantially the same as that of the first and second embodiments, a detailed description will be omitted. Referring to FIG. 6A, it is assumed that the distance between the points C and K is equal to that between the points K and K' (where K is the transfer position). If black information is detected when the leading edge of the transfer material reaches the point G, the black information is exposed to the point C and forms a toner image. Therefore, the point K' on the transfer material coincides with the toner image on the drum 10 at the point K within a time period required for the drum 10 to rotate from the point C to the point K. Thus, the voltage applied to the transfer charger 16 is set 0 for at least the above-mentioned time period (the time period required for the drum 10 to rotate from the point C to the point K) after the laser beam scan is started and black information is detected. Thereafter, the voltage applied to the transfer charger 16 is increased to a voltage required for image transfer. A time period required for the first toner image (boundary between non-image and image zones) to reach the point D to which the corona discharge effect of the separation charge eliminator 17 reaches is also known. From this, the timing for applying the transfer voltage to the transfer charger 16 (i.e., the timing at which the first toner image reaches the point K), and the timing for switching the application voltage of the separation charge eliminator 17 (i.e., the timing at which the first toner image reaches the point D) can be determined. Note that these timings are determined including short time periods required for the corona discharge to stabilize after application of a high voltage.

A description will briefly be made with reference to the case wherein the distance between the points C and K is longer than that between the points K and F. Since the operation is substantially the same as that of the first embodiment, a detailed description will not be made.

In the third embodiment, if black information is detected when the point C on the drum 10 rotates to the point J, a toner image corresponding to the black information is formed at the point C. Therefore, the transfer charger must be stopped for the time period required for the drum 10 to rotate from the point C to the point K. Even if the point J is between the points C and H, i.e., even if black information is detected before the registration rollers 15 are driven, the operation is the same.

Although the description has been made with reference to the case of two positional relationships, in an actual optical printer or the like, the positional relationship between the drum 10, the registration rollers 15 and the like remains constant. Therefore, the following description will be made with reference to the case wherein the drum 10, the registration rollers 15 and the like have the positional relationship as shown in FIG. 6A.

Figure 17A:
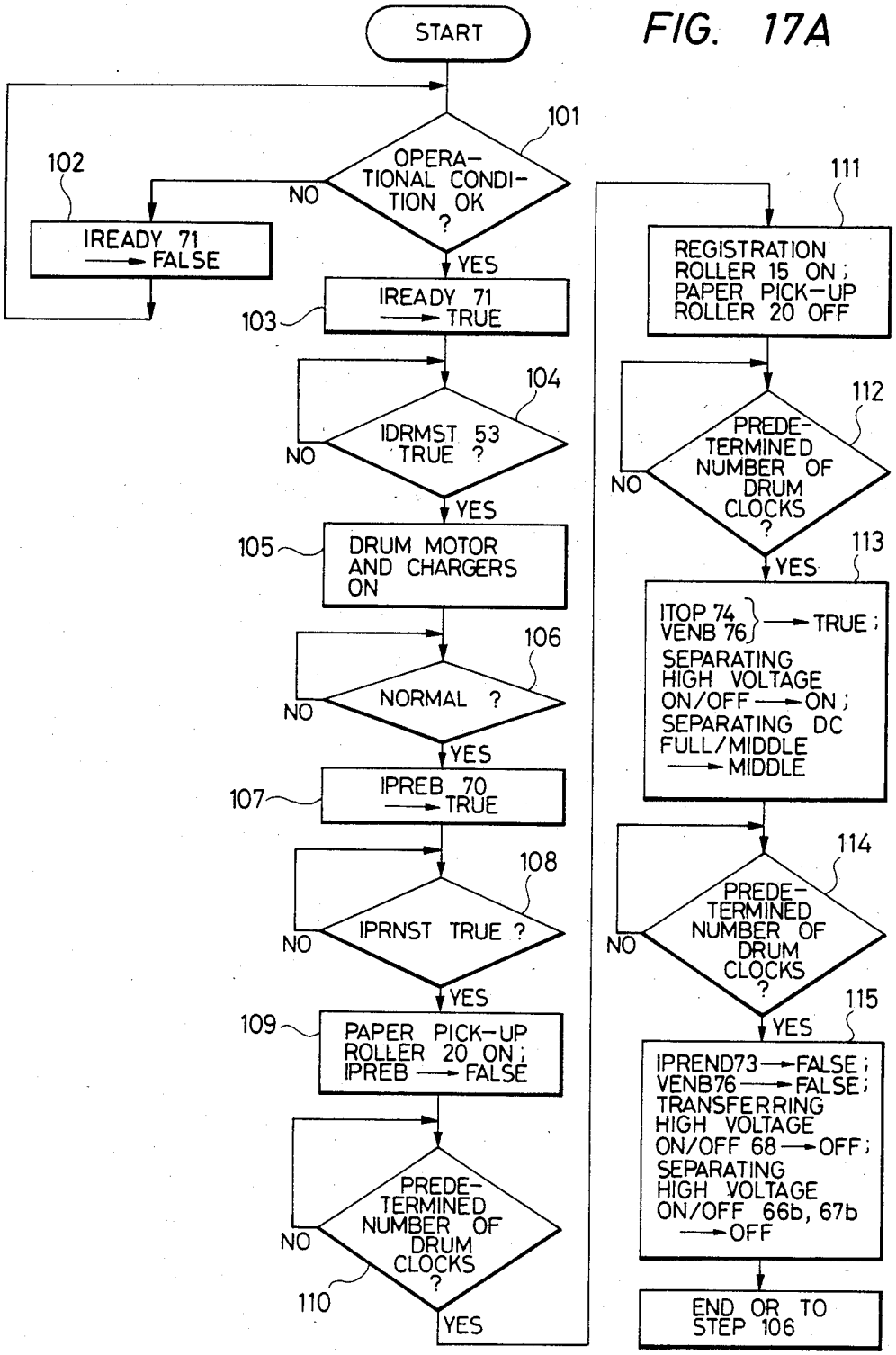
FIGS. 17A, 17B and 17C are flow charts of a control sequence in the third embodiment of the present invention.
Figure 17B:
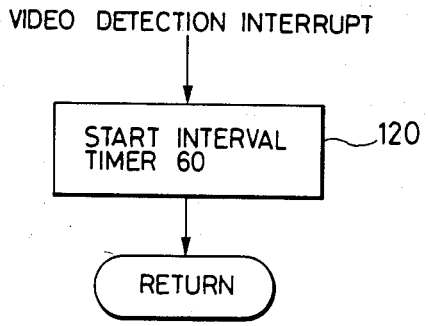
Figure 17C:
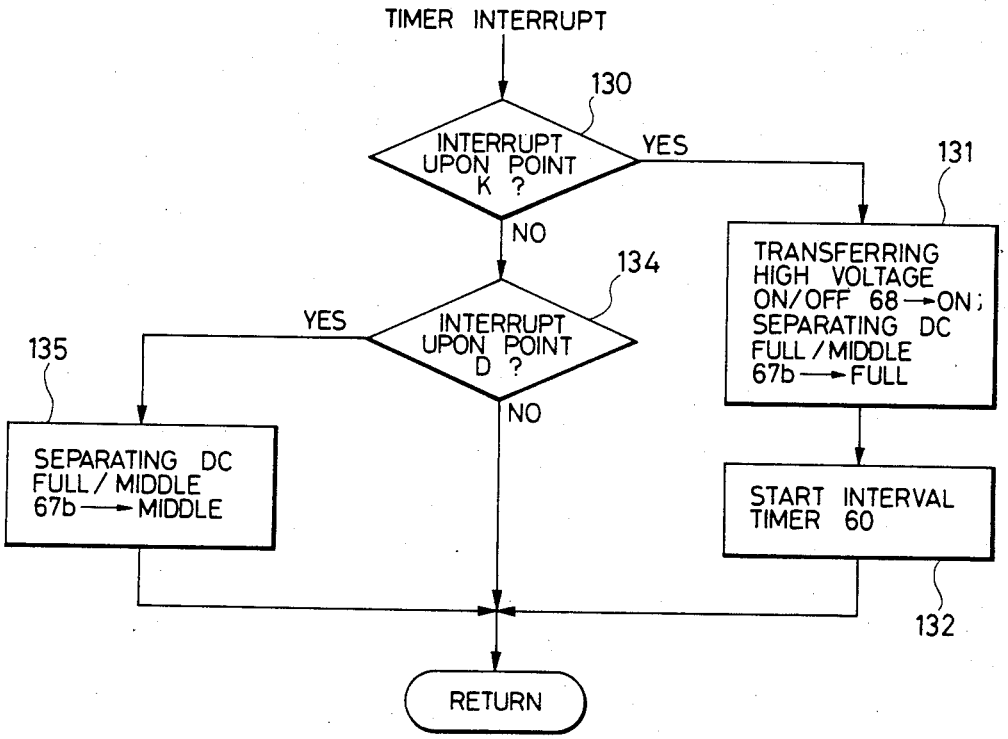

The control flow of the printer controller **50*b* will be described with reference to FIGS. 17A, 17B and 17C**.

Figure 16:
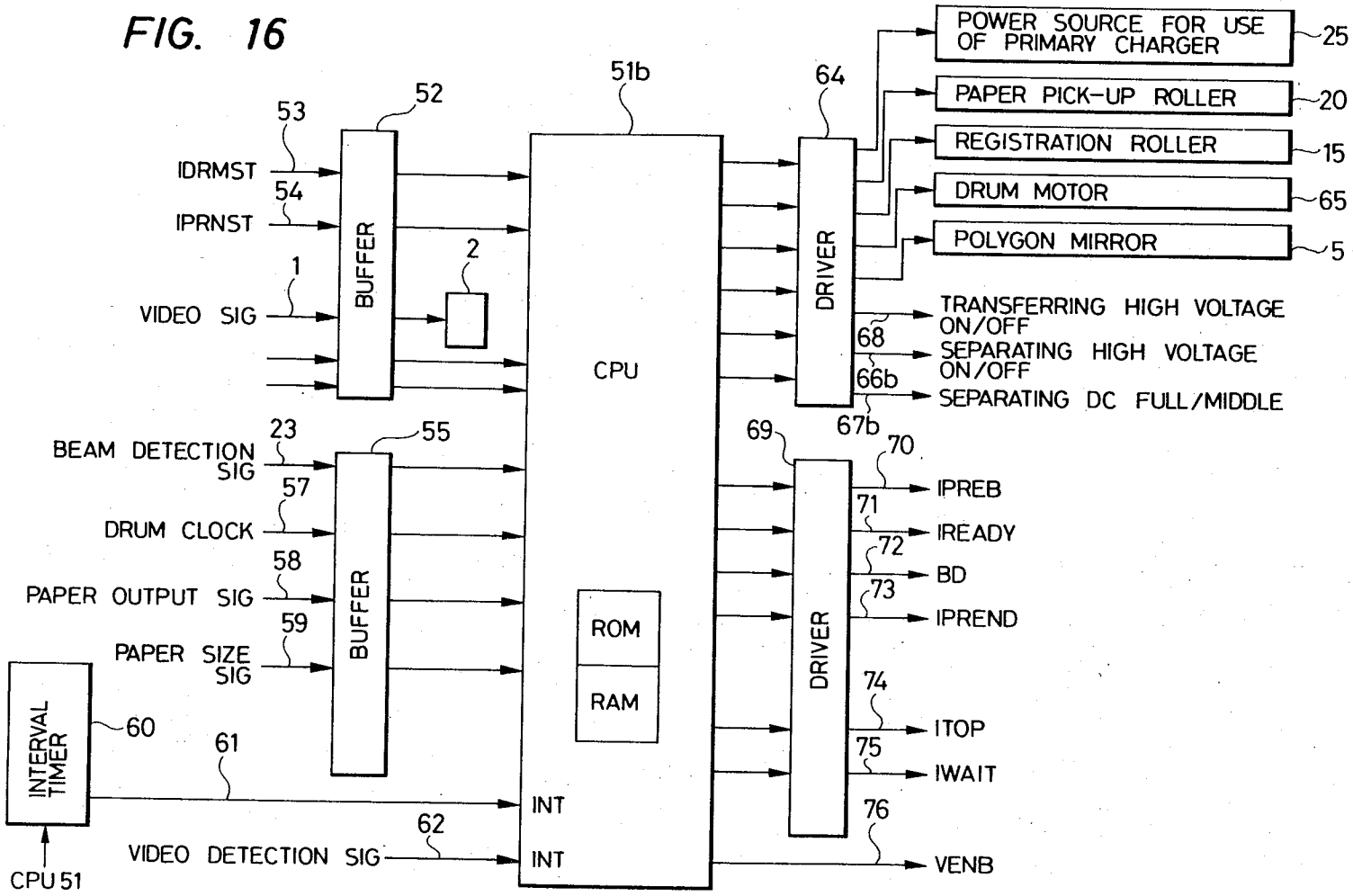
FIG. 16 is a block diagram showing the main part of a printer controller in the third embodiment of the present invention.

FIG. 16 is a block diagram of the printer controller. Referring to FIG. 16, the same reference numerals as in FIG. 7 denote the same parts, and a detailed description thereof will be omitted. The switching timing of the DC voltage in the third embodiment is controlled by the interval timer 60. As described above, the controller **50*b* generates the transfer high voltage ON/OFF signal 68 as a control signal for the transfer charger power source 18, the separating high voltage ON/OFF signal 66*b* for turning on or off an AC power source section of the AC/DC voltage power source 27 for the separation charge eliminator 17, and a separating DC FULL/-MIDDLE signal 67*b* for controlling an output from the DC section of the AC/DC voltage source 27** between a high voltage and an intermediate voltage. The DC power source section does not operate when the separating high voltage ON/OFF signal is OFF.

Figure 18A:
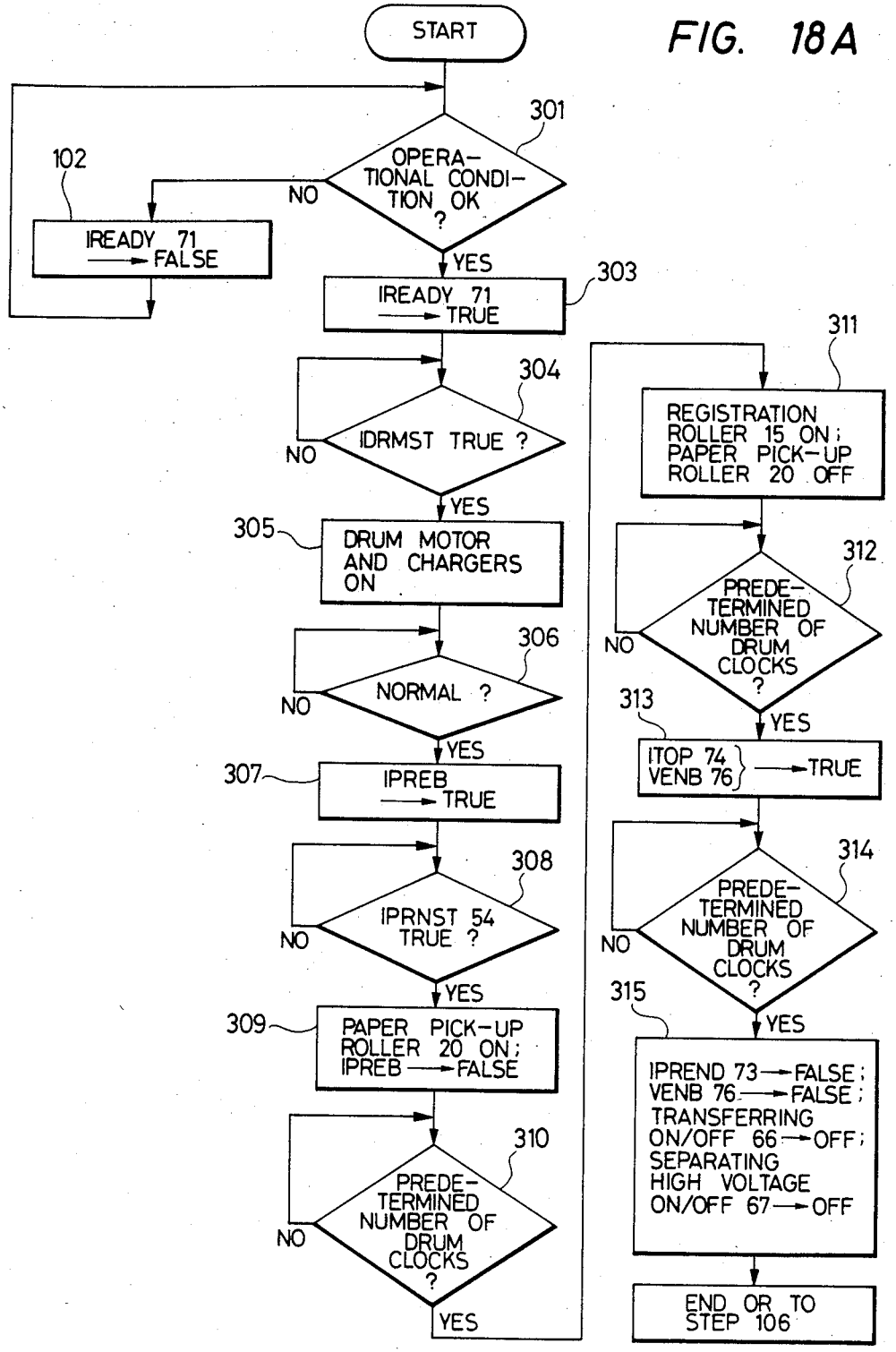
FIGS. 18A, 18B and 18C are flow charts of a control sequence in a modification of the present invention.
Figure 18B:
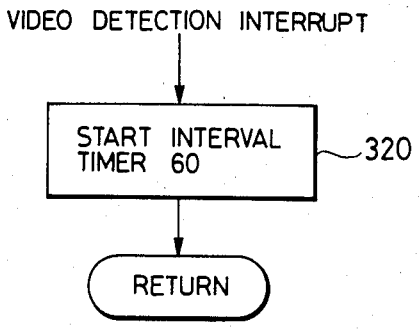
Figure 18C:
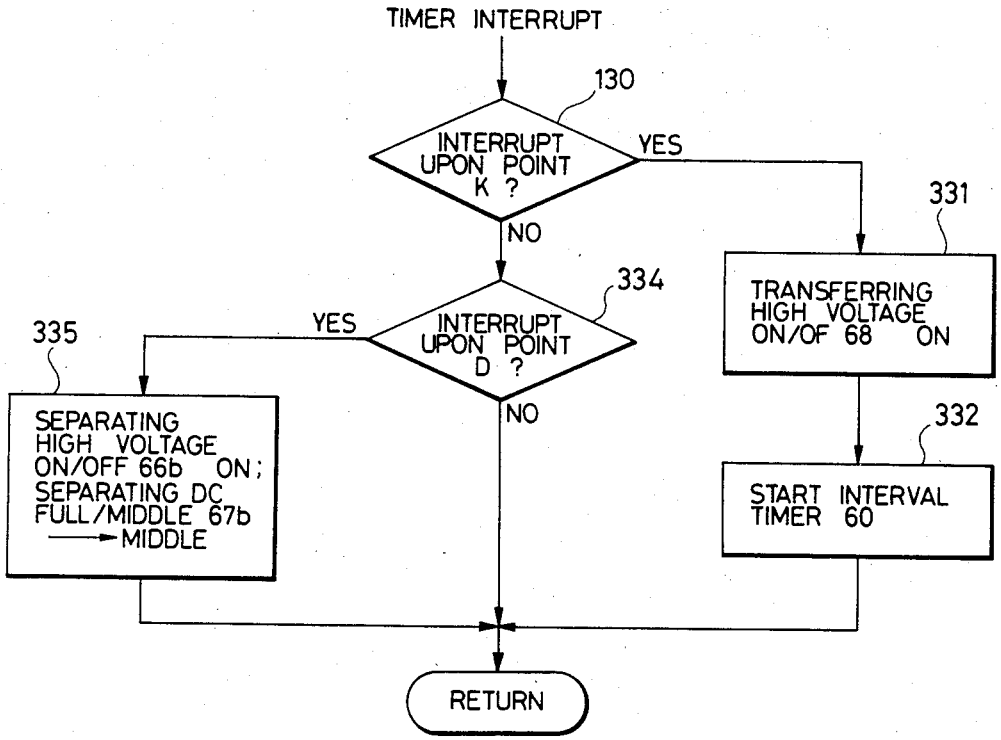

FIGS. 17 and 18 are control program flows for executed by a CPU **51*b*. FIG. 17 is a flow chart wherein the separation charge eliminating voltage is changed from a high voltage to an intermediate voltage or middle voltage from a non-image zone to an image zone. FIG. 18 is a flow chart for turning on the separation charge eliminating voltage. The flow shown in FIG. 17 will be described with reference to FIGS. 6 and 16** as needed.

Referring to FIG. 17, steps 101 to 112 are the same as steps 101 to 112 in FIG. 8, and a description thereof will be omitted. In step 113, the signal ITOP 74 is produced by the CPU **51*b* for one drum clock period so as to request an external apparatus 200 to send a video signal 1, and a signal VENB 76 is set true. At this time, a video detector 30 starts operating, and an interrupt to the CPU 51*b* by a video detection signal 62 can be made. The separating high voltage ON/OFF signal 66*b* is turned on, and the separating DC voltage FULL/MIDDLE signal 67*b*** is turned off, i.e., set at MIDDLE, thereby applying an intermediate separation charge eliminating voltage.

In response to the signal ITOP 74, the external apparatus 200 sends an image in an internal memory to the printer controller **50*b* as a video signal 1. Since the signal VENB 76 is true, the video detector 30 starts discriminating if the video signal 1 includes black information. When the video detection signal 62 is set true, the flow enters the interrupt routine shown in FIG. 17B**.

In the interrupt routine, the internal timer of a preset time period is started (step 120) and the flow returns to the main control flow. The preset time period in FIG. 6A is a time period required for the drum 10 to rotate from the point C to the point K. When the flow returns to the main control flow shown in FIG. 17A, the print processing is continued while awaiting a timer interrupt. During this process, an electrostatic latent image is formed on a photosensitive drum 10. When a timer interrupt is generated, it means that the first toner image (i.e., an image zone) has reached the point K. When a timer interrupt is generated, the flow enters the timer interrupt routine shown in FIG. 17C.

In the timer interrupt routine, it is checked if the timer interrupt has been generated since the drum has reached the point K (step 130). Since YES in step 130, the flow advances to step 131. In step 131, the transfer high voltage ON/OFF signal 68 is turned on, and the separating DC FULL/MIDDLE signal **67*b* is turned on (FULL) so as to apply a high transfer voltage so as to transfer a toner image to the transfer material 21. At the same time, the separating DC FULL/MIDDLE signal 68 is turned on (FULL) so as to apply a high separation charge eliminating voltage. Since a non-image zone is on the separation charge eliminator 17, the transfer material can be easily separated. In step 132, the interval timer 60 is started, the time period required for the drum 10** to rotate from the point K to the point D is set, and the flow returns to the main control flow.

In the program of the main control flow, it is checked in step 114 if printing of one page has been completed. However, another timer interrupt is generated before printing of one page is completed. Generation of this timer interrupt means that the image zone has reached the point D. Therefore, in the interrupt routine shown in FIG. 17C, NO is obtained in step 130, the flow advances to step 131 and then to step 135. In step 135 in order to decrease the separation charge eliminating voltage to a level not to cause re-transfer, the separating DC FULL/MIDDLE signal **76*b* is turned off (MIDDLE) and the flow returns to the main control flow. In the main control flow, it is checked in step 114** if printing of one page has been completed, and transfer/separation is performed.

An end of printing of one page is determined by means of a paper size signal 59, i.e., the count of the drum clocks 57. Therefore, when the number of drum clocks reaches a predetermined value (step 114), an image zone end signal IPREND 73 is set true for the one drum clock period through a driver 69, thereby signalling to the external apparatus 200 an end of printing of a zone. At the same time, the signal VENB 76 is set false to stop operation of the video detector 30, and the transfer high voltage ON/OFF 68 is turned off and the separating high voltage ON/OFF signals **66*b* and 67*b* are turned off (step 115). The transfer material 21 is output through a fixing unit 26. When a continuous copy operation is performed, processing from step 106** is repeated.

When printing is completed and signals IDRMST 53 and IPRNST 54 are both set false, all the printing paper or transfer material is output, and a drum motor 65, a paper pick-up roller 20 and registration rollers 15 are stopped.

FIG. 18 is a control flow chart for turning off the transfer voltage and separation charge eliminating voltage for a non-image zone and for turning on both the voltages for an image zone. Steps 301 to 312 in FIG. 18 are the same as steps 101 to 112 in FIG. 17, and a description thereof will be omitted.

When the transfer material 21 reaches the point E in step 132, the flow advances to step 313. The CPU 51*b* produces the signal ITOP 74 for one drum clock period through the driver 69 to request the external apparatus 200 to send the video signal 1, and sets the signal VENB 76 true. At this time, the video detector 30 starts operating, and an interrupt to the CPU 51*b* by the video detection signal 62 can be generated.

In response to the signal ITOP 74, the external apparatus 200 sends image data in the internal memory to the printer controller 50*b* as a video signal 1. Since the signal VENB 76 is true, the video detector 30 starts discriminating if the video signal 1 includes black information. When the video detection signal 62 goes true, the flow enters the interrupt routine shown in FIG. 18B.

In the interrupt routine, the interval timer 60 setting a preset time period therein is started (step 320) and the flow returns to the main control flow. The preset time period is a time period required for the drum 10 to rotate from the point C to the point K in the case shown in FIG. 6A. When the flow returns to the main control flow (FIG. 18A), processing is continued while awaiting a timer interrupt. During this processing, since both the transfer and separation zones are non-image zones, neither the transfer voltage nor the separation charger eliminating voltage is applied. When a timer interrupt is generated, it means that the first toner image (i.e., image zone) has reached the point K. When a timer interrupt is generated, the flow enters the timer interrupt routine shown in FIG. 18C. In the timer interrupt routine, it is checked if the current timer interrupt routine is one generated since the drum has reached the point K (step 330). Since YES in step 330, the flow advances to step 331. In step 331, the transfer high voltage ON/OFF signal 68 is turned on and the toner image is transferred onto the transfer material 21. In step 332, the interval timer 60 is started to set the time required for the drum 10 to rotate from the point K to the point D, and the flow returns to the main control flow. In the main control flow program, it is checked in step 314 if printing of one page has been completed, and a timer interrupt is generated every time printing of one page is completed. Since a timer interrupt means that an image zone has reached the point D, in the interrupt routine shown in FIG. 18C, NO is obtained in step 330, and the flow advances to step 334 and then to step 335. In step 335, since the image zone has reached a position on the separation charge eliminator 17, in order to apply a voltage not causing re-transfer of toner, the separating high voltage ON/OFF signal 66*b* is turned on and the separation DC FULL/MIDDLE signal 68 is turned off, and the flow returns to the main control flow. The subsequent flow is the same as that in FIG. 17, and a description thereof will be omitted.

Figure 19A:
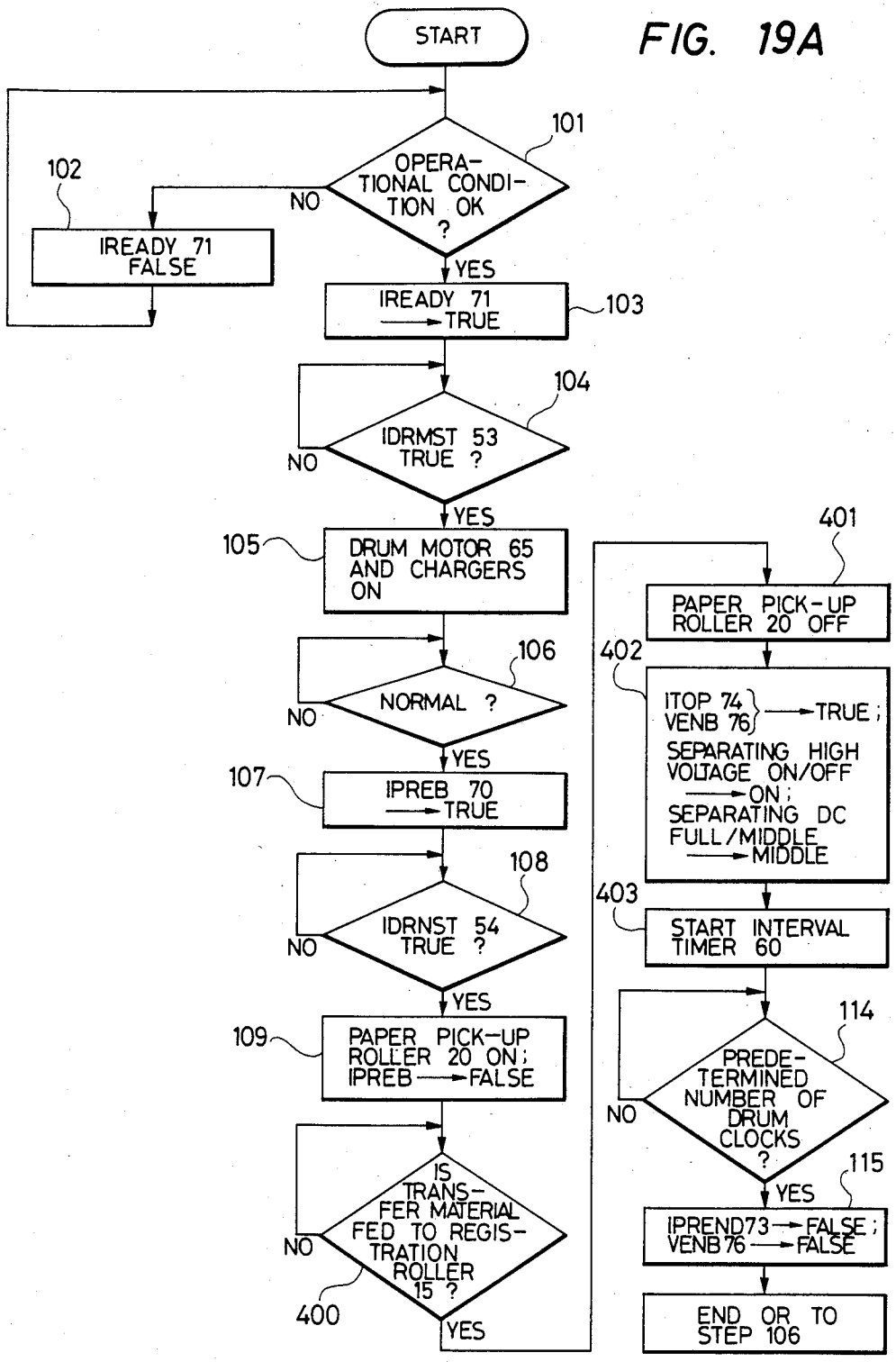
FIGs. 19A, 19B and 19C are flow charts of a control sequence when the photosensitive body 10 and the registration rollers 15 are in the positions shown in FIG. 6B.
Figure 19B:
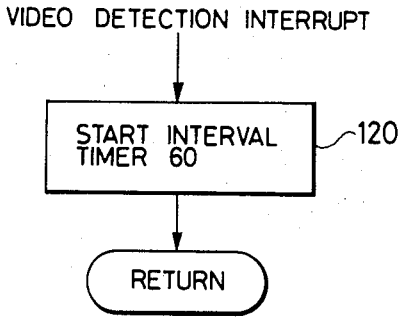
Figure 19C:
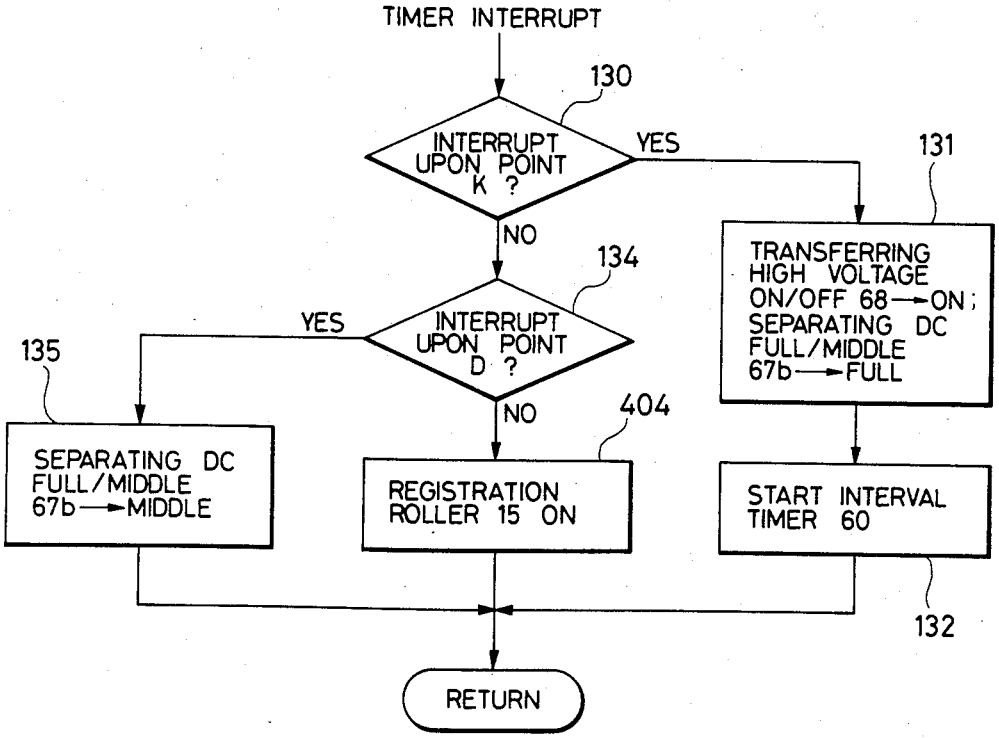

The control flows shown in FIGS. 17 and 18 correspond to a case wherein the drum 10 and the registration rollers 15 are at the positional relationship as shown in FIG. 6A. The following description will be made with reference to the case wherein the drum 10 and the registration rollers 15 hold the relationship as shown in FIG. 6B. FIG. 19 shows a control flow in this case. Referring to FIG. 19, steps 101 to 401 are substantially the same as steps 101 to 401 in FIG. 9, and a description thereof will be omitted.

In step 402, the signals ITOP 74 and VENB 76 are set true to request the external apparatus 200 to send the video signal 1, and the video detector 30 is actuated. The separation charge eliminator 17 is operated. In step 403, the interval timer 60 is started. When the photosensitive drum reaches the point H, a timer interrupt is generated. Therefore, in the interrupt routine shown in FIG. 19C, the flow advances in the order of steps 130, 134, and 404 to drive the registration rollers 15. When the registration rollers 15 are driven, the transfer material 21 and the registration rollers 15 are moved in synchronism with each other. The subsequent flow is the same as that in FIG. 17, and will not be described.

In the above embodiment, after the CPU 51*b* receives the video detection signal 62, the interval timer 60 is started in the interrupt routine (FIG. 17B) to generate a timer interrupt. However, since a preset time period set in the timer corresponds to a predetermined count of the drum clocks 57, the interval timer 60 can be omitted and a counter can be used in the video detection interrupt routine. The counter is incremented every time a drum clock 57 is received. When the count of the counter reaches a predetermined value, it can be determined that the image zone has reached a predetermined position.

A fourth embodiment of the present invention will be described below.

A copying machine according to the fourth embodiment basically consists of two units, i.e., a reader A and a printer B. The overall configuration will first be described. Then, the construction and operation of the reader A will be described next, and the construction and operation of the printer B will thereafter be described. The operation involving the two units will finally be described with reference to a flow chart.

Figure 20:
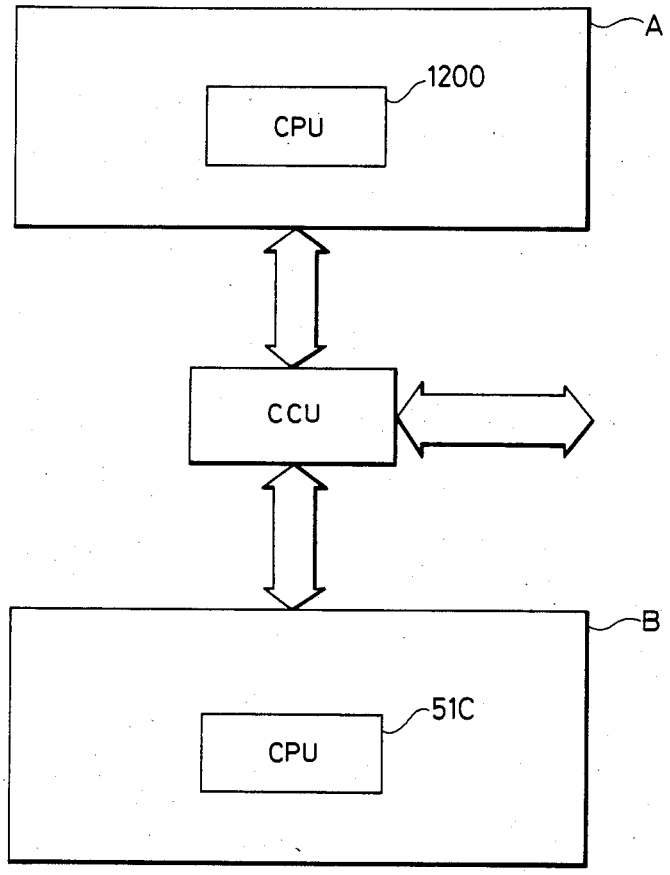
FIG. 20 a diagram showing an interface connecting a reader A and a printer B.

Thus, the construction of the overall system will first be described. FIG. 20 shows an interface between the reader A and the printer B. The reader A has a CPU 1200, and the printer B has a CPU 51*c*. The CPUs 1200 and 51*c* respectively control the corresponding units independent of each other. A communication control unit (CCU) allows connection of the reader A or the printer B to another reader or printer. However, the CCU does not modify the interface signal in any manner, and only performs switching operation of the signal. For this reason, the CCU will not be included in the following description.

Figure 21:
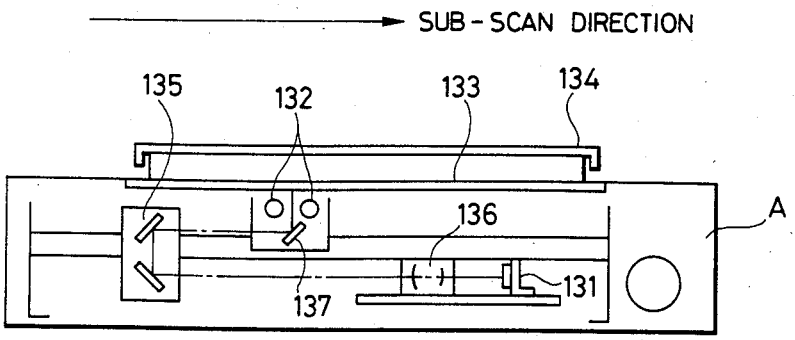
FIG. 21 is a sectional view of a reader in a fourth embodiment of the present invention.

The reader A will now be described. FIG. 21 is a sectional view of the reader A. An original is set on an original glass 133 facing downward. The setting standards are at the left back corner viewed from the front. The original is lightly urged against the glass by an original cover 134 having a rear surface treated not to reflect light. The original is illuminated with light from a fluorescent lamp 132, and reflected light from the original is focused on a CCD (charge-coupled device) 131 through mirrors 135 and 137 and a lens 136.

The mirrors 137 and 135 are moved in the subscan direction indicated by an arrow at a relative speed ratio of 2:1. The optical unit is moved from the left to right at a constant speed by a servo motor while performing PLL. The moving speed of the optical unit is 180 mm/sec during forward movement (original illumination), and is 468 mm/sec during backward movement. The resolution in the sub-scan direction is 16 lines/mm. The original sizes which can be processed are A5 to A3 sizes. The original setting directions are vertical for originals of A5, B5 and A4 sizes, and transverse for originals of B4 and A3 sizes.

The main scan width in the main scan direction is the width 297 mm of an original of a maximum size (A4 size) when the originals set in directions mentioned above. In order to obtain a resolution of 16 pel/mm, the CCD must have 4,752 ($=297\times16$) bits. Therefore, in the apparatus of this embodiment, two CCD array sensors each having 2,628 bits are used and are driven parallel with each other. Therefore, under the conditions of 16 lines/min and 180 mm/sec, the main scan period (CCD accumulation period) is given to be $T=1/(v.n)=1/(180\times16)=347.2$ μsec. The transfer speed of the CCD becomes $f=N/T=2628/347.2$ μsec$=7.569$ kHz.

Figure 22:
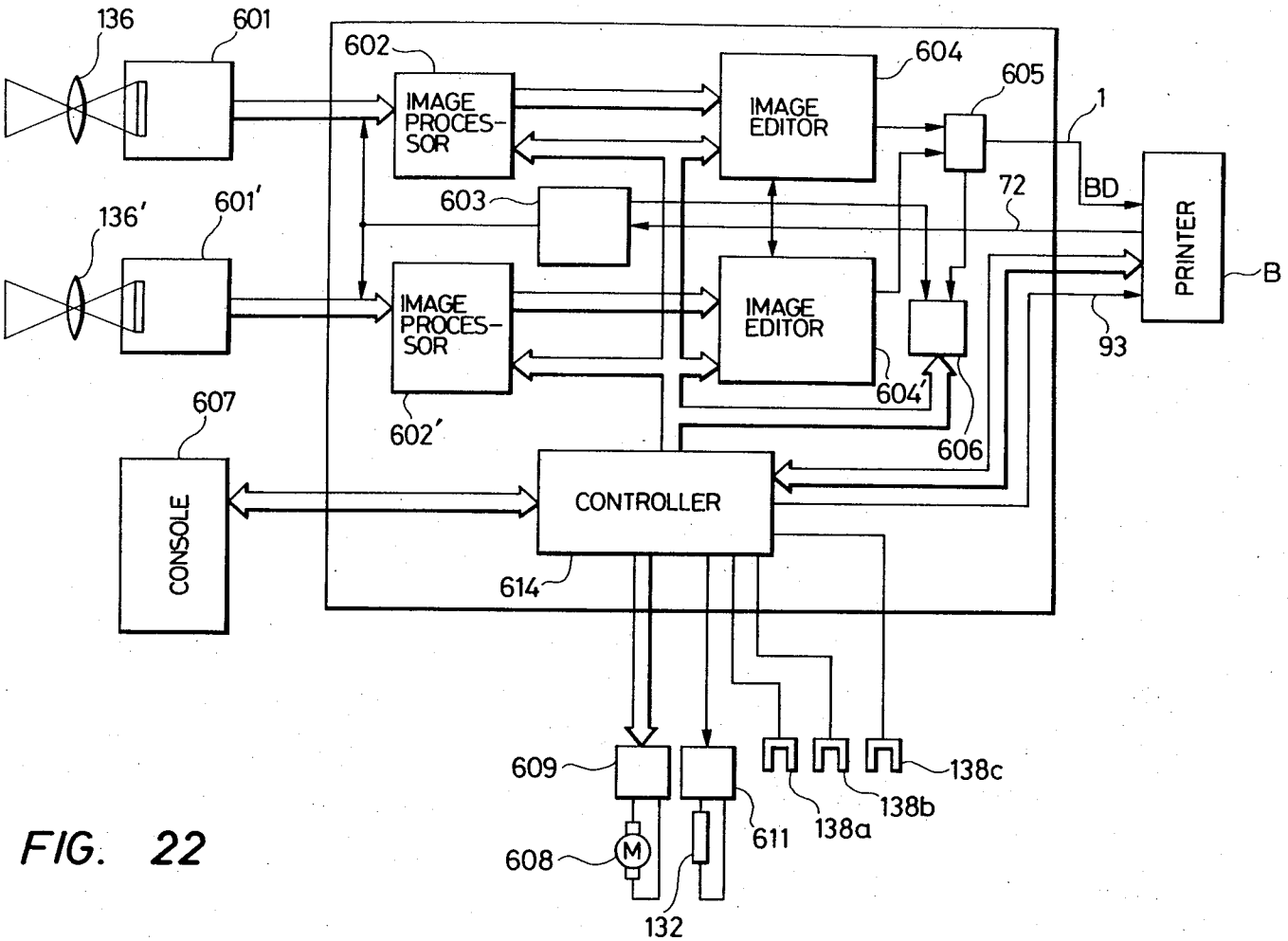
FIG. 22 is a block diagram of the main part of the reader A.

FIG. 22 is a system block diagram of the main portion of the reader A. Light signals focused by lenses 136 and 136' are converted into digital signals by CCD reading units 601 and 601', respectively. The CCD reading units 601 and 601' incorporate CCDs, CCD clock drivers, signal amplifiers for amplifying signals from the CCDs, and A/D converters for A/D converting signals from the amplifiers. A CCD control signal generator 603 generates a control signal for the CCDs, which is supplied to the clock drivers of the CCD reading units 601 and 601'. The control signal is generated in synchronism with a horizontal sync signal BD from the printer.

The CCD reading units 601 and 601' generate image data in the form of 6-bit digital signals which are supplied to image processors 602 and 602'. The image processors 602 and 602' include sampling circuits for sampling the light amount from a light source 132 and allowing a controller 614 to control the light amount, shading correction circuits and correction circuits for the light source and the lenses, peak holding circuits for detecting peak values of the light amount in each main scan for AE function, and quantizing circuits for quantizing the 6-bit image data after shading correction at one or two quantizing levels in accordance with the peak hold value of the immediately or second preceding line or a dither pattern. The quantized image signals from the image processors 602 and 602' are supplied to image editors 604 and 604'.

The image editors 604 and 604' have 2 line buffer memories. The 1-line capacity corresponds to twice or more of the 1-line pixel number, 4,752. This is because, when the image is to be enlarged to 200%, the pixel data is written in the buffer memories at a sampling rate twice the normal rate and the data amount is doubled.

Two line buffer memories are used for the following reason. Each line buffer cannot allow simultaneous write and read access. In view of this, two line buffer memories are incorporated, and while the Nth line image data is written in the first memory, the (N−1)th line image data is read out from the second memory.

The image editors 604 and 604' have write address counters for writing image data in the buffer memories, read address counters for reading out image data from the buffer memories, and address selectors for switching address signals from the two counters. The counters used are of parallel-load type in which preset values can be set, and the initial preset values are loaded by the controller 614 through an I/O port.

In accordance with the coordinate data designated by the scan portions, the controller 614 presets addresses corresponding to the main scan coordinates in the counters every time sub-scan reaches a line corresponding to a trimming coordinate, thereby allowing editing of the original data. The image editors 604 and 604' further include a coordinate region control counter and a gate circuit for allowing white masking, black masking, white frame trimming, and black frame trimming.

A combination unit 605 has a boundary detection shift register for detecting automatic linking of CCD data. Image data from the image editors 604 and 604' are output such that image data from the image editor 604 is output first and then image data from the image editor 604' is output. Therefore, both the image data is smoothly linked by the combination unit 605 to obtain single serial image data.

A recognizer 606 prescans an original during warming up of the printer after the copy start button is depressed, and detects the coordinates of the original during prescan. The recognizer 606 includes a shift register for detecting continuous white 8-bit image data, an I/O port and main/sub-scan counters.

A console 607 includes a key matrix, an LED, a liquid crystal display, and a liquid crystal driver.

An optical system scan DC motor 608 is driven by a driver 609. An original illuminating fluorescent lamp 132 is started by a starter 611. A photosensor **138*a* detects if the optical system unit is at the home position. A sensor 138*b* detects if the optical system unit is at a position to illuminate the leading edge of the original setting zone. A sensor 138*c*** detects if the optical system unit is at a position to illuminate the trailing edge of the original setting zone.

The controller 614 comprises a CPU, a ROM, a RAM, a battery back-up circuit, a timer circuit, and an I/O interface. The controller 614 controls the console 607 so as to perform sequence control of the reader A in response to a command from the operator and also controls the printer in response to a command. In response to a command from the console 607, prior to or during original scan, the controller 614 sets data in the counters in the image processors 602 and 602' and the image editors 604 and 604'. In accordance with light amount data from the image processors, prior to original scan, the controller 614 performs light amount control of the fluorescent lamp starter. In response to a magnification command, the controller 614 sets speed data in the DC motor driver 609. The controller 614 collects image linking data from the image editors 604 and 604' and calculates the linking amount.

Figure 23:
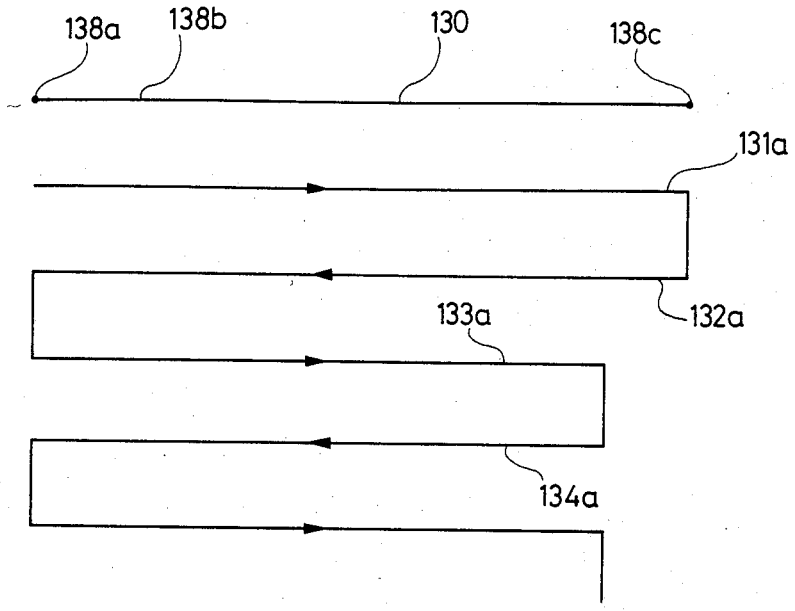
FIG. 23 is a diagram for explaining the scan method of the optical system of the reader A.

The movement of the optical system will be described with reference to FIG. 23. Referring to FIG. 23, a line 130 indicates the range of movement of the optical system. The sensors **138*a*, 138*b* and 138*c* are arranged at three locations on the line 130. The point 138*a* corresponds to the optical system start position, and the zone between the points 138*b* and 138*c*** is the copy zone.

In a forward path **131*a*, the optical system starts from the position 138*a* and the coordinates of the original in the zone between the points 138*b* and 138*c* are determined. The optical system then returns through a return path 132*a* from the point 138*c***. The above operation is called prescan.

The optical system starts moving a forward path **133*a* from the point 138*a* again. When the optical system reaches the initial coordinate position of the original detected during prescan, the reader A supplies a video signal as image data to the printer B. When black image (true in the video signal) is detected during image data transfer, this is signalled to the printer B and the printer B changes the voltage of the separation charge eliminator. This operation is repeated in the copying machine. The forward path 133a is shorter than the forward path 131a** since the trailing edge of the original has been confirmed during prescan and the optical system starts returning exactly at the trailing edge.

Figure 24:
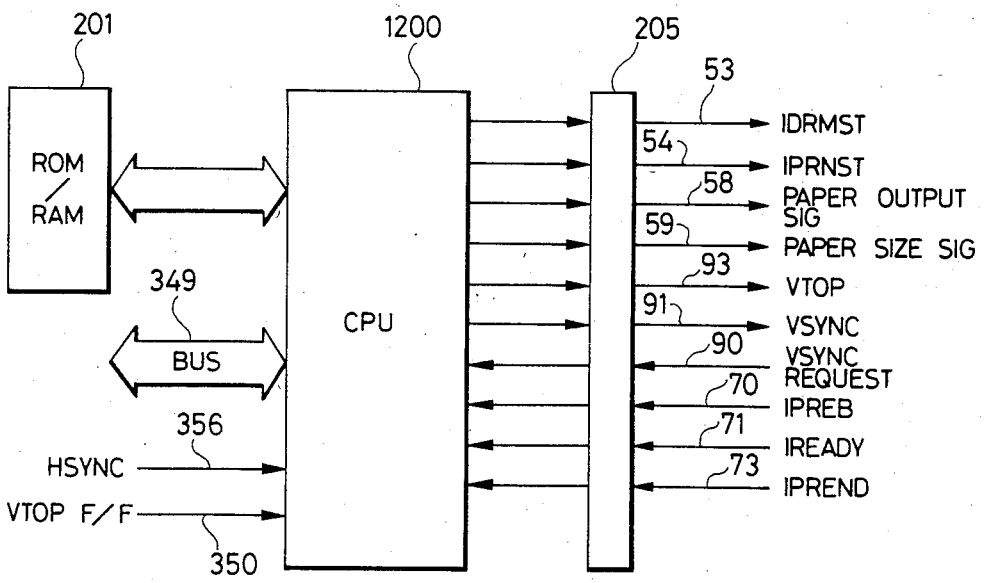
FIG. 24 is a diagram showing the CPU section of a controller 614 in the reader A.

The configuration of the controller 614 will be described with reference to FIG. 24. A central processing unit (CPU) 1200 performs control operation in accordance with a program stored in a ROM/RAM. A receiver/driver 205 exchanges an interface signal with the printer B. The CPU 1200 receives a signal HSYNC 356 and a signal VTOPF/F 350 as interrupt inputs. The signal VTOPF/F 350 is generated by the image processors 604 and 604' and represents the leading edge of a black image. A system bus 349 connects between the reader A and the CPU 1200. Other signals will be described below.

Figure 25:
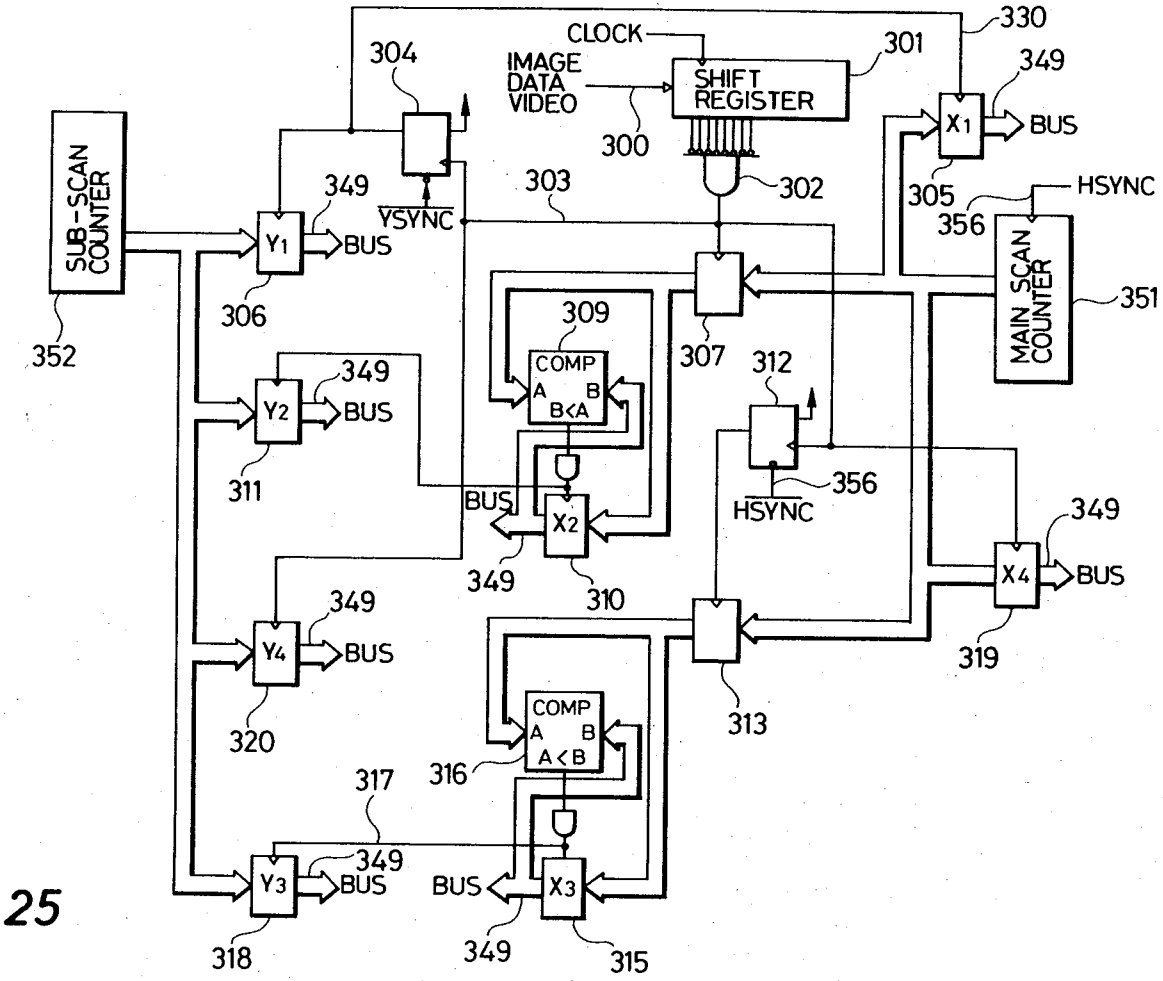
FIG. 25 is a circuit diagram of a circuit for detecting the coordinates of an original.

A method of determining the coordinates of the original will be described. The circuit shown in FIG. 25 is part of the recognizer 606 and is illustrated for explaining the principle of detecting original coordinates. In an example illustrated in FIG. 26, an original is set at a position defined by points P1 (X1, Y1), P2 (X2, Y2), P3 (X3, Y3) and P4 (X4, Y4) on the original glass 33.

Referring to FIG. 25, a main scan counter 351 and a sub-scan counter 352 hold X (main scan) and Y (sub-scan) addresses. Latches 305, 310, 315, 319, 306, 311, 318 and 320 latch respective addresses from the main scan counter 351 and the sub-scan counter 352. More specifically, the latches 305 and 306 latch the coordinates (X1, Y1), the latches 310 and 311 latch the coordinates (X2, Y2), the latches 315 and 318 latch the coordinates (X3, Y3), and the latches 319 and 320 latch the coordinates (X4, Y4).

The latching process of the coordinates by the recognizer 606 will be described below. The latches and the F/Fs such as F/Fs 304, 307 and 312 excluding shift registers 301 and 313 are reset when power is turned on. Although not shown, prior to prescan, the latch 315 is preset to a maximum value by the CPU 1200 for the reason to be described below. The main scan counter 351 is set to this maximum value for each scan by the horizontal sync signal HSYNC 356 generated every time the optical system scans in the Y direction (sub-scan direction). The sub-scan counter 352 is preset to its minimum value prior to prescan. Therefore, the main scan counter 352 counts in the count down mode, and the sub-scan counter 352 counts in the count up mode.

When the optical system scans the original during prescan, the image data is supplied to the shift register 301 as 8-bit image data through the image processors 602 and 602', the image editors 604 and 604', and the combination unit 605.

Since the original cover 34 is treated not to reflect light, black image data is obtained in a zone other than the original. Therefore, in order to determine the original position, a continuous white 8-bit signal must be detected.

When 8-bit data is input, a gate circuit 302 checks if all the 8-bit data is a white image. If so, a signal line 303 is set active. When the first white 8-bit data is received after original scan is started, the F/F 304 is set.

Initially, when power is turned on, the F/F 304 is reset by the CPU 1200. Thereafter, the F/F 304 is reset before each prescan by the signal VSYNC (image leading edge signal) generated in each previous copy operation. After being set, the F/F 304 is kept set before the next signal VSYNC is received.

Figure 26:
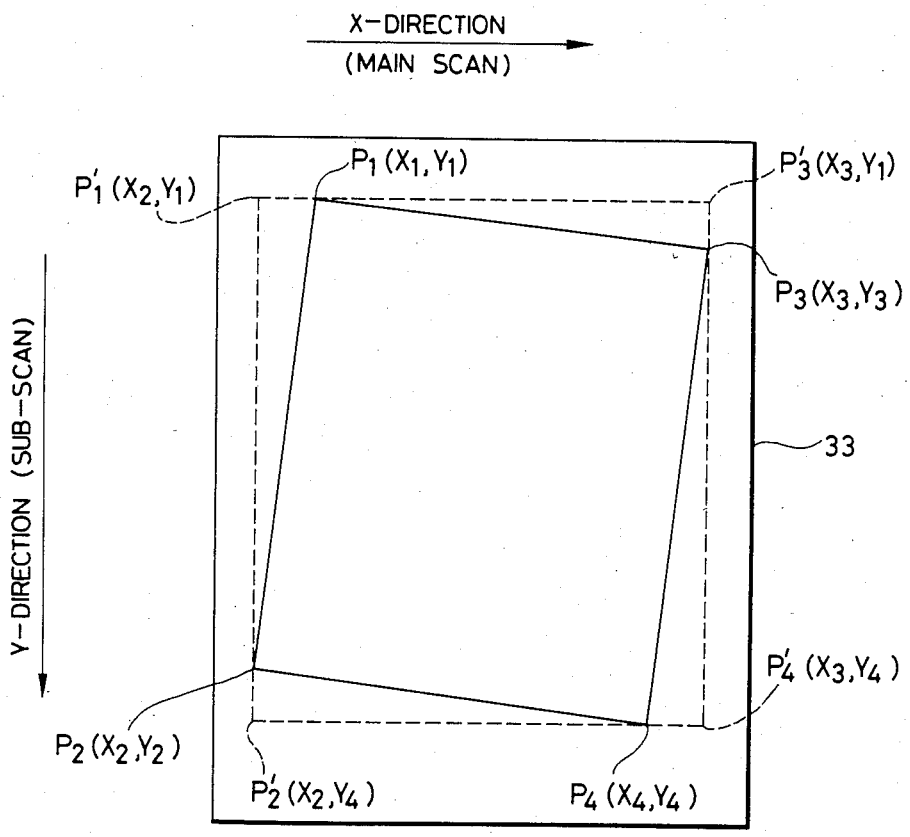
FIG. 26 is a diagram for explaining the original coordinates.

When the F/F 304 is set, the current value of the main scan counter 352 is loaded in the F/F 305 through the line 330. The loaded value is the X1 coordinate. Similarly, the current value of the subscan counter 352 is loaded in the latch 306. This is the Y1 coordinate. Thus, the point P1 (X1, Y1) as shown in FIG. 26 is determined.

Every time the signal line 303 is set at logic level "1", the value obtained by main scan is loaded in the latch 307. This data is compared by a comparator 309 with the value of the latch 310. If the data of the latch 307 is larger than that of the latch 310, the data of the latch 307 is loaded in the latch 310. The current value of the sub-scan counter 352 is loaded in the latch 311.

The above operation is performed before the next 8-bit data is supplied to the shift register 301. In this manner, when data of the latches 307 and 310 are compared for the entire image zone, the maximum value of the X coordinate remains in the latch 310 and the corresponding Y coordinate remains in the latch 311. These values define the point P2 (X2, Y2).

The F/F 312 is set when the first white 8-bit data is received in each main scan line. The F/F 312 is reset by the horizontal sync signal HSYNC, is set by the first white 8-bit data, and is kept set unitl the next signal HSYNC is received. When the F/F 312 is set, the value of the main scan counter 351 is set in the latch 313. When the data of the latch 313 is smaller than the value in the latch 315 holding the X address of the previous 8-bit data, a signal line 317 is set active and the data of the latch 313 is loaded in the latch 315. This operation is performed during a time interval between each signal HSYNC and the next signal HSYNC.

As described above, since the maximum X address is preset in the latch 315 prior to prescan, when the above comparison operation is performed for the entire image zone, the minimum X coordinate remains in the latch 315. This value is the X3 coordinate. When the signal line 317 is set active, the value from the sub-scan counter 352 is loaded in the latch 318. This value is the Y3 coordinate. In this manner, the point P3 (X3, Y3) is determined.

Every time white 8-bit data appears for the entire image, the corresponding values of the main scan counter and the sub-scan counter are loaded in the latches 319 and 320. Therefore, after prescan of the original is completed, the counts corresponding to the final white 8-bit data are loaded in the latches 319 and 320. These values define the point P4 (X4, Y4).

In this manner, the points P1 (X1, Y1), P2 (X2, Y2), P3 (X3, Y3) and P4 (X4, Y4) are determined.

Outputs from the eight latches 305, 306, 310, 311, 315, 318, 319 and 320 are supplied onto the bus line 349 of the controller 614. When prescan is completed, the CPU 1200 fetches these data on the bus line 349. Among these data, the zone of the coordinates X2, X3, Y1 and Y4 is discriminated as an original zone, and trimming as described above is performed during original scan for printing. Thus, coordinate points P1', P2', P3' and P4' defining a rectangle indicated by the dotted line in FIG. 26 and surrounded by these coordinates X2, X3, Y1 and Y4 are recognized, and the points P1, P2, P3 and P4 are included in the rectangle.

In this manner, the coordinates of the set original are determined. Then, in the copy scan operation, a first black image (actual image zone) in the rectangle defined by the points P1', P2', P3' and P4' is detected by the following method. The image editors 604 and 604' perform trimming for the zone which is included in the rectangle defined by the points P1', P2', P3' and P4' but not in the rectangle defined by the points P1, P2, P3 and P4, and replaces the corresponding data with white bits. Every time main scan in the X direction is performed, image data in the buffer memory in the range of the maximum value X2 and the minimum value X3 in the X direction is read out. When black image bits (logic "1") are detected, they are stored in a latch (this latch is referred to as VTOPF/F).

When the signal VTOPF/F 350 is set in this manner, an interrupt input is supplied to the CPU 1200, and the CPU 1200 sends a signal VTOP 93 to the printer B. In response to the signal VTOP 93, the printer B switches the separation charge eliminating voltage to achieve the prescribed object.

The printer B for switching the separation charge eliminating voltage will be described with reference to the block diagram shown in FIG. 27.

Figure 27:
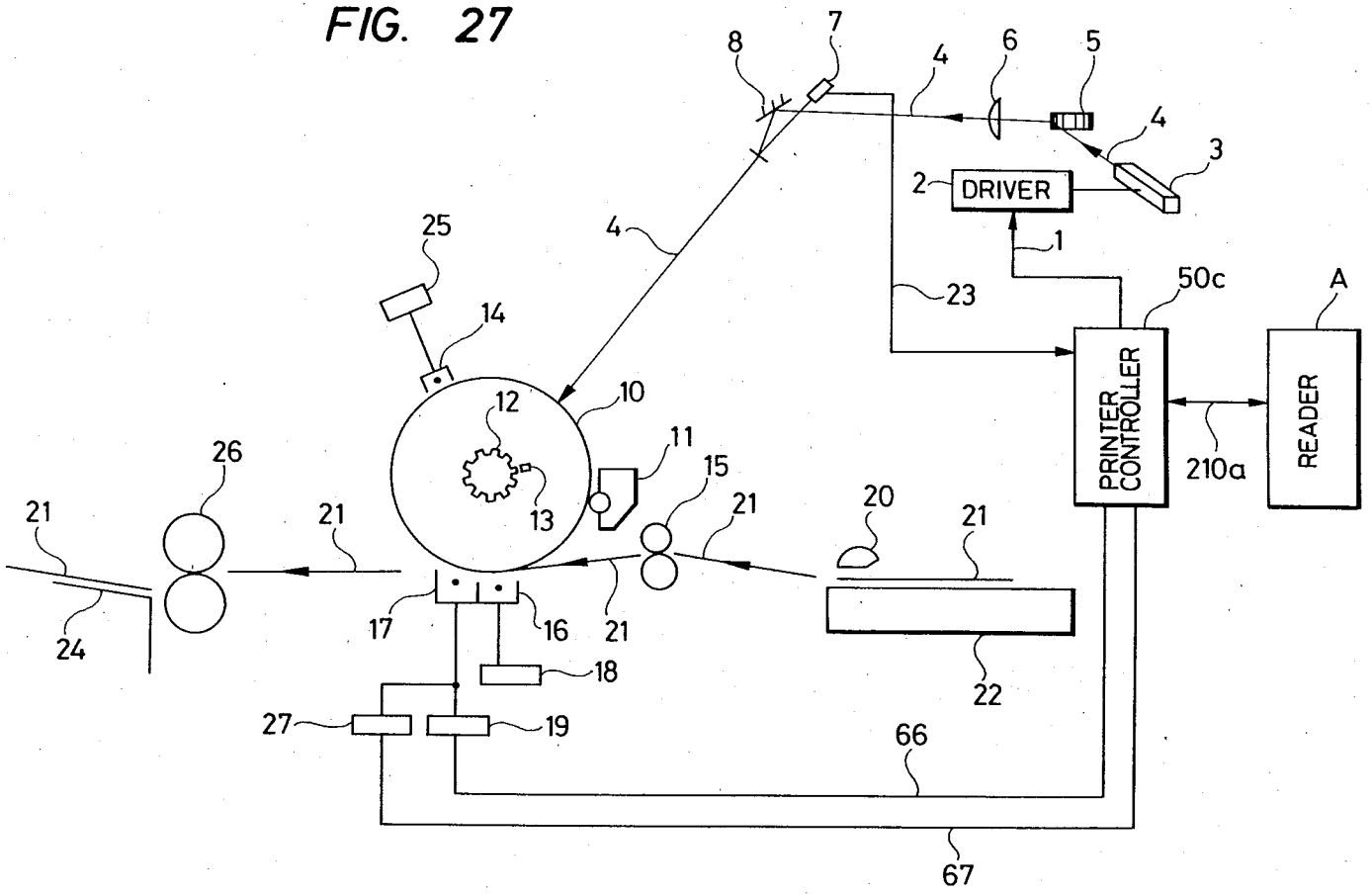
FIG. 27 is a diagram showing the configuration of a printer section in the fourth embodiment of the present invention.

Referring to FIG. 27, the same reference numerals as in FIG. 4 denote the same or similar parts of the same functions, and a detailed description thereof will be omitted.

Referring to FIG. 27, an interface cable 210*a* connects between the printer controller 50*c* and the reader A.

The DC voltage power source 27 receives the separation DC voltage FULL/MIDDLE signal 67 so as to be able to change its output voltage in response thereto.

Application of the DC voltage by the DC voltage power source 27 was described with reference to the first embodiment and a description thereof will not be repeated.

Discrimination of a non-image zone before the first video signal is received will be described below. When the first black image is detected at the reader A, the reader A sends a signal VTOP 93 to the printer B, as described above. This means that the relationship between the time at which the printer B receives the signal VTOP 93 and the time at which the first toner image on the transfer material reaches the separation charge eliminator must be determined.

This time relationship will be described with reference to FIG. 6A. As described above, when the point E is between the points D and F such that the distance between the points C and D is equal to that between the points D and E, when the signal VTOP 93 is sent from the reader A, the initial image formed on the drum 10 coincides, at the point D, with the point E on the transfer material 21. Therefore, the separation charge eliminating voltage is switched after elapse of the time required for the drum to rotate from the point C to the point D since reception of the signal VTOP 93. That is, the output from the DC voltage power source 27 for the separation charge eliminator 17 is set at an intermediate voltage.

Figure 6B:
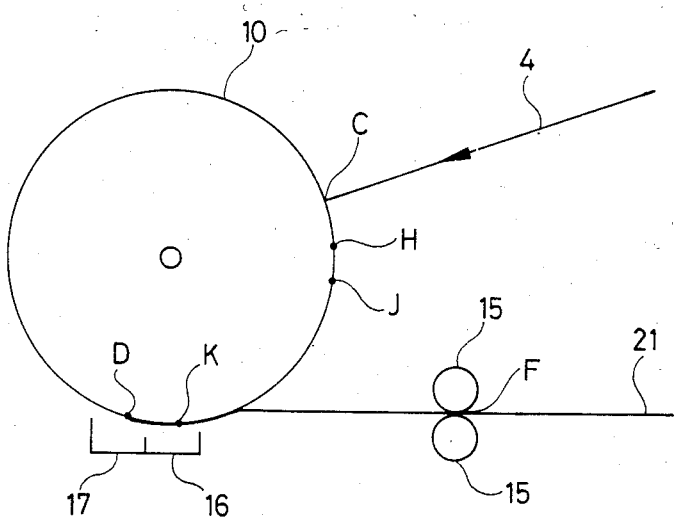

When the registration rollers 15 and the drum 10 hold the positional relationship as shown in FIG. 6B, i.e., when the distance between the points C and D is longer than that between the points D and F, the separation charge eliminating voltage can be switched at the same timing as in the first embodiment (the timing is determined using the signal VTOP 93 in this case).

In this manner, the boundary between image and non-image zones on the transfer material and the switching timing of the separation charge eliminating voltage of the separation charge eliminator are synchronized. When these synchronized timing is illustrated in FIG. 1, it is at the point A' in FIG. 1A and at the point B' in FIG. 1B.

Figures 2, 29A:
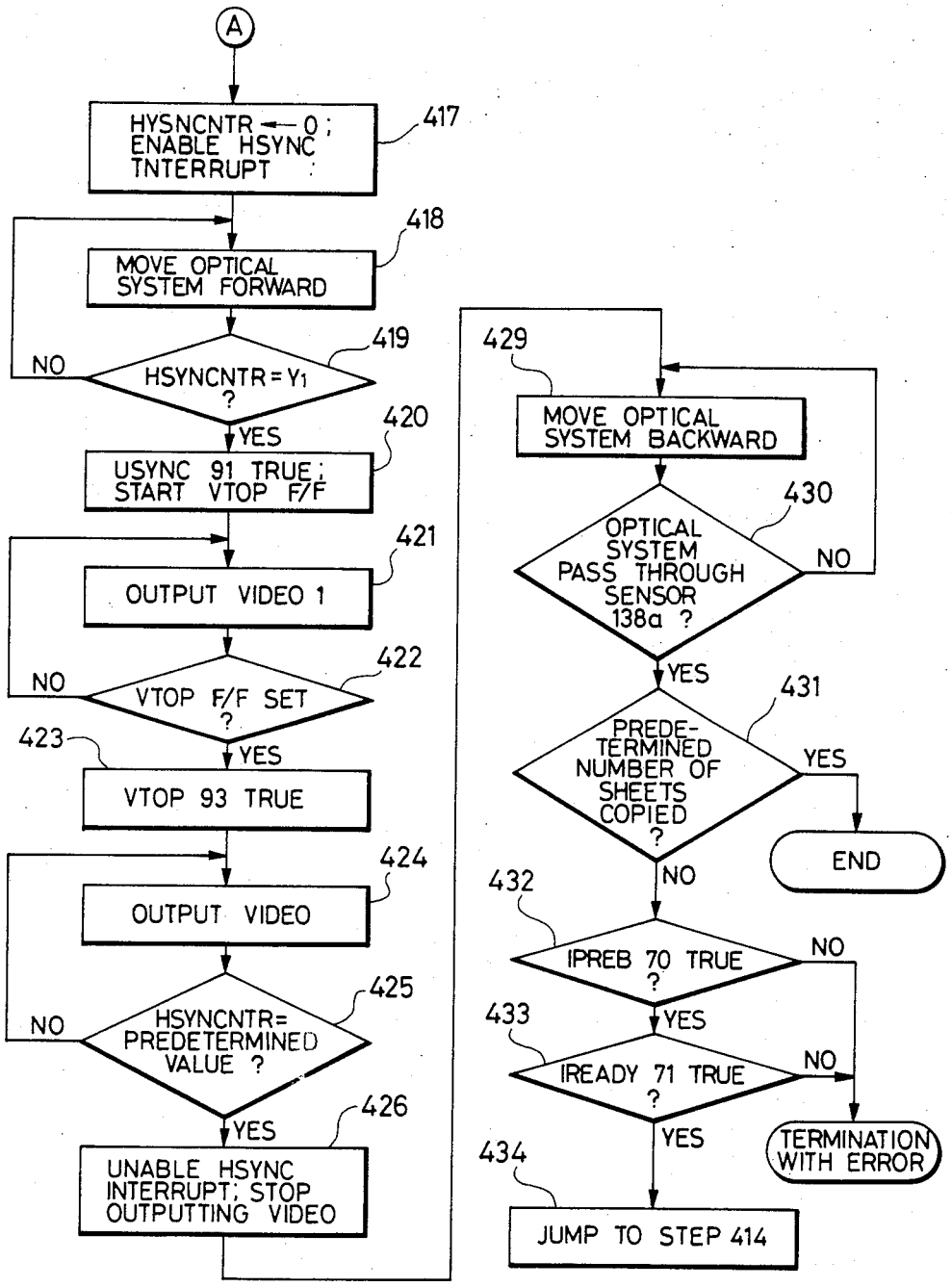
Figure 29B:
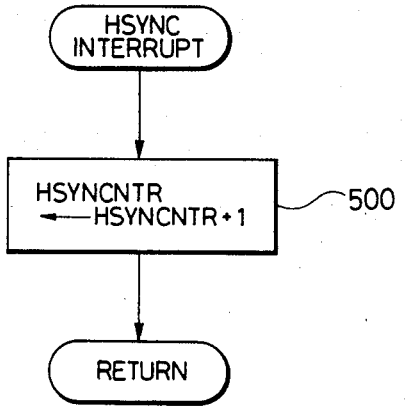

The control flow of the copying machine in the fourth embodiment will be described. As described above, the copying machine of this embodiment consists of the reader A and the printer B. The controllers of the respective units operate independently of each other. In order to facilitate easy understanding, a copy operation of a single original will be described with reference two independent control flows. FIG. 29 shows the control flow of the CPU 1200 of the reader A, and FIG. 30 shows the control flow of the CPU 51*c* of the printer B.

Figure 28:
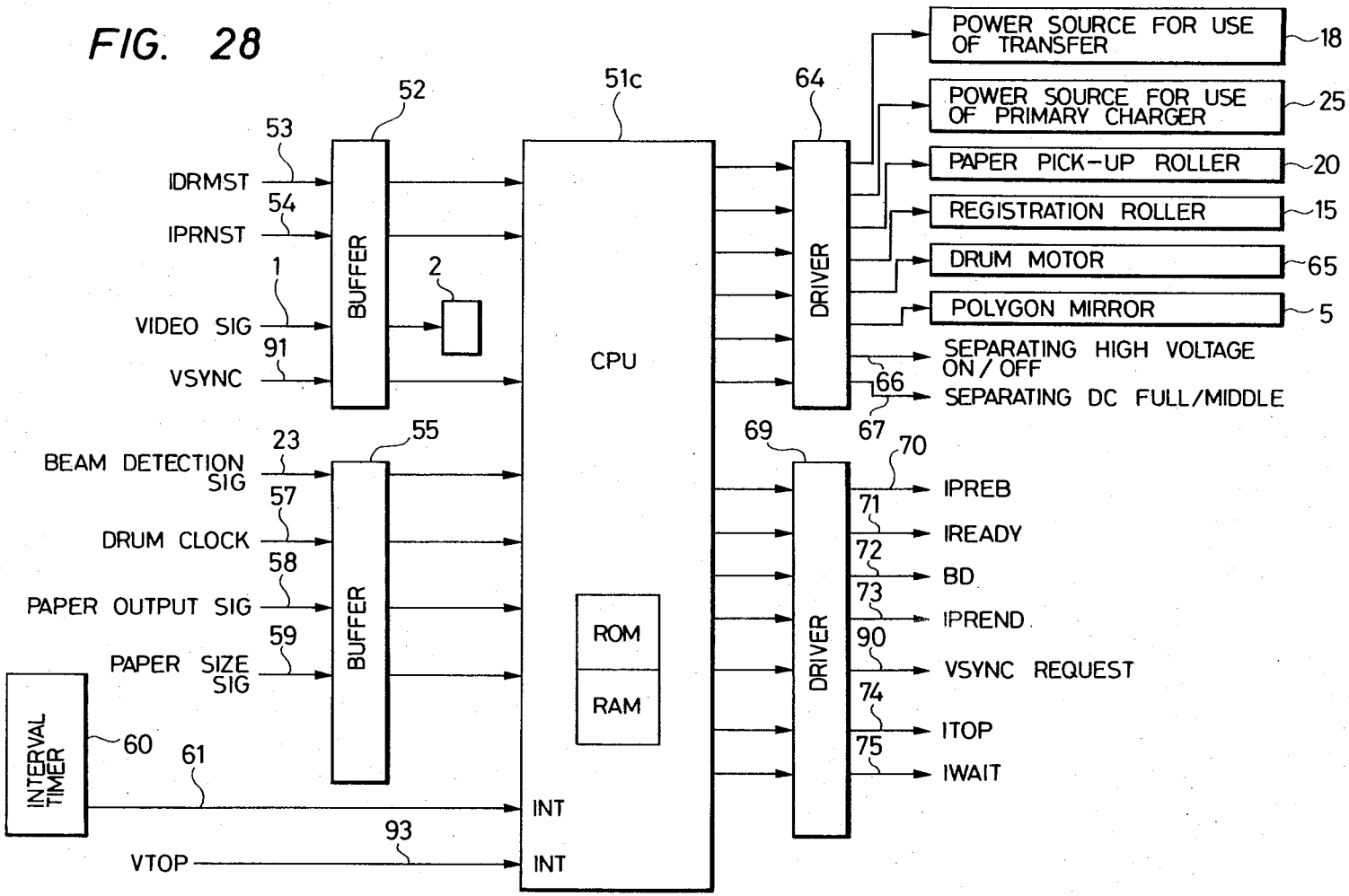
FIG. 28 is a block diagram of the main part of a controller 50C of the printer B.

FIG. 28 shows a controller of the printer B. The same reference numerals as in FIG. 7 denote the same parts or similar parts of the same functions in FIG. 28, and a detailed description thereof will be omitted.

When power of the copying machine is turned on, the program of the CPU 51*c* starts in the printer B, and initialization is performed. In step 101, it is checked if the printer B can operate. If NO, the signal IREADY 71 is set false to signal this situation to the reader A (step 102). However, when YES in step 101, the signal IREADY 71 is set true and sent to the reader A in step 103 and the signal IDRMST 53 from the reader A is awaited (step 104).

The reader A waits until the signal IREADY 71 from the printer B is set true (step 401) and waits until the operator depresses the print switch (step 402).

When the print switch is depressed (step 402), the reader A supplies a signal IDRMST 53 to the printer B (step 403), and moves the optical system forward (step 404) to start prescan.

In response to the signal IDRMST 53, the CPU 51*c* of the printer B receives this signal (step 104), turns on the drum motor 65, and turns on high-voltage power sources for the primary charger 14, the transfer charger 16 and the like excluding the separation charge eliminator 17 so as to set the surface potential of the drum at a recordable potential (step 105).

When recording can thus be performed, the CPU 51*c* sets a signal IPREB 70 to true which is sent to the reader A through the driver 69 (steps 106 & 107). At the same time, a signal IPRNST 54 from the reader A is awaited (step 108).

In the reader A which has started prescan, the optical system is moved forward until it passes by the sensor 138*b* (steps 404 & 405). The copying zone starts from the sensor 138*b*. When the optical system passes by the sensor 138*b*, the recognizer 606 is operated while the optical system is moved forward (step 406). The recognizer 606 detects continuous white 8-bits from the image signal sent from the optical system as described with reference to FIG. 25. When detected, the corresponding portion is determined as an edge of the original. When the optical system passes by the sensor 138*c* (step 407), the prescan of the original is completed. Therefore, the CPU 1200 fetches the original setting coordinates in a ROM/RAM 201 (step 408).

The optical system is then withdrawn to the position of the sensor 138*a* (steps 409 & 410). When the optical system passes by the sensor 138*a*, the optical system is stopped (step 411).

During the prescan, the photosensitive drum and the chargers of the printer B are in the operative state. This state of the printer B can be discriminated by checking if the signal IPREB 70 is true (step 412). If YES in step 412, the flow advances to step 413. However, if NO in step 412, the printer has failed and failure processing is performed. Since failure processing is not directly related to the present invention, a description thereof will be omitted.

In step 413, the reader A supplies a signal IPRNST 54 (paper feed command) to the printer B. At the same time, after a predetermined period of time elapses (step 414), forward movement of the optical system for copy scan is started (step 415). This predetermined period of time will be described below.

In response t.o the signal IPRNST 54, the printer B drives the paper pick-up roller 20 through the driver 69 and sets the signal IPREB 70 false to enter the print sequence (steps 108 & 109).

Thereafter, the drum clock 57 as an output from the sensor 13 mounted on the photosensitive drum 10 is supplied to the CPU 51*c* through the buffer 55. Therefore, the CPU 51*c* performs sequence control while checking the position of the transfer material in accordance with the transfer material.

The transfer material picked up by the pick-up roller 20 reaches the position of the registration rollers 15 (step 110). The transfer material 21 is registered with the registration rollers 15. The positional relationship between the registration rollers 15 and the photosensitive drum 10 is as described above. A case wherein the distance between the points C and D is shorter than that between the points D and F will be described. When the drum 10 rotates for a predetermined angle (step 110), the registration rollers 15 are driven to stop the roller 20 (step 111). As described above, when the leading edge of the transfer material reaches the point E, it can be detected by counting the drum clocks 57 (step 112). The CPU 51*c* produces a signal VSYNCREQUEST 90 for the drum clock through the driver 69 and awaits reception of a signal VSYNC 91 from the reader A. At this time, the registration rollers 15 are turned off.

In accordance with a simple method for setting a timing for starting scanning of the optical system of the reader A, the signal VSYNCREQUEST 90 is received in step 414 to start scanning operation of the optical system. However, in this method, the wait time is long, and the efficiency is low. In step 413, after a predetermined period of time elapses since sending of the signal IPRNST 54, the scanning operation of the optical system is started. Meanwhile, at the side of the printer B, convey operation of the transfer material is started immediately after the signal IPRNST 54 is received, and the minimum predetermined period of time as described above is set in step 414 such that the optical system does not reach the coordinate Y1 even when the transfer material 21 reaches the point E. With this method, the efficiency is improved.

When the optical system starts forward movement, it reaches the sensor 138*b* (steps 415 & 416). In step 417, the counter HSYNCCNTR for counting the number of the signals HSYNC 356 is set 0 in the ROM/RAM 201, and an interrupt by the signal HSYNC 356 is enabled to start counting the signals HSYNC 356.

The signal HSYNC 356 after step 417 is synchronized with a signal BD 72 which is, in turn, synchronized with laser scanning of the printer B.

Every time an interrupt is generated by the signal HSYNC 356, the CPU 1200 counts up the signal HSYNCNTR (step 501). Meanwhile, the optical system reaches the position of the Y1 coordinate. Then, the signal HSYNCNTR coincides with the Y1 coordinate (step 419). This means that the optical system has reached the leading edge of the original (step 420). Then, a signal VSYNC 91 is supplied to the printer B, and detection of the black information (logic level "1") in the image data in the image editors 604 and 604' is started. In step 421, sending of the video signal 1 is also started. However, the video signal 1 contains only bits of logic level "0" until the signal VTOPF/F is set.

At the side of the printer B, in step 113, the signal VSYNCREQUEST 90 is set true, and the separating high voltage ON/OFF signal 66 and the separation DC voltage signal 67 are set true to apply an optimal voltage to the separation charge eliminator 17. When the signal VSYNC 91 is received from the reader A (step 114), the registration rollers 15 are driven to resume convey operation of the transfer material 21 (step 115). At this time, the convey operation of the transfer material 21, rotation of the drum 10, and the scan operation of the optical system of the reader A are completely synchronized.

The video signal 1 sent from the image editors 604 and 604' to the combination unit 605 is checked for black information and is supplied to the printer B. When black information is detected, the signal VTOPF/F is set (step 422). The output of the signal VTOPF/F is supplied as a signal VTOP 93 to the printer B (step 423).

Figure 30B:
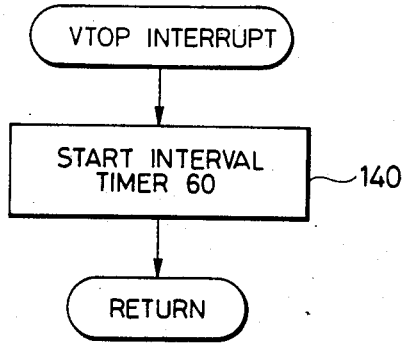
Figure 30C:
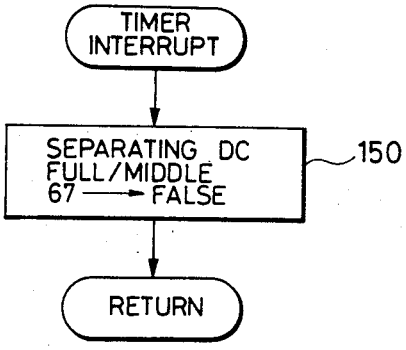

In response to the signal VTOP 93, at the side of the printer B, since the signal VTOP 93 is an interrupt input to the CPU 51*c*, the interrupt routine shown in FIG. 30B is started. The predetermined time period is set in the interval timer 60 (step 140) and the flow returns to the main control flow. The predetermined time period is a time period required for the drum to rotate from the point C to the point D. When the flow returns to the main control flow shown in FIG. 30A, a timer interrupt is awaited while the copy processing is performed. During this process, an electrostatic latent image is formed on the drum 10.

When a timer interrupt is generated, the first image zone reaches the point D. When a timer interrupt is generated, the flow enters the timer interrupt routine shown in FIG. 30C. Then, in order to decrease the output voltage from the DC voltage power source 27, the separation high voltage FULL/MIDDLE signal 67 is set false (MIDDLE) (step 150). With this control operation, the application DC voltage is high for the non-image zone at the leading edge but is low for an image zone, thus achieving the prescribed object.

The scan range of the reader A is different in accordance with the paper size of the original, and the magnification of enlargement/reduction. However, the paper size can be discriminated by the original coordinates, and the magnification is predetermined. Therefore, the scan end timing of the original can be determined when the signal HSYNCNTR reaches a predetermined value (step 425). At the side of the printer B, processing of the image data of one page determined by a paper size signal 59 can be determined by a predetermined count of the drum clocks 57 (step 116).

When processing of image data of one page is completed, the reader A stops sending the video signal 1 in step 426 and disables the interrupt by the signal HSYNC 356 (step 426), and allows the optical system to return (step 429). When the optical system reaches the sensor 138*a* (step 430), it is checked if a predetermined number of copies have been produced (step 431). If YES in step 431, the flow ends. However, if NO in step 431, it is checked in steps 432 and 433 if the printer B produces the signals IPREB 70 and IREADY 71. If YES in steps 432 and 433, the flow jumps to step 414 and the above-described processing is repeated. However, if NO in steps 432 and 433, it is determined that the printer B has failed and failure processing is performed.

At the printer B, the signal IPREND 73 representing an end of the image zone is set true for the one drum clock period through the driver 69 so as to signal to the reader A an end of one print zone. The separating high voltage ON/OFF signal 66 is turned off to turn off the power source of the separation charge eliminator (step 117). Thus, the transfer material is output through the fixing unit 26. When a continuous copy operation is performed, processing from step 106 is repeated.

When printing is completed and both the signals IDRMST 53 and IPRNST 54 are set false, the print paper is output, and the drum motor 65, the pick-up roller 20 and the registration rollers 15 are stopped.

In the above embodiment, the printer B comprises a laser beam printer. However, the present invention is similarly applicable to recording apparatuses using an LED array or an OFT as a light source.

In the above embodiment, the AC voltage applied to the separation charge eliminator is kept constant, and the DC superposition voltage is switched. However, the DC superposition voltage can be kept constant, and the AC voltage can be switched.

A fifth embodiment of the present invention will be described below.

The copying machine of the fifth embodiment basically consists of two units: a reader A and a printer B. The schematic configuration of the overall system will first be described, the construction and operation of the reader A will then be described, and the construction and operation of the printer B will be described. Finally, the operation involving both the units will be described in accordance with flow charts.

Figure 31:
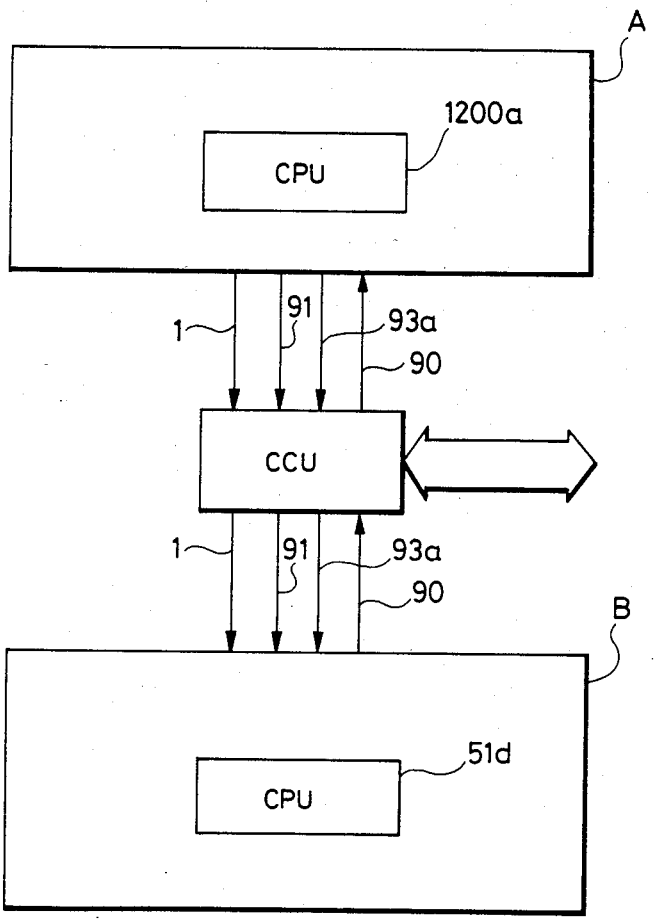
FIG. 31 is a diagram for explaining main interface signals exchanged between a reader A and a printer B in a fifth embodiment of the present invention.

Thus, the operation of the overall system will be described. FIG. 31 is a view showing an interface between the reader A and the reader B. The reader A has a CPU 1200*a* and the printer B has a CPU 51*d*. The CPUs 1200*a* and 51*d* operate independently of each other. It is to be noted that not all the interface signals are illustrated in FIG. 31 and only those closely associated with the operation of the system are illustrated.

A signal VIDEO 1 is sent from the reader A to the printer B and carries image data. A signal VSYNCREQUEST 90 is supplied from the printer B to the reader A to signal that the transfer material has been conveyed to a position for printing in the printer B.

A signal VSYNC 91 represents that the optical system of the reader A has reached the leading edge of the original. A signal 93*a* is a separating high voltage level (BRATE) obtained by binary encoding the image area ratio at a suitable resolution. In this embodiment, the signal BRATE has 4 bits (16 steps).

A CCU allows the reader A or the printer B to be connected to another reader or printer. However, since the CCU does not convert signals, it will not be described in the following description.

The reader A will first be described.

In this embodiment, the description of the reader A can be made with reference to FIGS. 21 and 22. Therefore, only those portions different from the fourth embodiment will be described with reference to FIGS. 21 and 22.

The function of a recognizer 606 of the fifth embodiment is slightly different from that of the fourth embodiment. During warming up of the printer after depression of the copy button, the recognizer 606 performs a prescan of an original. The recognizer 606 includes a circuit for detecting the coordinates of the original, and a circuit for calculating an area of a black portion of the original. The circuits include a shift register for detecting white 8-bit image data, an I/O port, main and sub-scan counters, and a counter for counting the number of pixels of the black portion of the image.

Figure 32:
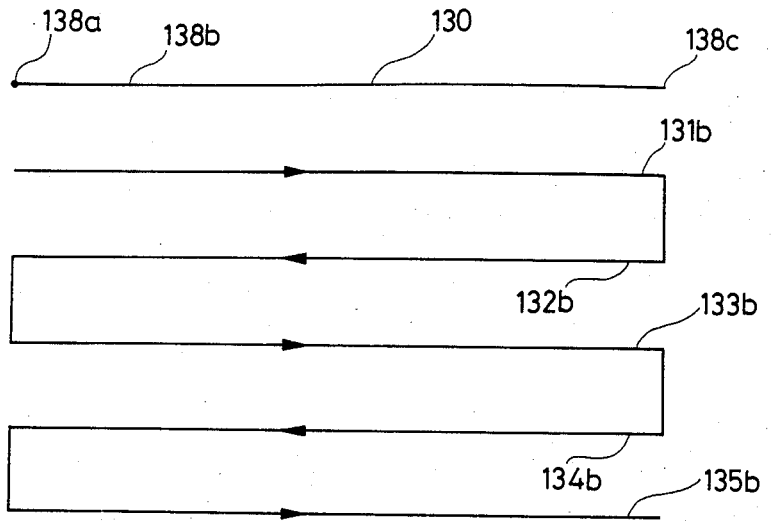
FIG. 32 is a diagram for explaining the scan method of the optical system of the reader.

The movement of the optical system will be described with reference to FIG. 32. Referring to FIG. 32, the optical system moves within a range 130, and sensors 138*a*, 138*b* and 138*c* are arranged at three locations of the range. The point 138*a* corresponds to the stationary position of the optical system, and the range between the points 138*b* and 138*c* is a copy zone. The optical system can scan the range between the points 138*b* and 138*c*.

At points 131*b*, 132*b*, 133*b* and 134*b*, the optical system is moved in the direction indicated by arrows. In the range between the points 131*b* and 132*b*, the setting position of the original is detected (prescan 1). In the range between the points 133*b* and 134*b*, the number of black pixels in the range of the set original detected in prescan 1 is counted (prescan 2). The ratio of the number of black pixels to the area of the overall image (area ratio) is calculated. The signal BRATE 93*a* as described above corresponding to the calculated area ratio is supplied to the printer B. In response to the signal BRATE 93*a*, the printer B controls the DC bias voltage to be applied to the separation charge eliminator. Scanning after the point 135*b* is for copying.

Figure 33:
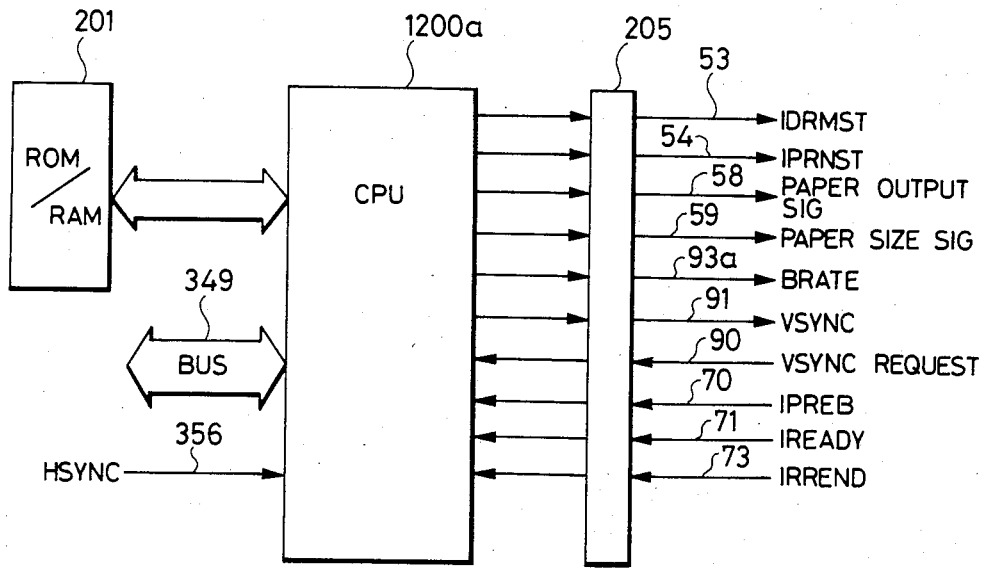
FIG. 33 is a diagram showing the configuration of the CPU sect of a controller 614 of the reader A.

The configuration of a controller 614 of the reader A will be described with reference to FIG. 33. The central processing unit (CPU) 1200*a* controls the reader A in accordance with a program stored in a ROM/RAM 201. A receiver/driver 205 exchanges an interface signal with the printer B. A signal HSYNC 356 is supplied to the CPU 1200*a* as an interrupt input. A system bus 349 is connected to the CPU 1200*a*.

A method of calculating an area ratio of an image will be described with reference to the drawings. The image area ratio is determined by detecting the set coordinates of the original in prescan 1, calculating the original area, counting the number of black pixels in prescan 2, and determining the ratio of the number of black pixels to the total image area.

In the fifth embodiment, the recognizer 606 has a circuit for detecting the original coordinates as shown in FIG. 25. In order to prevent a repeated description, the description of FIGS. 25 and 26 will be omitted.

An original area AREA can be calculated by:

$$\text{AREA} = \sqrt{[(X1 - X3)^2 + (Y1 - Y3)^2] \times [(X2 - X1)^2 + (Y2 - Y1)^2]}$$

In general, an original is set substantially parallel to the X and Y directions. Therefore, the original area calculated by the above equation can be assumed to equal to the area of the rectangle defined by points P1', P2', P3' and P4' surrounded by the dotted line in FIG. 26. Therefore, the original area can be approximated by:

$$AREA \approx |X2-X3| \times |Y4-Y1|$$

A method of calculating the ratio of the black area to the total image area will be described below. In this case, the optical system performs prescan as in the case of determining the original coordinates.

The area of the black portion can be considered to correspond to the number of pixels which are true in the image data. Therefore, the number of true image data can be detected when the optical system scans the rectangle defined by the points P1', P2', P3' and P4' in FIG. 26.

Figure 34:
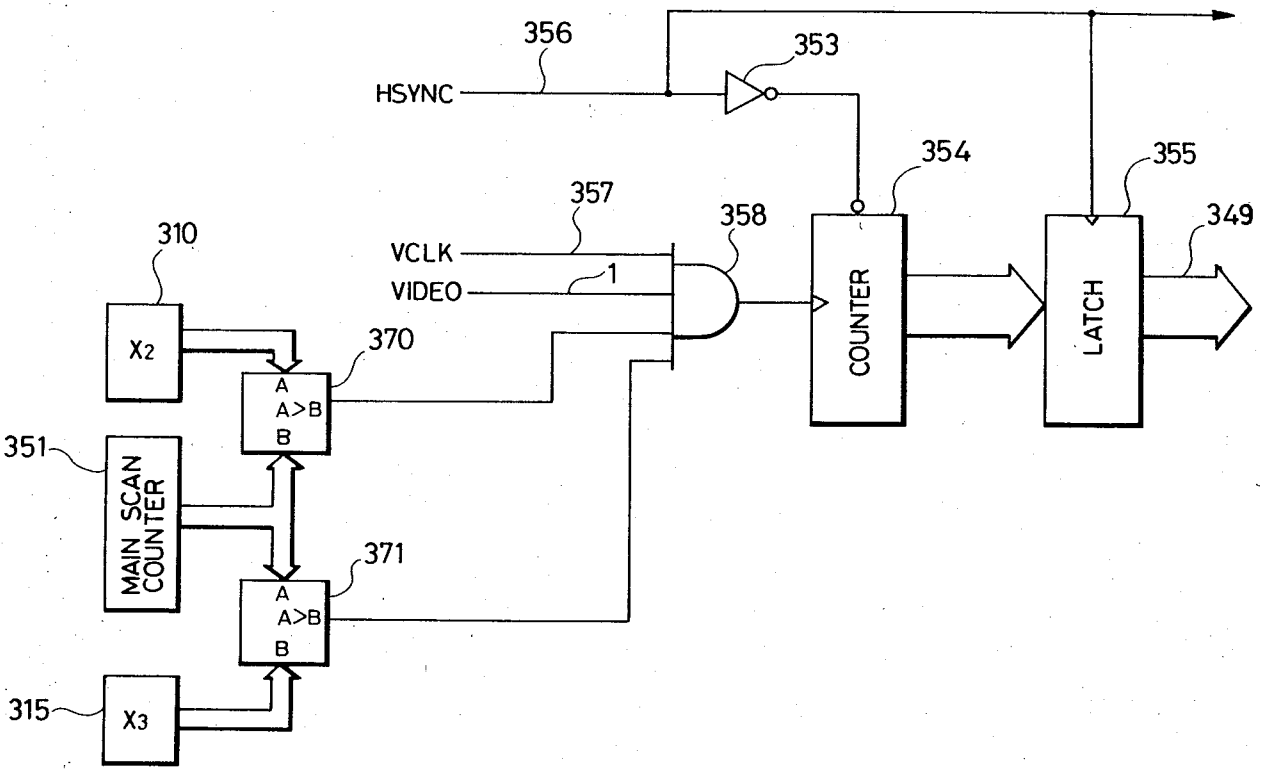
FIG. 34 is a block diagram of a circuit for counting the number of pixels in an image zone of an original.

FIG. 34 shows a circuit in the recognizer 606 for calculating the number of pixels of the black portion in the image. A counter 354 counts the number of pixels of the black portion of the original. A latch 355 temporarily stores the count-up value in the counter 354. An output from the latch 355 is supplied to the CPU 1200*a* through the bus 349.

When the optical system starts prescan 2, the coordinates of the points P1', P2', P3' and P4' detected in prescan 1 in FIG. 26 are set as the read range of the image signal. The image signals in this range are generated as a signal VIDEO 1 which is supplied to an AND gate 358 in FIG. 34.

As described above, image editors 604 and 604' perform trimming of a zone which is included in the rectangle defined by the points P1', P2', P3' and P4' but not in the rectangle defined by the points P1, P2, P3 and P4, so that this zone is replaced with white bits.

The maximum and minimum X coordinates are set in latches 310 and 315. Comparators 370 and 371 produce true outputs when the count of a main scan counter 351 is smaller than X2 but is larger than X3. Outputs from the comparators 370 and 371 are supplied to the AND gate 358.

The VIDEO 1 is logically ANDed with a clock VCLK 357 from a control signal generator 603. A clock is supplied to a counter 354 when there is a black pixel portion in the effective zone, i.e., in the rectangle defined by the points P1', P2', P3' and P4'. The counter 354 is counted up in response to the clock.

When one line scan along the X direction is completed, the count of the counter 354 is stored in a latch 355 at the leading edge of the horizontal sync signal HSYNC 356. The counter 354 is cleared at the trailing edge of the signal HSYNC 356. Scanning of the next line along the X direction is then started.

Since the signal HSYNC 356 is connected to the interrupt input of the CPU 1200*a*, the CPU 1200*a* upon reception of the interrupt fetches the content of the latch 355 before the latch 355 is updated by the next signal HSYNC 356. This scan operation is repeated from the Y1 coordinate to the Y4 coordinate along the Y direction (sub-scan direction). Every time the scan operation is performed, the count of the latch 355 is accumulated to calculate the number of black pixels. When this number of black pixels is represented as DBLACK, the area ratio of the black portion to the total area is (DBLACK)/(AREA).

Figure 2:
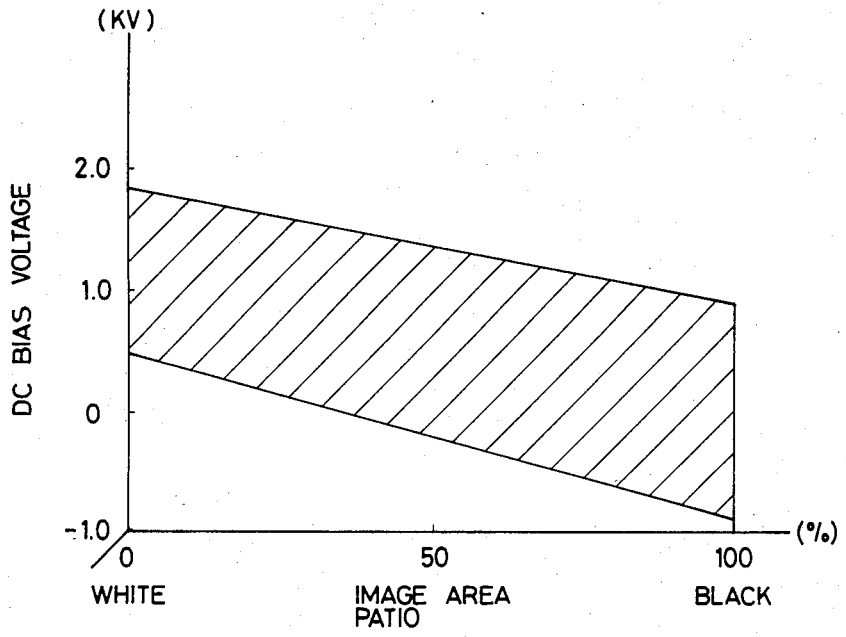
FIG. 2 is a graph showing the optimal DC voltage for separation as a function of the image area ratio.

The calculated area ratio can be processed to provide a desired resolution (4 bits in this embodiment) and can be supplied to the printer B as a signal BRATE 93*a*. In response to the signal BRATE 93*a*, the printer B sets the output from the DC power source of the separation charge eliminator in accordance with the relationship of the DC voltage and the image area ratio as shown in FIG. 2. Then, for an original of any image area ratio, separation is easy and re-transfer will not be caused.

The control flow of the reader A in accordance with a control program stored in the ROM/RAM 201 will be described with reference to FIG. 35.

When power of the copying machine is turned on, the signal IREADY 71 is set true. When the printer B is set operative (step 401), the operator depresses the print switch (step 402). When the print switch is depressed, a signal IDRMST 53 (signal for starting the drum motor) is supplied to the printer B (step 403).

Steps 404 to 411 constitute prescan 1. In step 404, the optical system is moved forward. When the optical system passes the sensor 138*b*, it can be determined that the optical system has reached the copy zone. Therefore, the optical system is moved forward until it passes by the sensor 138*b* (steps 404 & 405).

When the optical system passes by the sensor 138*b*, the recognizer 606 is operated while the optical system is moved forward further (step 406). As described with reference to FIG. 25, the recognizer 606 detects continuous white 8-bit data from the image signal sent from the optical system and determines such continuous white 8-bit data as the leading edge of the original.

When the optical system passes by the sensor 138*c* (step 407), the overall image has been scanned. Therefore, the CPU 1200*a* fetches the original coordinates in the ROM/RAM 201 (step 408). In order to calculate the area of a black image, the fetched coordinates are reset in the latches 310 and 315.

The optical system is then returned to the position of the sensor 138*a* (steps 409 & 410). When the optical system passes by the sensor 138*a*, it is stopped (step 411).

During this prescan period, the photosensitive drum and the chargers of the printer are initialized and are ready for operation. This state of the printer B can be determined by checking if the signal IPREB 70 is true (step 412). If YES in step 412, the flow advances to step 413. However, if NO, the printer B has failed, and failure processing is performed. Since failure processing is not directly associated with the present invention, a description thereof will be omitted.

Steps 413 to 422 correspond to prescan 2.

In step 413, forward movement of the optical system is resumed. When the optical system passes by the sensor 138*b* (step 414), an interrupt of the CPU 1200*a* by the signal HSYNC 356 is enabled, and the recognizer 606 is rendered operative (step 415). At this time, part of the circuit of the recognizer 606 shown in FIG. 34 operates. Since the X coordinates are set in the latches 310 and 315 shown in FIG. 34 in step 408, the counter 354 counts up the number of the signals VIDEO 1 detected between the X2 and X3 coordinates, in accordance with the main scan counter count.

Figures 2, 35A:
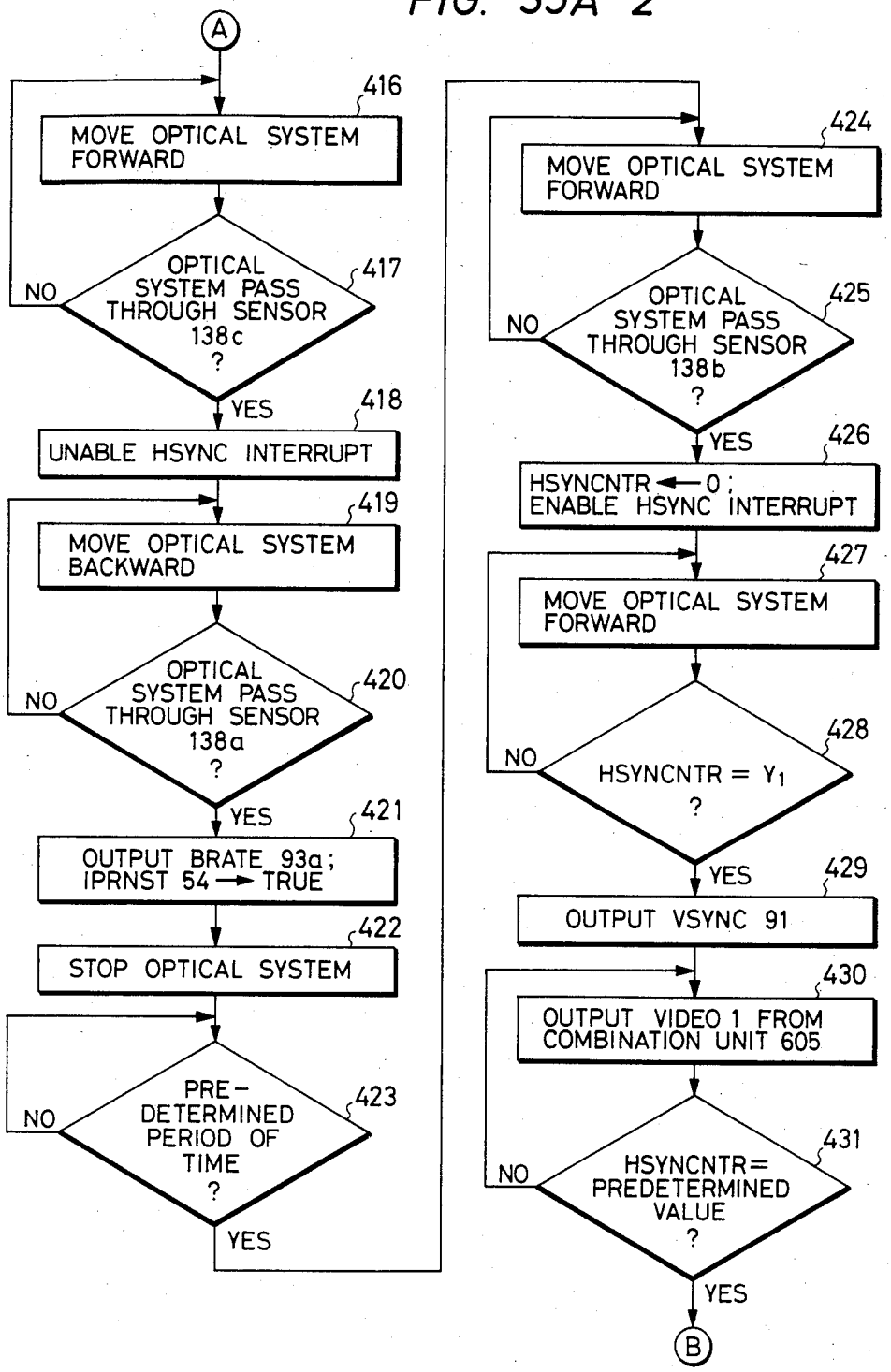
Figures 3, 35A:
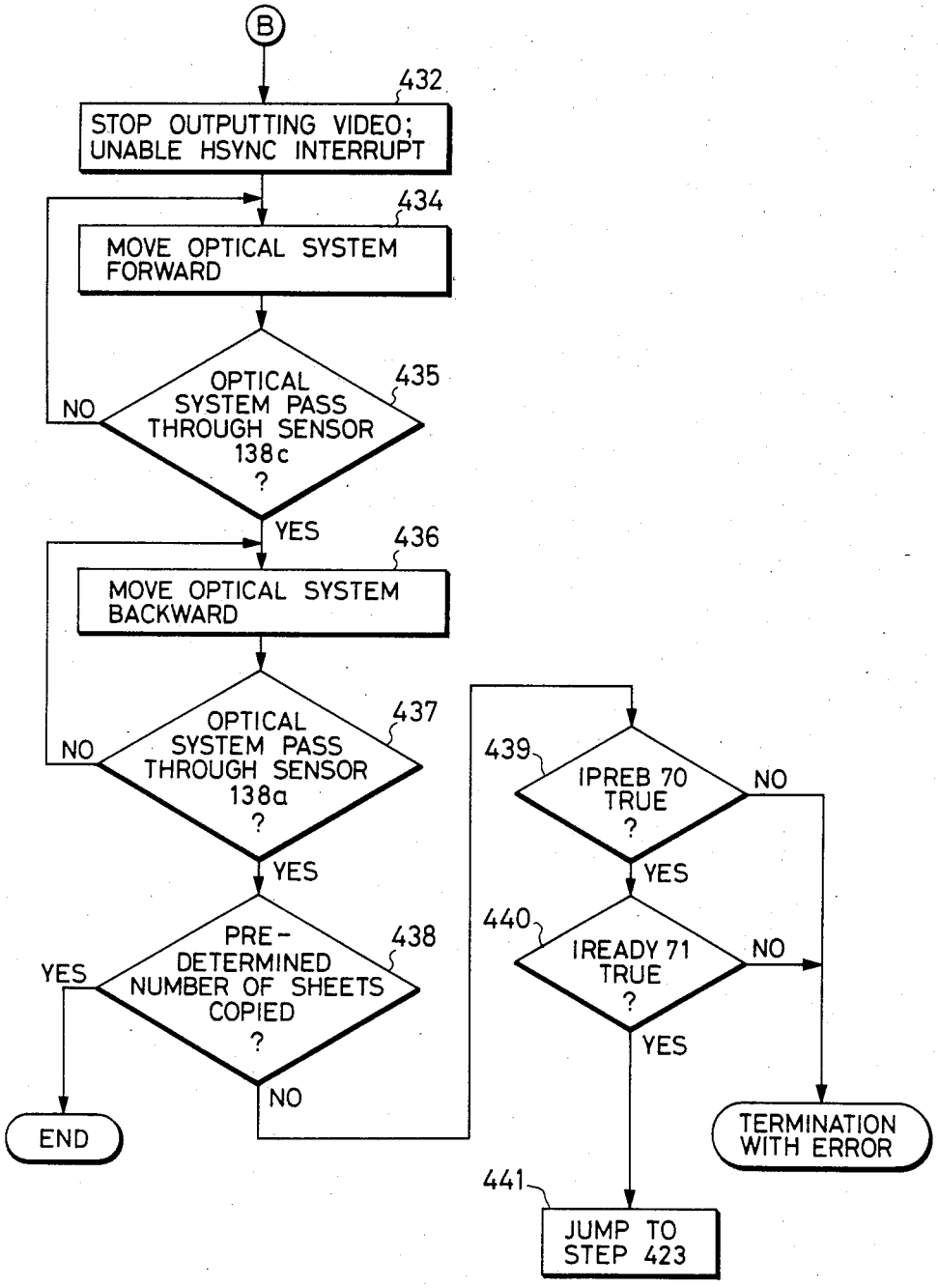
Figure 35B:
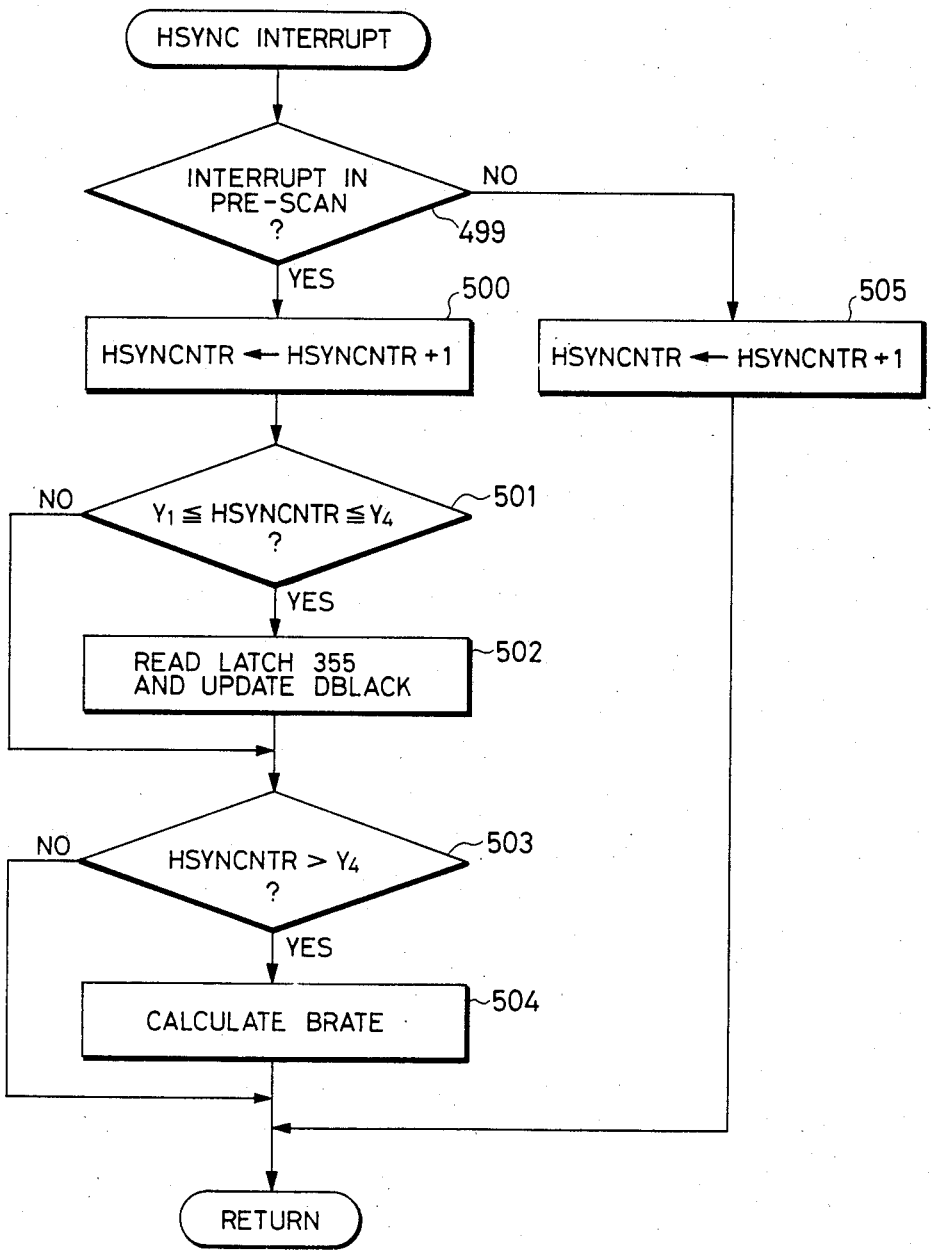

Since the signal HSYNC is generated every time the optical system moves in the Y direction, the flow enters the interrupt flow of the signal HSYNC 356 shown in FIG. 35B in response to the signal HSYNC.

In step 499 in FIG. 35B, it is checked if the interrupt is an interrupt for prescan. The number of interrupt routines performed is stored, and the counter HSYNCNTR in the ROM/RAM 201 is counted up by 1 (step 500).

Thus, the content of the counter HSYNCNTR coincides with the Y coordinate currently scanned by the optical system. When the count of the counter HSYNCNTR is not between the minimum and maximum Y coordinates, Y1 and Y4, detected in the previous prescan, even if black data is detected, it is noise and must be ignored. Therefore, only when the count of the counter HSYNCNTR is between the Y1 and Y4 coordinates (step 501), the CPU 1200*a* fetches the content of the latch 355 through the bus 349 and updates a signal DBLACK (number of black pixels) (step 502). In step 503, it is checked if the signal HSYNCNTR is larger than Y4. Since NO in this case, the flow returns to the main control flow.

The optical system passes the original portion. Then, the count of the counter HSYNCNTR is larger than Y4. Thus, the flow does not advance to step 502. Instead, the signal BRATE 93*a* is calculated in steps 503 and 504 and is stored in the ROM/RAM 201.

The optical system keeps moving forward until it passes by the sensor 138*c*. When the optical system reaches the sensor 138*c* (steps 416 & 417), an interrupt by the signal HSYNC 356 is enabled (step 418) and the optical system is returned (step 419). Return movement of the optical system is performed until the optical system passes by the sensor 138*a* (steps 419 & 420).

When the optical system passes by the sensor 138*a*, the 4-bit signal BRATE 93*a* calculated in step 504 is supplied to the printer B together with the signal IPRNST 54 (paper feed signal) (step 421). The optical system is then stopped (step 422).

The subsequent flow is for copy scan. In response to the signal IPRNST 54, the printer controller starts driving the pick-up roller and the transfer material is conveyed toward the registration rollers.

In the control flow of the reader A, forward movement of the optical system is resumed after a predetermined time period since the optical system is stopped. The reasons for delaying forward movement of the optical system for the predetermined time period will be described with reference to the control flow of the printer B.

In the printer B, when the transfer material is conveyed to a predetermined position by the registration rollers, the signal VSYNCREQUEST 90 is supplied to the CPU 1200*a* of the reader A, and the registration rollers are temporarily stopped. At this time, the printer A can receive the signal VIDEO 1 any time to start image printing. At the same time, in this condition, the power source for the separation charge eliminator stably supplies an optimal separation charge eliminating voltage in accordance with the signal BRATE 93*a* supplied in step 421.

In response to the signal VSYNCREQUEST 90, the CPU 1200*a* knows that the printer B can receive the signal VIDEO 1 and moves the optical system forward until it passes by the sensor 138*b* (step 425). When the optical system passes by the sensor 138*b* (step 425), an interrupt by the signal HSYNC 356 is enabled, and the counter HSYNCNTR in the ROM/RAM 201 for counting the signal HSYNC 356 is cleared to 0 (step 426).

When an interrupt by the signal HSYNC 356 is generated, the flow advances to step 499 in FIG. 35B. It is checked if the signal HSYNC 356 is one generated during prescan. If NO, the counter HSYNCNTR is counted up by one in step 505 and the flow returns to the main control flow. When the optical system is moved forward while counting the signals HSYNC 356 in this manner, the count of the counter HSYNCNTR reaches Y1 (steps 427 & 428).

When HSYNCNTR=Y1, it means that the optical system has reached the leading edge of the original. Therefore, the signal VSYNC 91 (vertical sync signal) for signalling sending of the signal VIDEO 1 is supplied to the printer B (step 429). Sending of the signal VIDEO 1 from the combination unit 605 is immediately started (step 430). In response to the signal VSYNC 91, the registration rollers are driven again and data write on the drum by the laser beam is staretd. The transfer material reaches the photosensitive drum, and transfer of the toner image is performed.

The scanning range of the original image is determined in accordance with the original size or enlargement/reduction magnification. However, the paper size can be determined by the original coordinates, and the selected magnification is also known. Therefore, when the counter HSYNCNTR reaches a predetermined value (step 431), sending of the signal VIDEO 1 is stopped, and an interrupt by the signal HSYNC 356 is disabled (step 432). The optical system is moved forward to the sensor 138*c*. When the optical system passes by the sensor 138*c*, it is returned (steps 434, 435, & 436).

After starting return movement, the optical system reaches the sensor 138*a*. When the optical system reaches the sensor 138*a* (step 437), it is checked if a predetermined number of copies have been produced (step 438). If YES, the flow ends. However, if NO, it is checked in steps 439 and 440 if the printer B is sending the signals IPREB 70 and IREADY 71. If YES, the flow jumps to step 423 and the above processing is repeated. If NO, it is determined that the printer B has failed and a failure end occurs.

The reader of the copying machine has been described. The printer operating integrally with the reader will next be described.

Figures 36, 38:
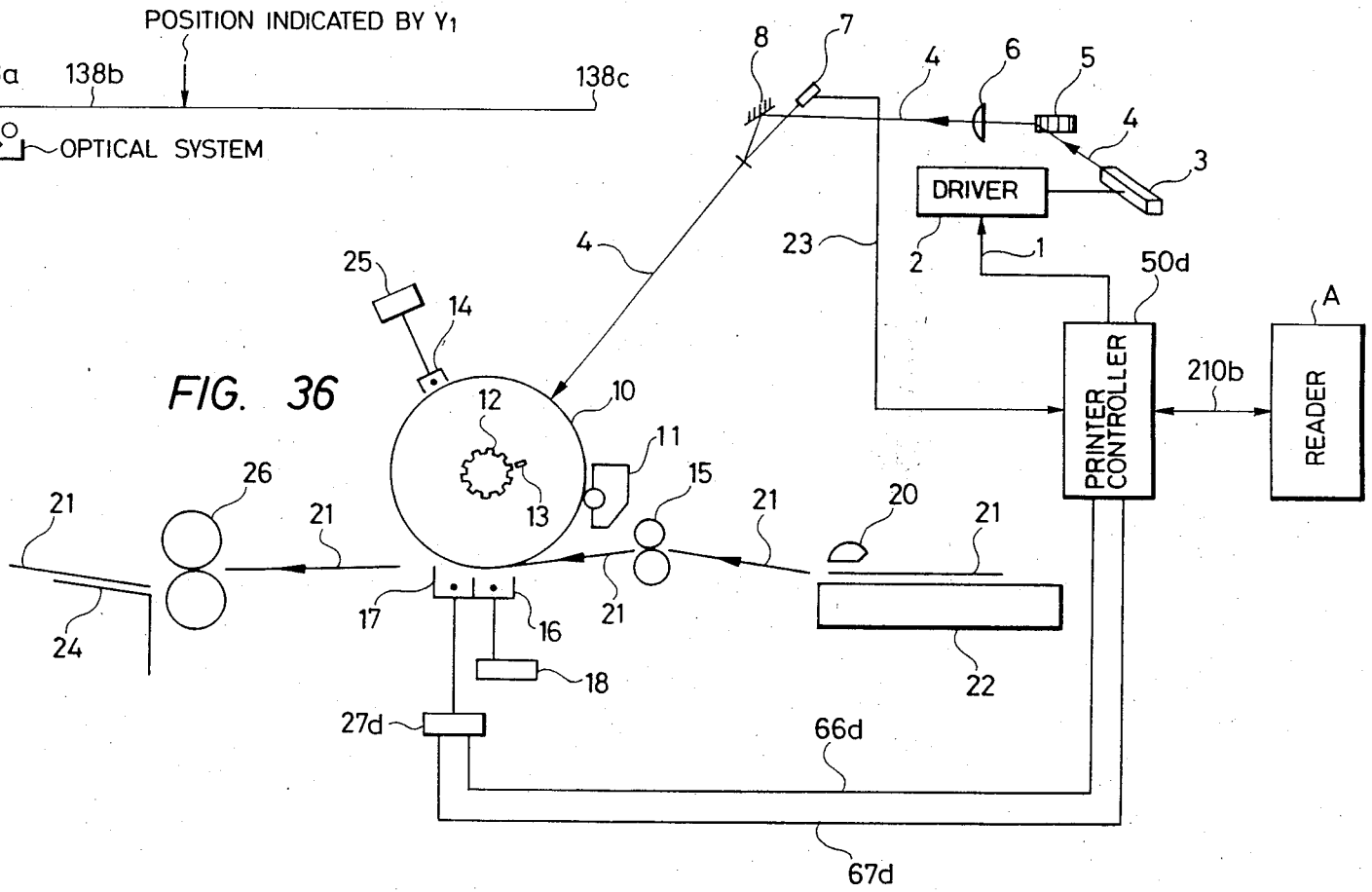
FIG. 36 is a diagram showing the configuration of a printer section in the fifth embodiment of the present invention.
FIG. 38 is a diagram for explaining the movement of the optical system in the reader A.

FIG. 36 shows the configuration of the printer B.

The same reference numerals as in FIG. 27 denote the same parts as in FIG. 36, and a detailed description thereof will be omitted.

The printer B includes a separation charge eliminating power source 27*d* as a power source of a separation charge eliminator 17, a printer controller 50*d*, and an interface cable 210*b* between the printer controller 50*d* and the reader A. The cable 210*b* transmits signals VIDEO 1, VSYNCREQUEST 90, VSYNC 91, BRATE 93*a*, and the like.

The printer controller 50*d* supplies a separating high voltage ON/OFF signal 66*d* for controlling a high voltage AC section of the separation charge eliminator power source 27*d*, and a 4-bit separating DC level voltage 67*d* for controlling the superposition DC voltage output from the power source 27*d*.

In this embodiment, the power source 27*d* supplies a positive DC voltage on an AC voltage of 5.0 kVrms to the separation charge eliminator 17. A transfer material 21 is charge eliminated by a separation corona generated by this high voltage.

As was described with reference to the prior art, the relationship between the image area ratio of the transfer material and the application DC voltage of the separation charge eliminator is closely associated with the separability of the transfer material and re-transfer property of toner. More specifically, the image area ratio varies in each original. When a DC voltage corresponding to each image area ratio is applied to the charge eliminator, separation of the transfer material is facilitated and re-transfer of toner is prevented.

In view of this, in accordance with the present invention, the image area ratio determined in the reader is encoded into 4-bit data and is supplied to the printer as a signal BRATE 93*a*. In response to the 4-bit signal BRATE 93*a*, the printer controller 50*d* supplies a 4-bit separation DC level signal 67*d* to the separation charge eliminator power source 27*d*. The power source 27*d* can easily control its output voltage by, for example, performing digital-to-analog conversion of the received 4-bit separation DC level signal 67*d*.

Figure 37:
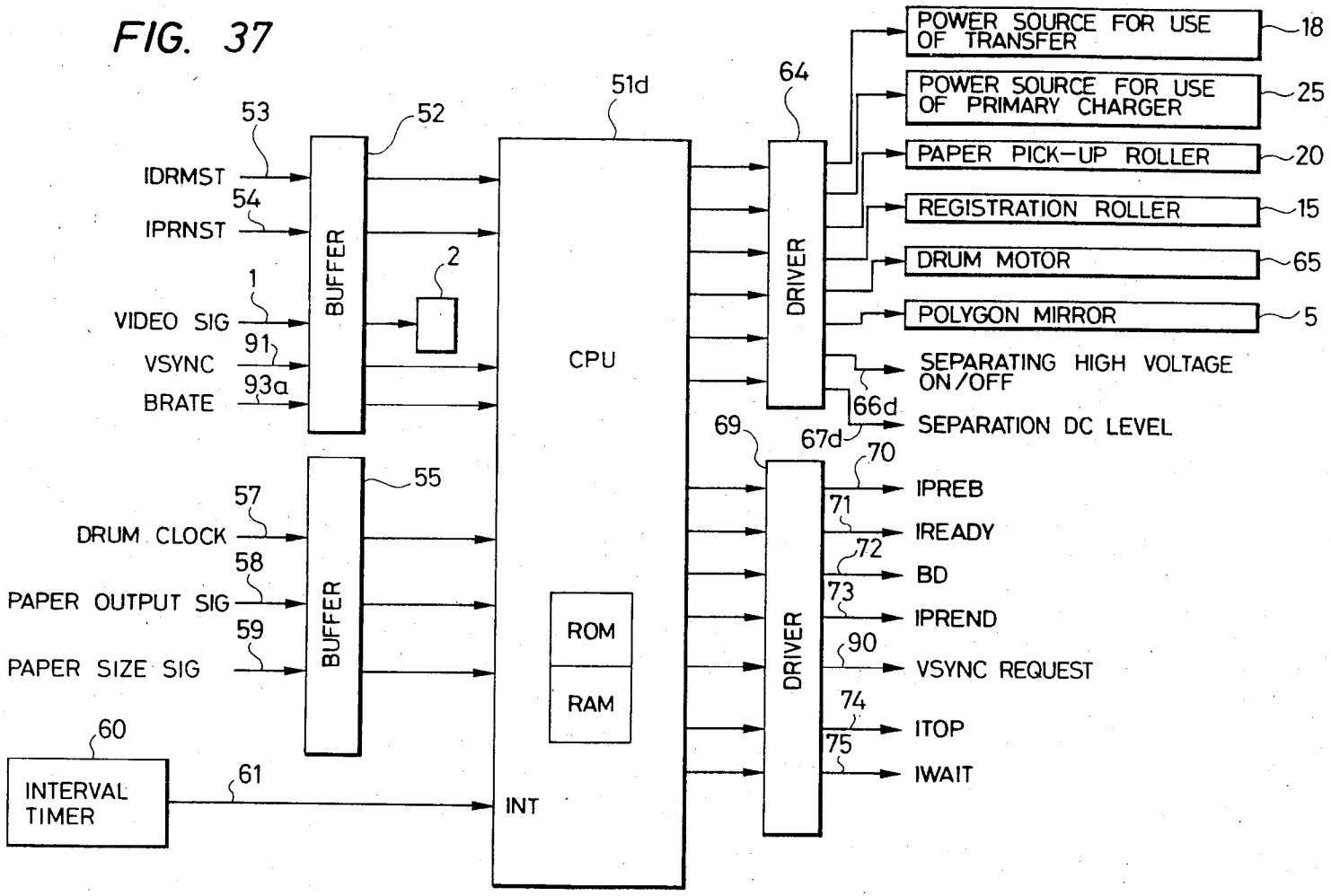
FIG. 37 is a block diagram of the main part of a printer controller 50*d*.

FIG. 37 is a block diagram showing the main control section of the printer controller 50*d* of the printer B.

The same reference numerals as in FIG. 28 denote the same parts or similar parts of the same functions in FIG. 37, and a detailed description thereof will be omitted.

Referring to FIG. 37, a buffer 52 receives an input interface signal from the reader A. A buffer 55 and a driver 64 perform exchange of various signals within the printer B.

The operation of the printer controller 50*d* is performed in accordance with a program stored in a ROM or RAM in a CPU 51*d*. The CPU 51*d* operates independently of a CPU 1200*a* in the reader A.

In order to perform a single copy operation as a system incorporating the reader A and the printer B, the operation of the CPU 51*d* is synchronized with that of the CPU 1200*a* at times, as needed. The timings for scanning the original by the reader A, the convey start of the transfer material 21 by the registration rollers 15, and generation of a signal VSYNC 91 will be described with reference to FIGS. 38 and 6A. Upon reading the following description, the significance of the "preset time period" in step 423 in the flow shown in FIG. 35A will become clear.

FIG. 38 shows a state wherein all prescan has been completed and the optical system is stopped, i.e., the state in step 422 in FIG. 35A. Y1 and Y4 coordinates are minimum and maximum set position coordinates of the original which are detected in prescan.

As can be apparent from FIG. 38 and FIG. 6A, the transfer material 21 is set at the point E such that the distance between the points C and D is equal to that between the points D and E. The reader A generates a signal VSYNC 91 when the optical system reaches the Y1 coordinate.

In response to the signal VSYNC 91, the printer B starts driving the registration rollers 15. Then, the movement of the optical system, the rotation of the drum 10, and convey operation of the transfer material 21 are synchronized.

In accordance with a simplest method for achieving this synchronization, instead of setting the preset time period in step 423, the printer B sends a signal VSYNCREQUEST 90 to signal that the transfer material 21 has reached the point E. Then, the CPU 1200*a* can start forward movement of the optical system in response to the signal VSYNCREQUEST 90 (step 424).

However, this method requires a long wait time and provides only a low efficiency. Therefore, instead of waiting for reception of the signal VSYNCREQUEST 90 in step 423, the forward movement of the optical system can be started after a preset time period. The preset time period can be a minimum time period so as not to allow the optical system to pass through the sensor 138*b* when the pick-up roller 20 is driven and the transfer material 21 reaches the point E after a signal IPRNST 54 is generated.

However, even with this method, the transfer material 21 reaches the point E before the preset time period elapses, and the material 21 which has reached the point E waits until the optical system reaches the Y1 coordinate. Thus, the efficiency is still low. Since the rotating speed of the registration rollers 15 and the moving speed of the optical system are known and the Y1 coordinate of the original is also known by prescan, the time required for the optical system to reach the Y1 coordinate can be determined by the CPU 1200*a*. Therefore, a minimum time period is determined in step 422 such that the optical system does not exceed the Y1 coordinate when the transfer material 21 reaches the point E. Forward movement of the optical system can be started after the minimum time period elapses. Then, the wait time can be minimized, and the copy efficiency can be improved.

Figures 1, 39:
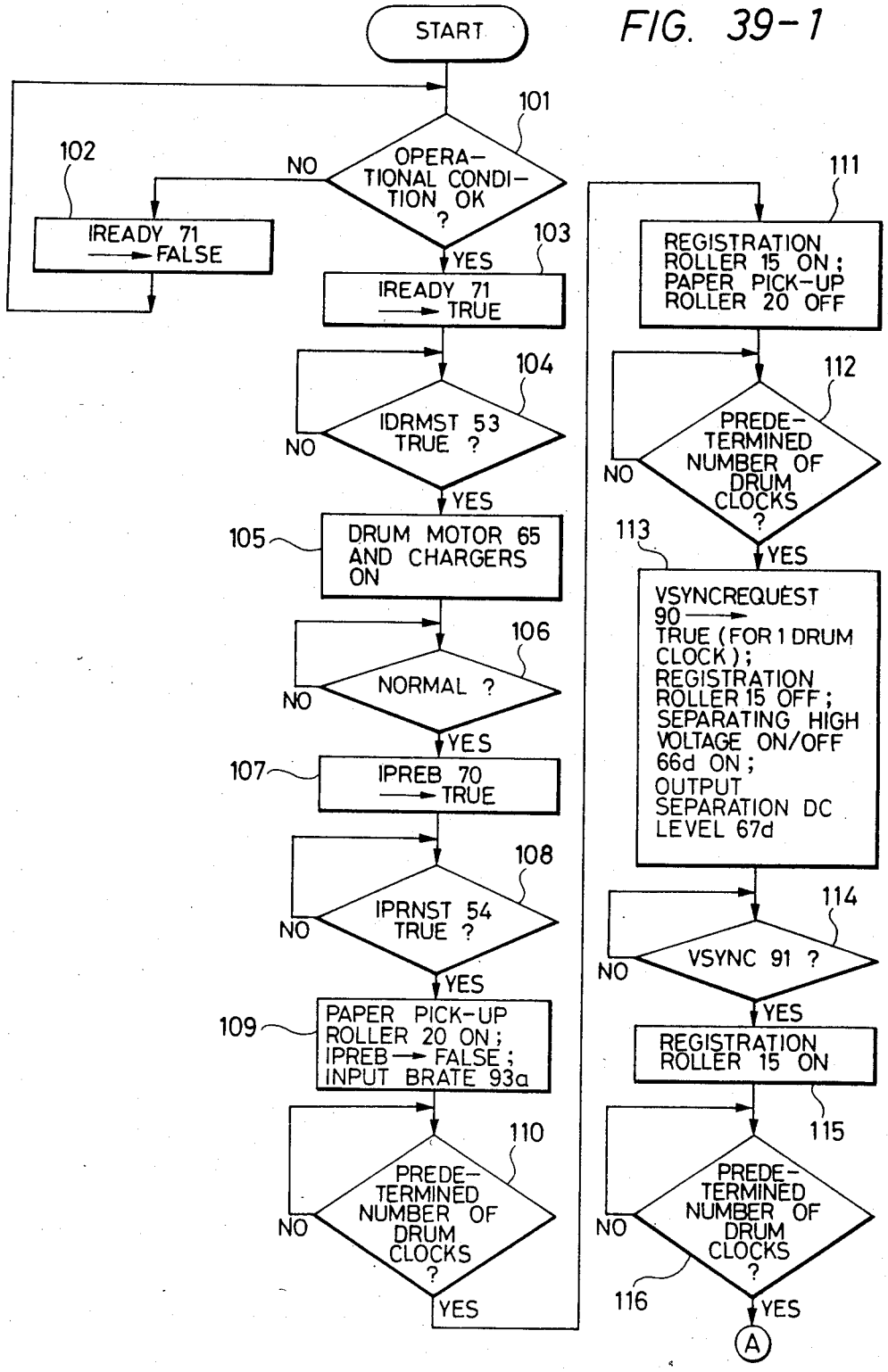
Figures 2, 39:
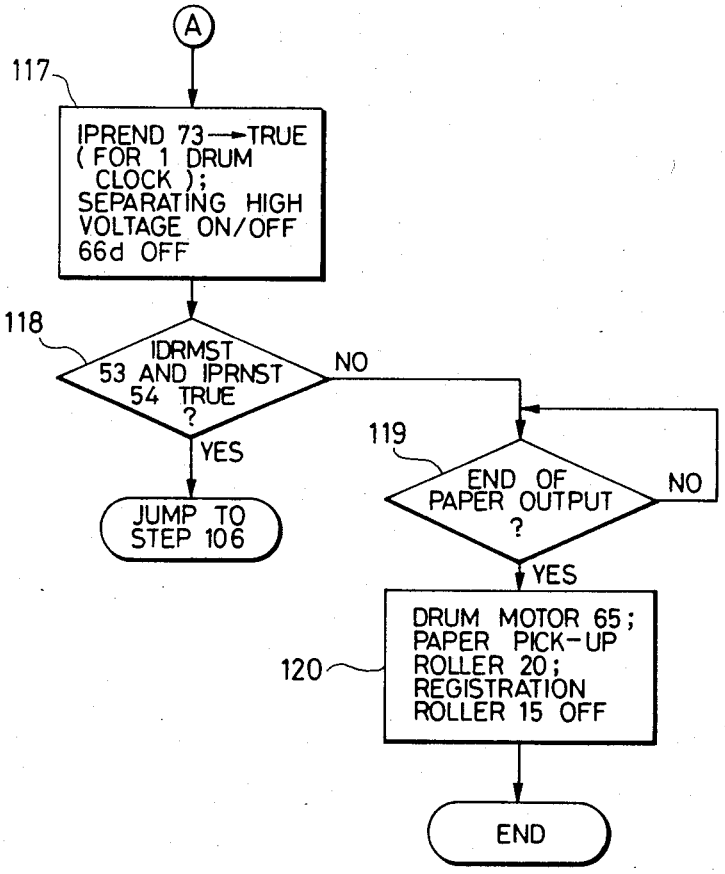

Assuming the synchronized relationship between the reader and the printer described above, the control flow of the control section of the printer B will be described with reference to FIGS. 39 and 35.

When power of the copying machine is turned on, the program of the CPU 51*d* starts to run and initialization is performed. In step 101, it is checked if the temperature of the fixing unit has reached a predetermined temperature. If YES and other conditions are also met, a signal IREADY 71 is supplied to the reader A in step 103.

When the signal IREADY 71 is true and an original to be copied is present, the reader A supplies a signal IDRMST 53 (drum rotation instruction) to the CPU 51*d* of the printer B (step 403). In response to this signal (step 104), the CPU 51*d* turns on the drum motor 65 and the primary charger power source 25, and sets the surface potential of the drum surface at a recordable potential (step 105).

When recording can thus be performed, the CPU 51*d* supplies a true signal IPREB 70 to the reader A through the driver 69 (steps 106 & 107). Then, the printer B awaits reception of a signal IPRNST 54 from the reader A.

As described with reference to FIG. 35, the controller of the reader A performs steps 404 to 411. After the prescan 1 is completed and the original coordinates are determined, a signal IPREB 70 from the printer B is checked if any failure has occurred in the printer B (step 412). If NO, the reader A performs prescan 2 (step 413 to 420) to determine the image area ratio (step 504). The reader A then supplies signals BRATE 93*a* and IPRNST 54 to the printer B (step 421).

The CPU 51*d* drives the pick-up roller 20 through the driver 69, sets the signal IPREB 70 false, and enters the print sequence (steps 108 & 109). The signal BRATE 93*a* is saved for later use. Thereafter, since the drum clock 57 as an output from a sensor 13 mounted on the drum 10 is supplied to the CPU 51*d* through the buffer 55, the CPU 51 performs sequence control while confirming the position of the transfer material by means of the drum clock 57.

At this time, the optical system of the reader A is stopped (step 422). Whether the transfer material 21 conveyed by the pick-up roller 20 has reached the registration rollers 15 can be confirmed by counting the number of drum clocks 57 (step 110). When the transfer material reaches the registration rollers 15, the registration rollers 15 are driven and the pick-up roller 20 is stopped (step 111). The transfer material 21 is fed to the point E in FIG. 6A by the registration rollers 15.

Whether the optical system has reached the point E can be confirmed by the count of the drum clocks 57 (step 112). Therefore, when the transfer material 21 reaches the point E, the registration rollers 15 are stopped, a signal VSYNCREQUEST 90 is supplied to the reader A, and a separating high-voltage ON/OFF signal *66d* is turned on. A separation DC level signal *67d* is also supplied to the power source *27d* (step 113). The power source *27d* starts corona discharge by a voltage corresponding to the image area ratio. Then, the power source voltage can rise to a sufficiently high voltage before the transfer material 21 reaches the drum. In step 114, reception of a signal VSYNC 91 from the reader A is awaited.

In response to a signal VSYNCREQUEST 90, in the reader A, the preset time period in step 423 has elapsed and forward movement of the optical system has started (step 424). Alternatively, forward movement of the optical system can be started in response to a signal VSYNCREQUEST 90. The effect obtained by starting forward movement of the optical system at each timing is as described above.

After starting forward movement, the optical system reaches the leading edge Y1 coordinate of the original past the sensor *138b* (steps 425 to 428). When the optical system reaches the Y1 coordinate, it supplies a signal VSYNC 91 representing sending of a signal VIDEO 1 to the printer B (step 429) and subsequently supplies the signal VIDEO 1 (step 430).

In response to the signal VSYNC 91 (step 114), the printer B resumes driving of the registration rollers 15 (step 115). The signal VIDEO 1 sent from the reader A is converted into a laser beam by the laser driver 2 and the laser maser 3 in FIG. 2, and scans the drum surface.

In this manner, the image read from the original is formed as an electrostatic latent image on the drum 10, visualized into a toner image, and transferred onto the transfer material 21 by the transfer charger 16. The transfer material 21 is tightly attached to the drum. However, since the transfer material is subjected to corona discharge at a voltage corresponding to the image area ratio, separation performance is good and re-transfer of toner is not caused.

After an image signal of one page determined by a paper size signal 59 is processed (step 116), a signal IPREND 73 is set true for the one clock period through the driver 69 so as to signal the reader A that printing of one print zone has been completed. At the same time, the separating ON/OFF signal *66d* is turned off (step 117).

The signal IPRMST 53 from the reader A is checked (step 118). If the signal IPRMST 53 is true, there is still an original to be copied, so that the flow jumps to step 106 and the routine after step 106 is repeated.

When all copy operations are completed, and both the signals IDRMST 53 and IPRNST 54 are set false (step 118), after the transfer sheets are all output (step 119), the drum motor 65, the pick-up roller 20 and the registration rollers 15 are turned off. Thus, all the copy operation is completed.

In the above embodiment, the present invention is applied to a laser beam printer. However, the present invention is similarly applicable to a recording apparatus using an LED array or an OFT array as a light source.

In the above embodiment, the AC voltage applied to the separation charge eliminator 17 is set constant, and the DC superposition voltage is switched. However, the DC superposition voltage can be kept constant, and the AC voltage can be switched.

The present invention is not limited to the particular embodiments described above, and various changes and modifications can be made within the spirit and scope of the present invention.

What is claimed is:

1. An image forming apparatus comprising:

a recording medium;

image forming means for forming an image on said recording medium in accordance with an input image signal;

convey means for conveying a transfer material;

separating means for separating from said recording medium the transfer material which is conveyed by said convey means;

detection means for detecting a state of said input image signal; and control means for controlling said separating means in accordance with an output of said detection means.

2. An apparatus according to claim 1, wherein said control means controls a switching timing of an output from said separating means in accordance with the output of said detection means.

3. An apparatus according to claim 2, wherein said separating means includes a separation charge eliminator.

4. An apparatus according to claim 1, wherein said detection means detects whether information representing a black image is present in said input image signal.

5. An apparatus according to claim 4, wherein said control means determines a drive timing and an output level of said separating means in accordance with a detection output of said detection means.

6. An image forming apparatus comprising:

a recording medium;

image forming means for forming an image on said recording medium in accordance with an input image signal;

transfer means for transferring an image formed on said recording medium onto a transfer material;

detection means for detecting a state of said input image signal; and control means for controlling said transfer means in accordance with an output of said detection means.

7. An apparatus according to claim 6, further comprising separating means for separating the transfer material on said recording medium.

8. An apparatus according to claim 6 wherein said control means controls an operation timing of said transfer means in accordance with the output of said detection means.

9. An apparatus according to claim 8, wherein said transfer means includes a transfer charger.

10. An apparatus according to claim 6, wherein said detection means detects whether information representing a black image is present in said input image signal.

11. An apparatus according to claim 7, wherein said control means determines a drive timing and an output level of said transfer means and a drive timining and an output level of said separating means.

12. An apparatus according to claim 7, wherein said separating means has a separation charge eliminator.

13. An image forming apparatus comprising:

read means for reading an image of an original;
means for reproducing the image of the original read by said read means onto a recording medium;
convey means for conveying a transfer material;
separating means for separating from said recording medium the transfer material which is conveyed by said convey means;
detection means for detecting a state of an image signal outputted from said read means; and
control means for controlling said separating means in accordance with an output of said detection means.

14. An apparatus according to claim 13, wherein said control means controls a switching timing of an output from said separating means in accordance with the output of said detection means.

15. An apparatus according to claim 13, wherein said separating means includes a separation charge eliminator.

16. An apparatus according to claim 8, wherein said detection means detects whether information representing a black image is present in said image signal.

17. An apparatus according to claim 16, wherein said control means determines a drive timing and an output level of said separating means in accordance with a detection output of said detection means.

18. An apparatus according to claim 13, wherein said detection means detects a ratio of an image area of an original to the total area thereof, and said control means controls an output level of said detection means.

19. An image forming apparatus comprising:
a recording medium;
image forming means for forming an image on said recording medium;
transfer means for transferring an image formed on said recording medium onto a transfer material;
detection means for detecting an image area or a non-image area on said recording medium; and
control means for controlling said transfer means in accordance with a detection output of said detection means.

20. An apparatus acoording to claim 19, wherein said image forming means forms an image on the recording medium on the basis of the input image signal, and said detection means detects an image area or a non-image area on the basis of information representing a black image in said image signal.

* * * * *

UNITED STATES PATENT AND TRADEMARK OFFICE

CERTIFICATE OF CORRECTION

PATENT NO. : 4,728,991 Sheet 1 of 3

DATED : March 1, 1988

INVENTOR(S) : KENZO TAKAYAMA, ET AL.

Figure 14A:
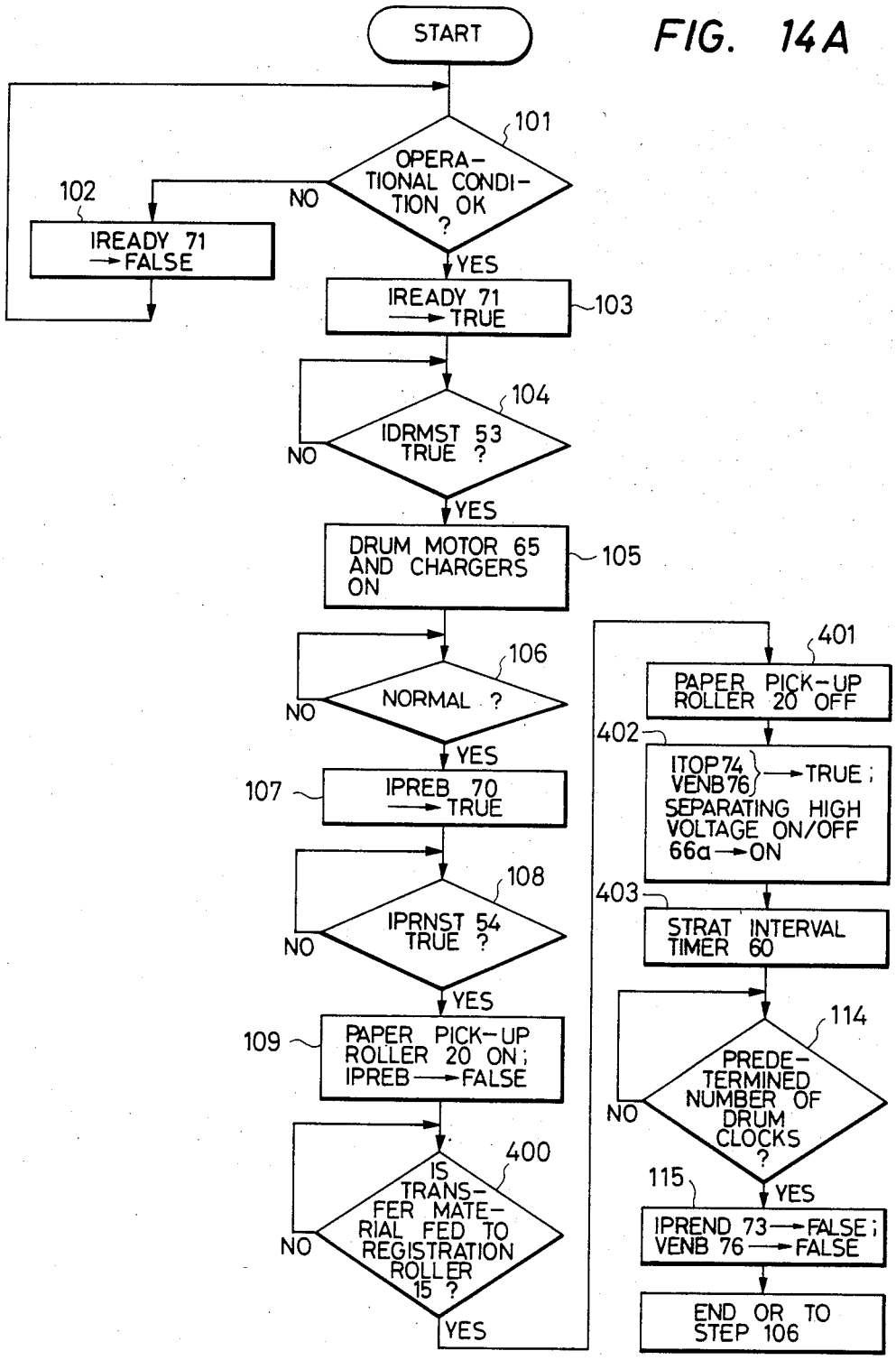
FIGS. 14A, 14B and 14C are flow charts of a control sequence when the photosensitive drum and the registration rollers are in the positional relationship as shown in FIG. 6B.
Figure 14B:
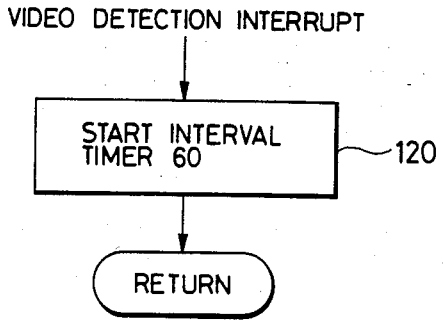
Figure 14C:
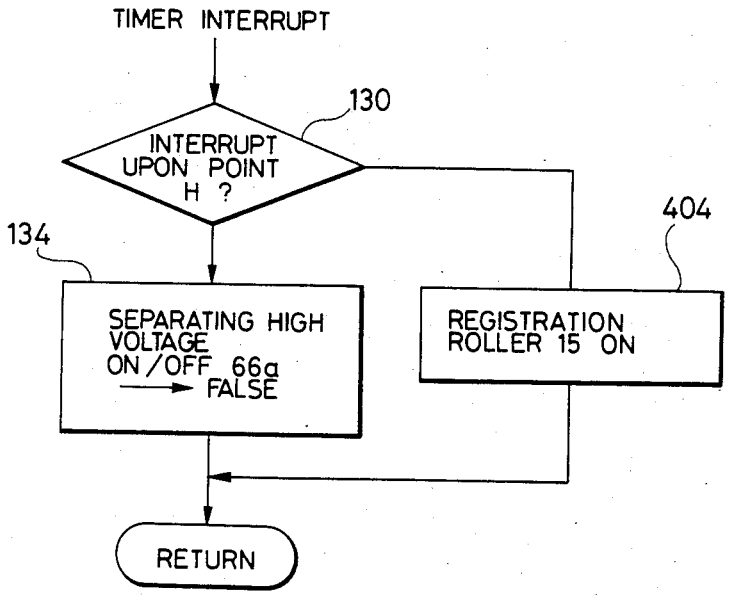

It is certified that error appears in the above-identified patent and that said Letters Patent is hereby corrected as shown below:

IN THE DRAWING:

Sheet 1, Fig. 1A and 1B, "APPLING" should read --APPLYING--;

Sheet 2, Fig. 2, "PATIO" should read --RATIO--;

Sheet 15, Fig. 14A, "STRAT" should read --START--.

Column 2, line 60, "an" should read --as an--.

Column 5, line 21, "configuration" should read --configuration of--;

line 59, "FIGS. 30A-1, 30A-2, and 30C" should read --FIGS. 30A-1, 30A-2, 30B and 30C--;

line 68, "sect" should read --section--.

Column 7, line 47, "mateiral" should read --material--.

Column 11, line 12, "apparatus20" should read --apparatus 200--;

line 53, "drum H" should read --drum 10--.

Column 14, line 45, "FIG. 16A" should read --FIG. 6A--;

UNITED STATES PATENT AND TRADEMARK OFFICE

CERTIFICATE OF CORRECTION

PATENT NO. : 4,728,991 Sheet 2 of 3

DATED : March 1, 1988

INVENTOR(S) : KENZO TAKAYAMA, ET AL.

It is certified that error appears in the above-identified patent and that said Letters Patent is hereby corrected as shown below:

Column 17, lines 47-48, "for exe-cuted" should read --for execution--.

Column 18, line 48, "signal 76b" should read --signal 67b--.

Column 23, line 20, "604 and 604'" should read --602 and 602'--;

line 30, "glass 33" should read --glass 133--;

line 60, "cover 34" should read --cover 134--.

Column 24, line 31, "unitl" should read --until--.

Column 26, line 7, "timings is" should read --timings are--;

line 17, "two" should read --to two--.

Column 29, line 49, "reader B" should read --printer B--.

Column 31, line 3, "to equal" should read --to be equal--.

Column 34, line 14, "staretd" should read --started--.

UNITED STATES PATENT AND TRADEMARK OFFICE

CERTIFICATE OF CORRECTION

PATENT NO. : 4,728,991 Sheet 3 of 3

DATED : March 1, 1988

INVENTOR(S) : KENZO TAKAYAMA, ET AL.

It is certified that error appears in the above-identified patent and that said Letters Patent is hereby corrected as shown below:

Column 38, line 53, "claim 6" should read --claim 6,--;

line 64, "timining" should read --timing--.

Column 39, line 20, "claim 8," should read --claim 13,--.

Column 40, line 6, "said detection" should read --said separating means in accordance with a detecting output of said detection--;

line 18, "acoording" should read --according--.

Signed and Sealed this

Fourth Day of October, 1988

*Attest:*

DONALD J. QUIGG

*Attesting Officer*

*Commissioner of Patents and Trademarks*